US005488787A

United States Patent [19]

Aoyagi et al.

[11] Patent Number: 5,488,787

[45] Date of Patent: Feb. 6, 1996

[54] HYDRAULIC DRIVE SYSTEM FOR CONSTRUCTION MACHINE

[75] Inventors: Yukio Aoyagi, Ibaraki; Kazuhiko Otsubo, Tsuchiura; Gen Yasuda, Ibaraki; Koji Fujita, Ibaraki; Takayuki Yamakawa, Ibaraki; Kazuyoshi Narita, Ibaraki, all of Japan

[73] Assignee: Hitachi Construction Machinery Co., Ltd., Tokyo, Japan

[21] Appl. No.: 284,410

[22] PCT Filed: Feb. 9, 1994

[86] PCT No.: PCT/JP94/00192

§ 371 Date: Aug. 3, 1994

§ 102(e) Date: Aug. 3, 1994

[87] PCT Pub. No.: WO94/18399

PCT Pub. Date: Aug. 18, 1994

[30] Foreign Application Priority Data

Feb. 9, 1993 [JP] Japan ..... 5-21344
Apr. 14, 1993 [JP] Japan ..... 5-087425

[51] Int. Cl.[6] ..... F16D 31/02; G06F 15/20

[52] U.S. Cl. ..... 37/348; 172/2; 414/699; 364/424.07

[58] Field of Search ..... 37/348, 103; 60/413, 60/469, 431; 91/6, 28, 461, 453, 520; 172/2, 4, 4.5, 7, 9; 364/424.07; 414/24.5, 473, 411, 699; 280/707, 714

[56] References Cited

U.S. PATENT DOCUMENTS

| | | | |
|---|---|---|---|
| 4,744,285 | 5/1988 | Presley | 172/2 X |
| 4,746,264 | 5/1988 | Kishi et al. | 414/687 |
| 4,809,586 | 3/1989 | Gage et al. | 91/6 |
| 4,848,790 | 7/1989 | Fukunaga et al. | 280/707 |
| 5,195,864 | 3/1993 | Drake et al. | 414/699 |
| 5,361,211 | 11/1994 | Lee et al. | 414/699 X |
| 5,392,539 | 2/1995 | Hirata et al. | 37/348 |
| 5,425,431 | 6/1995 | Brandt et al. | 414/699 X |

FOREIGN PATENT DOCUMENTS

| | | |
|---|---|---|
| 61-112069 | 7/1986 | Japan . |
| 1-75604 | 5/1989 | Japan . |
| 3-13364 | 2/1991 | Japan . |
| 4-30038 | 2/1992 | Japan . |

*Primary Examiner*—Randolph A. Reese
*Assistant Examiner*—Robert Pezzuto
*Attorney, Agent, or Firm*—Fay, Sharpe, Beall, Fagan, Minnich, & McKee

[57] ABSTRACT

When a prime mover (1) is driven, a controller (25) outputs an open-drive signal for bringing an opening/shutting valve (23) into an open position and, upon a control lever (68, etc.) being operated, a hydraulic fluid is supplied from an auxiliary hydraulic pump (7) through pressure reducing valves to driving sectors of directional control valves (8 to 16) for shifting them. A flow rate and a direction of flow of the hydraulic fluid from main hydraulic pumps (3, 4) are thereby adjusted so that actuators (57A, 57B, 57C, 56A, 54) can be each operated at a speed depending on the amount by which the control lever is operated. When one of the actuators (57A, 57B, 57C, 56A, 54) is to be driven when the prime mover (1) is not driven, an open command is selected in a selection command device (24), whereupon the controller (25) outputs the open-drive signal, causing the opening/shutting valve (23) to open a line interconnecting the accumulator (21) and the pressure reducing valve (17), etc. By now operating the control lever (68), for example, the directional control valve (9) is shifted so that a boom cylinder (57A) is operated with the dead weight of a working unit to allow a descent thereof. When any of the actuators (57A, 57B, 57C, 56A, 54) is not to be driven when the prime mover (1) is in a stopped state, a shut command is selected in the selection command device (24), whereupon the controller (25) outputs a shut-drive signal, causing the opening/shutting valve (23) to shut off the line interconnecting the accumulator (21) and the pressure reducing valve (17). Even if the control lever (68), etc. are touched by a mistake under such a condition, no actuators (57A, 57B, 57C, 56A, 54) are operated and the working unit is not descended. Thus, the actuators are surely prevented from being operated against the intention of an operator.

20 Claims, 32 Drawing Sheets

HYDRAULIC DRIVE SYSTEM FOR CONSTRUCTION MACHINE

TECHNICAL FIELD

The present invention relates to a hydraulic drive system mounted on construction machines such as hydraulic excavators.

Background Art

A conventionally known hydraulic drive system for hydraulic excavators comprises a prime mover, a main hydraulic pump driven by the prime mover, actuators such as a travel motor, a swing motor, a boom cylinder, an arm cylinder and a bucket cylinder which are driven by a hydraulic fluid delivered from the main hydraulic pump, directional control valves for controlling respective flows of the hydraulic fluid supplied from the main hydraulic pump to the actuators, an auxiliary hydraulic pump driven by the prime mover, and control valve operating means for controlling a hydraulic fluid delivered from the auxiliary hydraulic pump to operate the directional control valves.

In a hydraulic drive system for large-sized hydraulic excavators, it is known to dispose, in addition to the above arrangement, accumulator means or an accumulator in a line branched from a line interconnecting the auxiliary hydraulic pump and the control valve operating means, as disclosed in JP, A, 4-30038, for example. With this arrangement, if any control valve operating means is operated as occasion requires even after stop of the prime mover, the hydraulic fluid from the accumulator serves as a hydraulic source to shift the corresponding directional control valve for driving the corresponding actuator.

Specifically, the above accumulator is utilized, for example, when the corresponding actuator should be driven to operate a working unit which is left suspended in midair upon the prime mover being stopped due to a failure, for descending the working unit down to the ground by its own dead load, or when the directional control valve should be shifted to introduce the hydraulic fluid, which is left in the line connected to the corresponding actuator, to a low-pressure circuit for pressure release before front attachments such as an arm and a boom are disassembled for the purpose of displacement or transportation.

Disclosure of the Invention

In the above-described prior art, however, if an operator or any other person touches the control valve operating means by a mistake after stop of the prime mover, the hydraulic fluid from the accumulator may be supplied to a driving sector of the corresponding directional control valve to shift the same such that the corresponding actuator is brought into an operable state. This results in a disadvantage that the actuator may be operated against the intention of an operator, e.g., that the working unit left suspended in midair, as mentioned above, is descended by gravity.

The present invention has been made in view of the foregoing situation in the prior art, and its object is to provide a hydraulic drive system for a construction machine in which a directional control valve is not shifted even if control valve operating means is touched accidentally while a prime mover is in a stopped state.

To achieve the above object, according to the present invention, there is provided a hydraulic drive system for a construction machine comprising a prime mover, main hydraulic pumps driven by said prime mover, actuators driven by a hydraulic fluid delivered from said main hydraulic pumps, directional control valves for controlling flows of the hydraulic fluid supplied from said main hydraulic pumps to said actuators, an auxiliary hydraulic pump driven by said prime mover, control valve operating means for controlling the hydraulic fluid delivered from said auxiliary hydraulic pump to shift said directional control valves, and accumulator means disposed in a line branched from a line interconnecting said auxiliary hydraulic pump and said control valve operating means, said directional control valves being shifted by using said accumulator means as a hydraulic source for said control valve operating means when said prime mover is in a stopped state, wherein said hydraulic drive system further comprises stop detecting means for detecting that said prime mover is in the stopped state, selection means for selecting whether said actuators are to be driven or not when said prime mover is in the stopped state, and shift control means for enabling said directional control valves to be shifted with the aid of said accumulator means when said stop detecting means detects that said prime mover is in the stopped state and said selection means selects that said actuators are to be driven, and disabling said directional control valves from shifting with the aid of said accumulator means when said stop detecting means detects that said prime mover is in the stopped state and said selection means selects that said actuators are not to be driven.

In the present invention arranged as above, for example, when an operator desires to drive one actuator while the prime mover is in the stopped state, he selects driving of the actuator in the selection means, whereupon the shift control means allows the directional control valve to be effectively shifted with the aid of the accumulator means, because the stop detecting means detects that the prime mover is in the stopped state. Specifically, the hydraulic fluid stored in the accumulator means as a hydraulic source is supplied through the control valve operating means to a driving sector of the directional control valve corresponding to the actuator. Thus, since the directional control valve can be shifted upon operation of the control valve operating means, the actuator corresponding to that directional control valve is brought into an operable state. For example, in the case of that actuator being connected to a working unit which is left in midair, the actuator is driven with the dead load of the working unit, enabling the working unit to descend.

On the other hand, when the operator has no intention of driving the actuator while the prime mover is in the stopped state, he selects non-driving of the actuator in the selection means, whereupon the shift control means disables the directional control valve from shifting with the aid of the accumulator means, because the stop detecting means detects that the prime mover is in the stopped state. At this time, therefore, even if the operator or any other person touches the control valve operating means by a mistake, the hydraulic fluid stored in the accumulator means will not be supplied through the control valve operating means to a driving sector of the directional control valve. As a result, the directional control valve is not shifted and held in its neutral position to prevent the corresponding actuator from being operated.

In the above hydraulic drive system for a construction machine, preferably, said shift control means enables said directional control valves to be shifted using said auxiliary hydraulic pump as a hydraulic source when said stop detecting means does not detect that said prime mover is in the stopped state.

With such an arrangement, when the actuator is to be driven while the prime mover is in the driven state, because the stop detecting means does not detect that the prime mover is in the stopped state, the hydraulic fluid from the auxiliary hydraulic pump is supplied through the control valve operating means to the driving sector of the directional control valve corresponding to the actuator. By manipulating the control valve operating means, therefore, the operator can operate the actuator associated with the directional control valve.

In the above hydraulic drive system for a construction machine, preferably, said shift control means comprises valve means disposed in one of a line interconnecting said accumulator means and said control valve operating means and a line interconnecting said control valve operating means and said directional control valves, and means for shifting said valve means to shut off said one line.

With such an arrangement, the pilot pressure due to the hydraulic fluid in the accumulator means is not transmitted to the control valve operating means by being blocked off by the valve means midway the line interconnecting the accumulator means and the control valve operating means, or is transmitted to the control valve operating means, but not to the directional control valve by being blocked off by the valve means midway the line interconnecting the control valve operating means and the valve means.

In the above hydraulic drive system for a construction machine, preferably, said shift control means includes opening/shutting means disposed in the line interconnecting said accumulator means and said control valve operating means for opening and shutting said line, said selection means is selection command means for selectively receiving one of an open command to drive said opening/shutting means into an open state and a shut command to drive said opening/shutting means into a shut state, and outputting a corresponding selection command signal, and said shift control means further includes opening/shutting control means for controlling operation of said opening/shutting means in accordance with a stop detection signal output from said stop detecting means and said selection command signal.

With such an arrangement, for example, when the operator desires to drive the actuator while the prime mover is in the stopped state, by entering the open command to drive the opening/shutting means into the open state in the selection command means, the operation of the opening/shutting means is controlled by the opening/shutting control means in accordance with the selection command signal corresponding to the open command and the stop detection signal output from the stop detecting means, so that the opening/shutting means is brought into the open state to make open the line interconnecting the accumulator means and the control valve operating means. By manipulating the control valve operating means, therefore, the hydraulic fluid in the accumulator means can be supplied to the driving sector of the directional control valve for shifting the same.

On the other hand, when the operator has no intention of driving the actuator while the prime mover is in the stopped state, by entering the shut command to drive the opening/shutting means into the shut state in the selection command means, the operation of the opening/shutting means is controlled by the opening/shutting control means in accordance with the selection command signal corresponding to the shut command and the stop detection signal output from the stop detecting means, so that the opening/shutting means is brought into the shut state to shut off the line interconnecting the accumulator means and the control valve operating means. Therefore, the directional control valve is held in its neutral position without being shifted.

In the above hydraulic drive system for a construction machine, said shift control means includes auxiliary control valves disposed in pilot lines interconnecting said control valve operating means and said directional control valves and selectively shifted to either first positions to hold said directional control valves in a neutral state and second positions to bring said directional control valves into an operable state, said selection means is selection command means for selectively receiving one of a shift command to shift said auxiliary control valves to the first positions and a shift command to shift said auxiliary control valves to the second positions, and outputting a corresponding selection command signal, and said shift control means further includes auxiliary control valve control means for controlling operation of said auxiliary control valves in accordance with a stop detection signal output from said stop detecting means and said selection command signal.

With such an arrangement, for example, when the operator desires to drive the actuator while the prime mover is in the stopped state, by entering the shift command for shifting the auxiliary control valve to the second position to bring the directional control valve into the operable state, the operation of the auxiliary control valve is controlled by the auxiliary control valve control means in accordance with the selection command signal corresponding to that shift command and the stop detection signal output from the stop detecting means, so that the auxiliary control valve is shifted to the second position to make open the line interconnecting the control valve operating means and the directional control valve. By manipulating the control valve operating means, therefore, the hydraulic fluid in the accumulator means can be supplied to the driving sector of the directional control valve for shifting the same.

On the other hand, when the operator has no intention of driving the actuator while the prime mover is in the stopped state, by entering the shift command for shifting the auxiliary control valve to the first position to hold the directional control valve in the neutral state in the selection command means, the operation of the auxiliary control valve is controlled by the auxiliary control valve control means in accordance with the selection command signal corresponding to that shift command and the stop detection signal output from the stop detecting means, so that the auxiliary control valve is shifted to the first position to cut off the line interconnecting the control valve operating means and the directional control valve. Therefore, the directional control valve is held in the neutral state without being shifted.

In the above hydraulic drive system for a construction machine, preferably, said shift control means includes auxiliary control valves disposed in pilot lines interconnecting said control valve operating means and said directional control valves and selectively shifted to either first positions to hold said directional control valves in a neutral state and second positions to bring said directional control valves into an operable state, and means for shifting said auxiliary control valves to the second positions when said stop detecting means do not detect that said prime mover is in the stopped state, and said selection means is means for manually shifting said auxiliary control valves to either the first positions or the second positions.

With such an arrangement, when the actuator is to be driven while the prime mover is in the driven state, because the stop detecting means does not detect that the prime mover is in the stopped state, the auxiliary control valve is shifted to the second position to bring the directional control valve into the operable state to make open the pilot line interconnecting the control valve operating means and the directional control valve. Upon the control valve operating means manipulated by the operator, therefore, the hydraulic fluid from the auxiliary hydraulic pump can be supplied to the driving sector of the directional control valve corresponding to the actuator, thereby shifting the directional control valve.

For example, when the operator desires to drive the actuator while the prime mover is in the stopped state, by manually shifting the auxiliary control valve to the second position, the pilot line interconnecting the control valve operating means and the directional control valve is made open. By manipulating the control valve operating means, therefore, the hydraulic fluid in the accumulator means can be supplied to the driving sector of the directional control valve for shifting the same.

On the other hand, when the operator has no intention of driving the actuator while the prime mover is in the stopped state, the auxiliary control valve is shifted to the first position to hold the directional control valve in the neutral state because the stop detecting means detects that the prime mover is in the stopped state, or it is manually shifted to the first position, the pilot line interconnecting the control valve operating means and the directional control valve is cut off. Therefore, the directional control valve is held in the neutral state without being shifted.

In the above hydraulic drive system for a construction machine, preferably, said shift control means includes lock means for locking said control valve operating means to be unable to operate, said selection means is selection command means for selectively receiving one of a lock command to actuate said lock means into a locked state and an unlock command to release said lock means from the locked state, and outputting a corresponding selection command signal, and said shift control means further includes lock control means for controlling actuation of said lock means in accordance with a stop detection signal output from said stop detecting means and said selection command signal.

With such an arrangement, when the operator has no intention of driving the actuator while the prime mover is in the stopped state, by entering the lock command for actuating the lock means into the lock state in the selection command means, the operation of the lock means is controlled by the lock control means in accordance with the selection command signal corresponding to the lock command and the stop detection signal output from the stop detecting means, so that the lock means is brought into the locked state to disable the control valve operating means from operating. Therefore, the directional control valve is held in the neutral state without being shifted.

On the other hand, for example, when the operator desires to drive the actuator while the prime mover is in the stopped state, by entering the unlock command for releasing the lock means from the lock state in the selection command means, the operation of the lock means is controlled by the lock control means in accordance with the selection command signal corresponding to the unlock command and the stop detection signal output from the stop detecting means, so that the lock means is released from the locked state, enabling the control valve operating means to be operated. By manipulating the control valve operating means, therefore, the hydraulic fluid in the accumulator means can be supplied to the driving sector of the directional control valve for shifting the same.

In the above hydraulic drive system for a construction machine, preferably, said control valve operating means include control levers operated by an operator and control valves for controlling the hydraulic fluid depending on operation of said control levers, and said lock means are means for enabling said control levers to be angularly movable when said selection command means receives said unlock command, and mechanically locking said control levers to be not angularly movable when said selection command means receives said lock command.

With such an arrangement, when the operator desires to drive the actuator, by entering the unlock command in the selection command means, the lock means releases the control lever to be angularly movable and, upon the control lever being operated by the operator, the hydraulic fluid is introduced to the corresponding directional control valve through the control valve. When the operator has no intention of driving the actuator, by entering the lock command in the selection command means, the lock means mechanically locks the control lever to be not angularly movable and hence the directional control valve is held in the neutral state without being shifted.

In the above hydraulic drive system for a construction machine, preferably, said control valve operating means include pressure reducing valves having electric input means and outputting secondary pressures, which are resulted by reducing a pressure of the hydraulic fluid from said auxiliary hydraulic pump, to said directional control valves, said selection means is selection command means for selectively receiving one of an operation stop command to disable said pressure reducing valves from operating and an operation command to enable said pressure reducing valves to be operated, and outputting a corresponding selection command signal, and said shift control means is means for controlling operation of said pressure reducing valves in accordance with a stop detection signal output from said stop detecting means and said selection command signal.

With such an arrangement, for example, when the operator desires to drive the actuator while the prime mover is in the stopped state, by entering the operation command to enable the pressure reducing valves having the electric input means to be operated in the selection command means, the operation of the pressure reducing valve is controlled by the shift control means in accordance with the selection command signal corresponding to the operation command and the stop detection signal output from the stop detecting signal, so that the pressure reducing valve is brought into an open state corresponding to an electric input. Therefore, the hydraulic fluid from the accumulator means is reduced in pressure and the resulting secondary pressure is supplied to the driving sector of the directional control valve for shifting the same.

On the other hand, when the operator has no intention of driving the actuator while the prime mover is in the stopped state, by entering the operation stop command to disable the pressure reducing valves having the electric input means from operating in the selection command means, the operation of the pressure reducing valve is controlled by the shift control means in accordance with the selection command signal corresponding to the operation stop command and the stop detection signal output from the stop detecting signal, so that the pressure reducing valve is closed. Therefore, the directional control valve is held in the neutral state without being shifted.

In the above hydraulic drive system for a construction machine, therefore, said control valve operating means include pressure reducing valves having electric input means and outputting secondary pressures, which are resulted by reducing a pressure of the hydraulic fluid from said auxiliary hydraulic pump, to said directional control valves, operation detecting means for detecting a manual command from an operator and outputting a corresponding electric operation command signal, and pressure reducing valve driving means for outputting a drive signal to the input means of said pressure reducing valves in accordance with said operation command signal.

With such an arrangement, for example, when the operator manually operates the control lever, the operation detecting means detects the manual command from the operator and outputs the corresponding electric operation command signal, and the pressure reducing valve driving means outputs the drive signal to the electric input means of the pressure reducing valve in accordance with the operation command signal. Then, the pressure reducing valve outputs the secondary pressure, which is resulted by reducing the pressure of the hydraulic fluid from the auxiliary hydraulic pump, to the directional control valve, enabling the directional control valve to be finally operated.

In the above hydraulic drive system for a construction machine, preferably, said control valve operating means include manually operated pressure reducing valves for outputting secondary pressures, which are resulted by reducing a pressure of the hydraulic fluid from said auxiliary hydraulic pump, to said directional control valves.

With such an arrangement, the operator can directly operate the pressure reducing valve manually so as to output the secondary pressure, which is resulted by reducing the pressure of the hydraulic fluid from the auxiliary hydraulic pump, to the directional control valves.

In the above hydraulic drive system for a construction machine, preferably, said control valve operating means include pressure reducing valves having electric input means and outputting secondary pressures, which are resulted by reducing a pressure of the hydraulic fluid from said auxiliary hydraulic pump, to said directional control valves, operation detecting means for detecting a manual command from an operator and outputting a corresponding electric operation command signal, and pressure reducing valve driving means for outputting a drive signal to the input means of said pressure reducing valves in accordance with said operation command signal, said shift control means includes switching means for connecting and disconnecting a circuit interconnecting a power supply and the input means of said pressure reducing valves, said selection means includes selection command means for selectively receiving a turn-off command to turn off said switching means and a turn-on command to turn on said switching means, and outputting a corresponding selection command signal, and said shift control means further includes switching control means for controlling operation of said switching means in accordance with a stop detection signal output from said stop detecting means and said selection command signal.

With such an arrangement, for example, when the operator desires to drive the actuator while the prime mover is in the stopped state, by entering the turn-on command to turn on the switching means in the selection command means, the operation of the switching means is controlled by the switching control means in accordance with the selection command signal corresponding to the turn-on command and the stop detection signal output from the stop detecting means, so that the switching means is brought into a turn-on state to conduct the circuit interconnecting the power supply and the electric input means of the pressure reducing valve. Therefore, when the operator manually operates the control lever, for example, the operation detecting means detects the manual command from the operator and outputs the corresponding electric operation command signal, and the pressure reducing valve driving means outputs the drive signal to the electric input means of the pressure reducing valve in accordance with the operation command signal. Then, the pressure reducing valve outputs the secondary pressure, which is resulted by reducing the pressure of the hydraulic fluid from the auxiliary hydraulic pump, to the directional control valve, enabling the directional control valve to be finally operated.

On the other hand, when the operator has no intention of driving the actuator while the prime mover is in the stopped state, by entering the turn-off command to turn off the switching means in the selection command means, the operation of the switching means is controlled by the switching control means in accordance with the selection command signal corresponding to the turn-off command and the stop detection signal output from the stop detecting means, so that the switching means is turned off to cut off the circuit interconnecting the power supply and the electric input means of the pressure reducing valve. Therefore, no drive signal is applied to the electric input means of the pressure reducing valve, and hence the directional control valve is held in the neutral state without being shifted.

In the above hydraulic drive system for a construction machine, preferably, said stop detecting means is stop command means for receiving a stop command to command stop of said prime mover, or rotational speed detecting means for detecting a rotational speed of said prime mover, a pressure detector for detecting a delivery pressure of at least one of said main hydraulic pumps and said auxiliary hydraulic pump, or voltage detecting means for detecting an output voltage of an electric generator equipped on said prime mover.

With any of such arrangements, the means detecting that the prime mover is in the stopped state can be realized.

BEST MODE FOR CARRYING OUT THE INVENTION

Embodiments of a hydraulic drive system for a construction machine according to the present invention will hereinafter be described with reference to the drawings.

First Embodiment

A first embodiment of the present invention will be described with reference to FIGS. 1 to 9.

Figure 1:
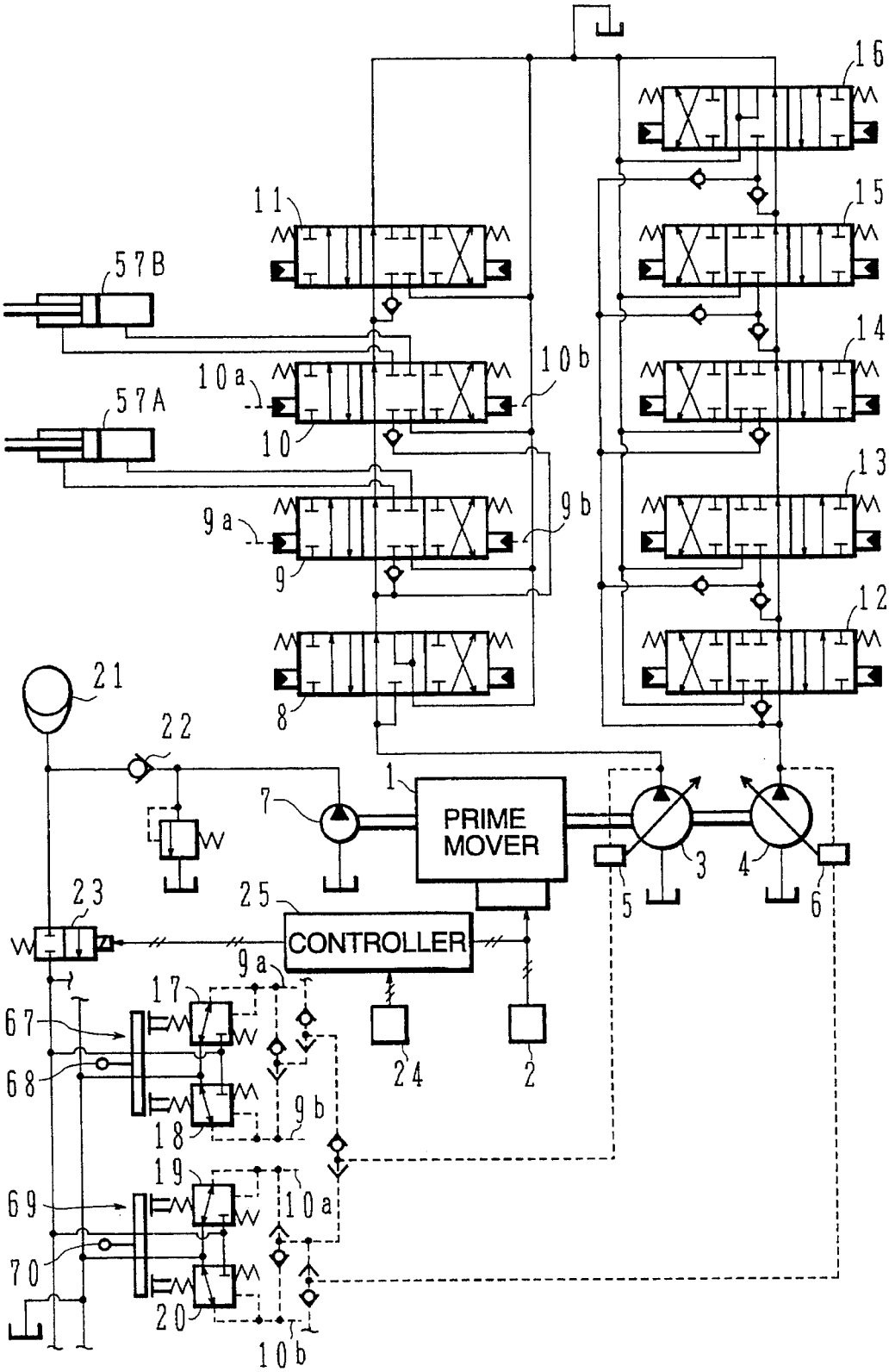
FIG. 1 is a circuit diagram of a hydraulic drive system for a construction machine according to a first embodiment of the present invention.

FIG. 1 shows a circuit diagram of a hydraulic drive system for a construction machine according to this embodiment.

Referring to FIG. 1, the hydraulic drive system of this embodiment comprises a prime mover 1, main hydraulic pumps 3, 4 driven by the prime mover 1, a plurality of actuators driven by a hydraulic fluid delivered from the main hydraulic pumps 3, 4, and directional control valves 8 to 16 for controlling respective flows of the hydraulic fluid supplied from the main hydraulic pumps 3, 4 to the actuators.

Figure 2:
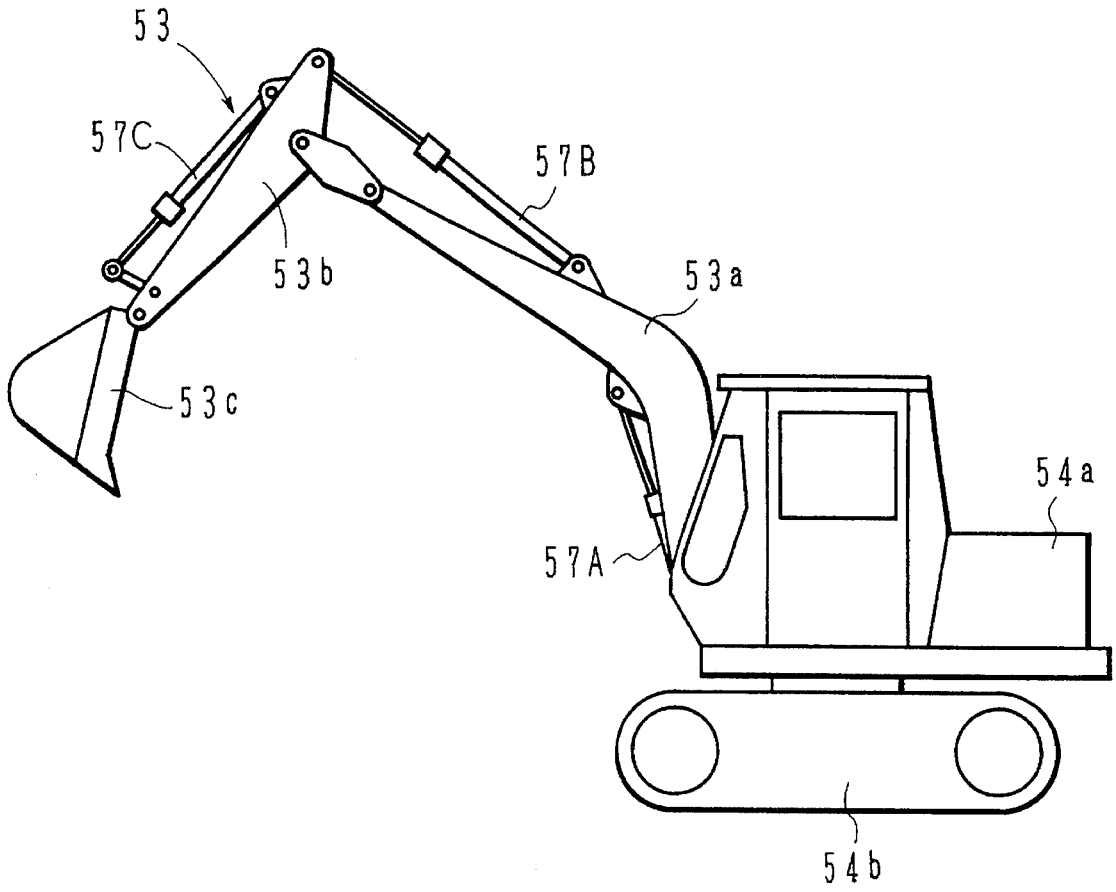
FIG. 2 is a view showing a hydraulic excavator.

In this embodiment, the hydraulic drive system is employed in a construction machine, for example, a hydraulic excavator shown in FIG. 2. The actuators comprise, e.g., boom cylinder 57A for raising and lowering a boom 53*a*, an arm cylinder 57B for driving an arm 53*b*, a bucket cylinder 57C for driving a bucket 53*c*, these boom, arm and bucket being parts of a front attachment 53, right-hand and left-hand travel motors (not shown) for driving a lower travel body 54*b*, and a swing motor (not shown) for swinging an upper swing 54*a* with respect to the lower travel body 54*b*. In FIG. 1, for the sake of brevity, only the boom cylinder 57A associated with a directional control valve 9 for controlling the hydraulic fluid supplied thereto and the arm cylinder 57B associated with a directional control valve 10 for controlling the hydraulic fluid supplied thereto are shown as the actuators, with the other actuators being omitted from the figure. But the other actuators are also associated with directional control valves 8, 11 to 16 for controlling the hydraulic fluid supplied to the respective actuators.

The hydraulic drive system for a construction machine of this embodiment further comprises an auxiliary hydraulic pump 7 driven by the prime mover 1, and a plurality of control valve operating mechanisms 67, 69, etc. for controlling a hydraulic fluid delivered from the auxiliary hydraulic pump 7 to operate the directional control valves 8 to 16. The control valve operating mechanism 67, for example, comprises pressure reducing valves 17, 18 and a control lever 68 for manually operating the pressure reducing valves 17, 18. Depending on the direction and the amount in and by which the control lever 68 is operated, the mechanism 67 generates a secondary pressure by reducing the pressure of the hydraulic fluid from the auxiliary hydraulic pump 7, and outputs the secondary pressure through lines 9*a*, 9*b* to drive the directional control valve 9 for controlling an opening of the directional control valve 9 and a direction in which it is shifted. Likewise, the control valve operating mechanism 69 comprises pressure reducing valves 19, 20 and a control lever 70 for manually operating the pressure reducing valves 19, 20. Depending on the direction and the amount in and by which the control lever 70 is operated, the mechanism 69 generates a secondary pressure by reducing the pressure of the hydraulic fluid from the auxiliary hydraulic pump 7, and outputs the secondary pressure through lines 10*a*, 10*b* to drive the directional control valve 10 for controlling an opening of the directional control valve 10 and a direction in which it is shifted. Though not shown, control valve operating mechanisms each comprising a pair of pressure reducing valves and a control lever for operating the pressure reducing valves are also provided corresponding to the other directional control valves 8, 11 to 16. Note that when the pressure reducing valves 17 to 20 and the control valve operating mechanisms 67, 69 are described below, the description is equally applied to the other pressure reducing valves and control valve operating mechanisms which are not shown.

The hydraulic drive system for a construction machine of this embodiment further comprises an accumulator 21 disposed in a line branched from a line interconnecting the auxiliary hydraulic pump 7 and the pressure reducing valves 17 to 20, etc. (or the accumulator 21 may be connected to the line interconnecting the auxiliary hydraulic pump 7 and the pressure reducing valves 17 to 20, etc. without providing the specific branch line), a check valve 22 for blocking off a flow of the hydraulic fluid from the accumulator 21 toward the auxiliary hydraulic pump 7, but allowing the hydraulic fluid to flow from the auxiliary hydraulic pump 7 toward the accumulator 21, an opening/shutting valve 23 disposed in the line interconnecting the accumulator 21 and the pressure reducing valves 17 to 20, etc. for opening and shutting that line, a stop command device 2 as stop detecting means for detecting that the prime mover 1 is in a stopped state, a selection command device 24 provided as selection means for selecting as to whether the actuator is to be driven or not, the device 24 receiving selectively an open command for driving the opening/shutting valve 23 into an open state and a shut command for driving the opening/shutting valve 23 into a shut state and then outputting a selection command signal corresponding to the received signal, a controller 25 having a logical decision function and outputting a signal to drive the opening/shutting valve 23 in accordance with the stop command signal output from the stop command device 2 and the selection command signal output from the selection command device 24, and pump operating mechanisms 5, 6 for controlling displacements of the main hydraulic pumps 3, 4.

Figure 3:
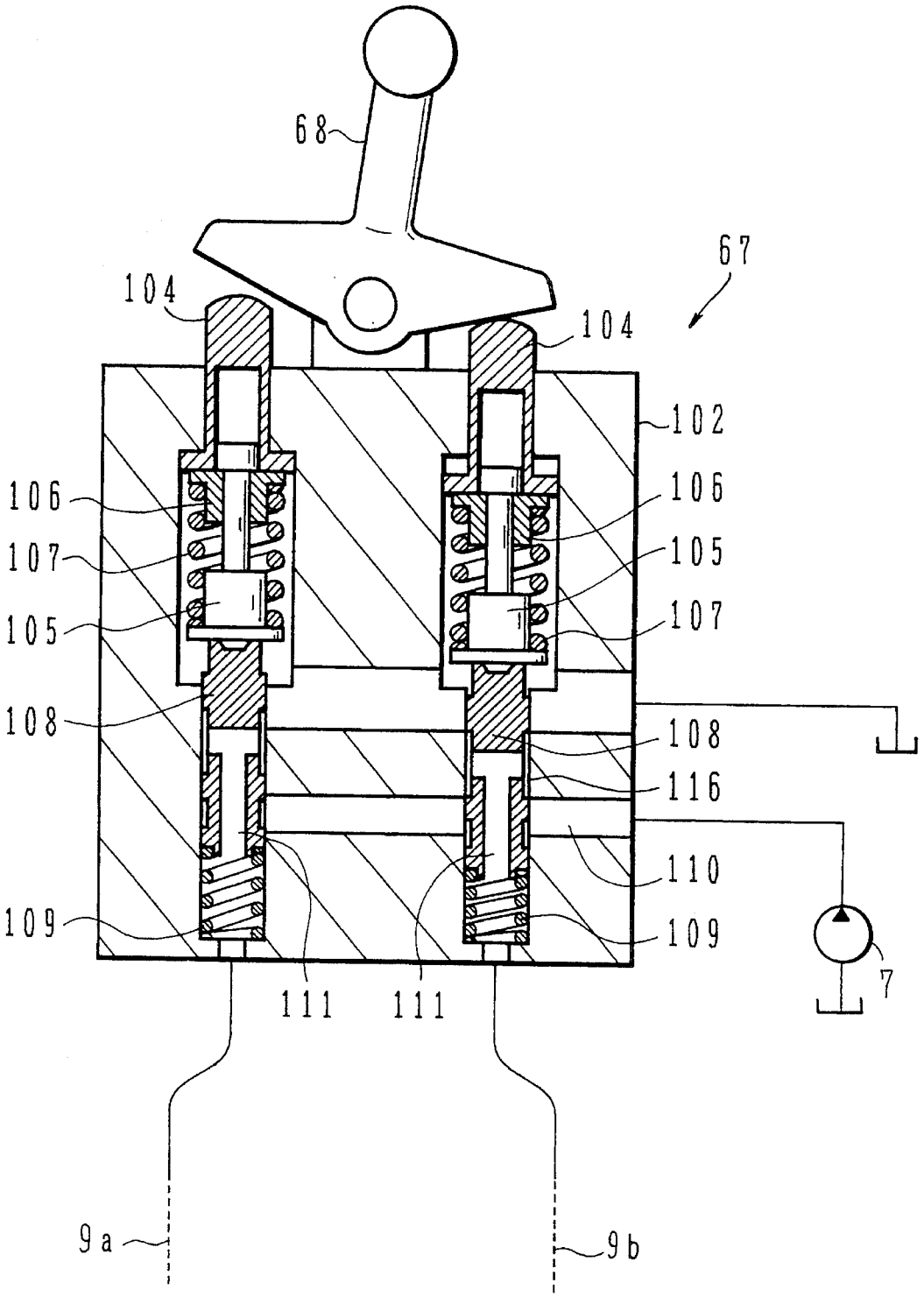
FIG. 3 is a view showing a detailed structure of a control valve operating mechanism 67.

A detailed structure of the control valve operating mechanism 67 is shown in FIG. 3.

Referring to FIG. 3, in the control valve operating mechanism 67, when the control lever 68 is operated to turn, for example, in the clockwise direction as shown, a push rod 104 engaging the control lever 68 is depressed, whereupon a spool 108 held in abutment with a rod 105 is also depressed through a sleeve 106 engaging the push rod 104, a spring 107 and the rod 105 against a resilient force of the spring 107. At this time, until a port 116 communicating with a passage 111 in the spool 108 is brought into communication with a passage 110 in a body 102, the hydraulic fluid from the auxiliary hydraulic pump 7 as a hydraulic source is not introduced to the lines 9*a*, 9*b* for the directional control valve 9, and a pilot pressure for operating the valve 9 is equal to the reservoir pressure, i.e., nearly zero. When the spool 108 is further depressed and the port 116 of the spool 108 is communication with the passage 110, the hydraulic fluid from the auxiliary hydraulic pump 7 is introduced to the passage 111 through the passage 110 and the port 116. In this way, within a predetermined pressure range, the pilot pressure output from the control valve operating mechanism 67 to the directional control valve 9 for operating the same is increased progressively depending on the amount by which the control lever 68 is operated.

Figure 4:
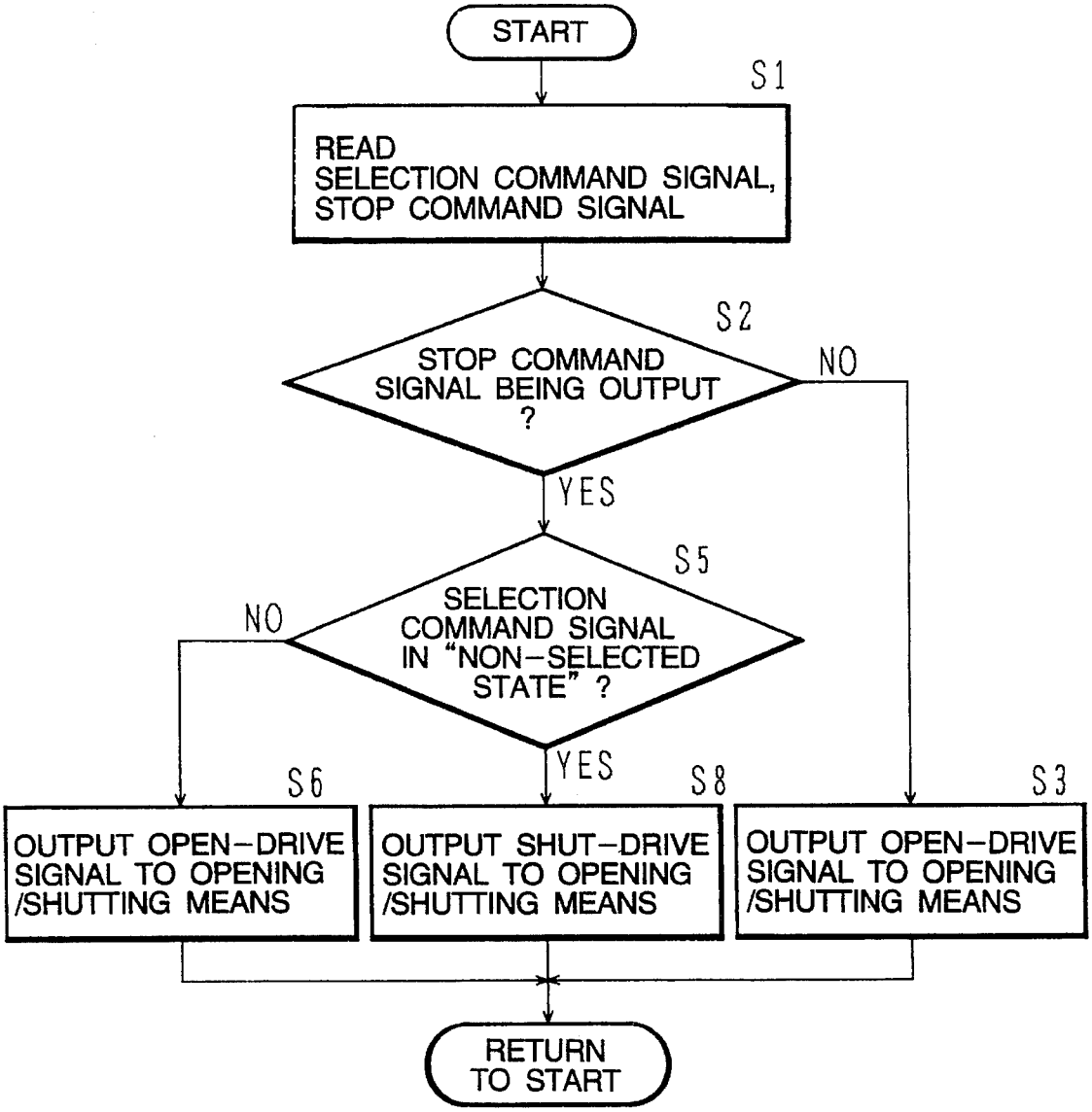
FIG. 4 is a flowchart showing operation of the hydraulic drive system for a construction machine according to the first embodiment.

Operation of this embodiment arranged as above will now be described with reference to a flowchart of FIG. 4 showing a process sequence carried out in the controller 25.

First, as shown at step S1, the controller 25 reads the stop command signal output from the stop command device 2 and the selection command signal output from the selection command device 24. Then, the process goes to step S2 to determine whether the stop command signal is output or not. If the decision in step S2 is not satisfied, then the process goes to step S3 upon judgment that the prime mover 1 is in a driven state. In step S3, the controller 25 outputs an open-drive signal for driving the opening/shutting valve 23 into an open state. The opening/shutting valve 23 is thereby opened to make open the line interconnecting the auxiliary hydraulic pump 7 and the pressure reducing valves 17 to 20, etc. The hydraulic fluid delivered from the auxiliary hydraulic pump 7 is supplied to the accumulator 21 as well to be accumulated therein. At this time, the main hydraulic pumps 3, 4 are driven with the operation of the prime mover 1 so that the hydraulic fluid from the main hydraulic pumps 3, 4 is supplied to center bypass passages of the directional control valves 8 to 16. When any of the control levers 68, 70, etc. is now operated, the hydraulic fluid from the auxiliary hydraulic pump 7 is supplied to a driving sector of the corresponding directional control valve through the corresponding pressure reducing valve, whereby the corresponding directional control valve is shifted. On this occasion, as a spool stroke of that directional control valve increases, an opening of a passage communicating a pump port with an actuator port of that directional control valve and an opening of a passage communicating the actuator port with a reservoir port of that directional control valve are increased gradually, while an opening of a throttle for opening and shutting the center bypass passage is reduced. Therefore, a flow rate of the hydraulic fluid flowing into the corresponding actuator from one of the main hydraulic pumps 3, 4 or a flow rate of the hydraulic fluid flowing out of the corresponding actuator, and a direction of flow of the hydraulic fluid are adjusted, enabling that actuator to be operated at a speed depending on the amount by which corresponding one of the control levers 68, 70, etc. is operated. At this time, maximum one of the pilot pressures from the pressure reducing valves 17 to 20, etc. is introduced to the pump operating mechanisms 5, 6, and delivery pressures of the main hydraulic pumps 3, 4 are also introduced to the pump operating mechanisms 5, 6. The pump operating mechanisms 5, 6 perform horsepower control in which displacements of the main hydraulic pumps 3, 4 are controlled so that an input torque of the main hydraulic pumps 3, 4 is kept within an output torque of the prime mover 1. Upon completion of the foregoing procedures in step S3, the process returns to the start.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the decision in above step S2 in the controller 25 is satisfied, the process goes to step S5 upon judgment that the prime mover 1 is in a non-driven state. In step S5, it is determined whether the selection command signal output from the selection command device 24 is a signal in a non-selected state or not, i.e., whether the selection command signal is a shut command signal for bringing the opening/shutting valve 23 into a shut state. When an operator selects the open command in the selection command device 24, which is a command to select driving of the actuator, with an intention of driving the actuator, the decision in step S5 is not satisfied and the process goes to step S6. In step S6, to allow the directional control valve to be effectively shifted with the aid of the accumulator 21, the controller 25 outputs the open-drive signal for driving the opening/shutting valve 23 into the open state to make open the line interconnecting the accumulator 21 and the pressure reducing valves 17 to 20, etc. By operating any of the control levers 68, 70, etc., therefore, the hydraulic fluid in the accumulator 21 is supplied to a driving sector of the corresponding directional control valve to shift the same, whereby the corresponding actuator can be brought into an operable state. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating the control lever 68, enabling the boom cylinder 57A to be operated with the dead load of the working unit, which results in a descent of the working unit. Upon completion of the foregoing procedures in step S6, the process returns to the start.

On the other hand, when the operator selects the shut command in the selection command device 24, which is a command to select non-driving of the actuator, with no intention of driving the actuator while the prime mover 1 is in the stopped state as mentioned above, the decision in step S5 as to whether the selection command signal is in the non-selected state or not is satisfied and the process goes to step S8. In step S8, to disable any shift of the directional control valve with the aid of the accumulator 21, the controller 25 outputs the shut-drive signal for driving the opening/shutting valve 23 into the shut state to shut off the line interconnecting the accumulator 21 and the pressure reducing valves 17 to 20, etc., whereby no pilot pressures due to the hydraulic fluid in the accumulator 21 are transmitted to the pressure reducing valves 17 to 20. Accordingly, even if the operator or any other person touches any of the control levers 68, 70, etc. by a mistake under the above condition, the directional control valves 8 to 16 are held in neutral positions with no fear that the hydraulic fluid in the accumulator 21 may be supplied to the pressure reducing valves 17 to 20, etc. to shift the directional control valves 8 to 16. Therefore, no actuators are operated and the working unit is kept at rest in midair without descending. In other words, the actuators can be surely prevented from operating against the intention of the operator. Upon completion of the foregoing procedures in step S8, the process returns to the start.

Even when the prime mover 1 is stopped against the intention of the operator because of a failure in itself or an overload imposed thereon, the hydraulic fluid in the accumulator 21 can be supplied to the directional control valves 8 to 16 through the pressure reducing valves 17 to 20, etc. by entering the stop command in the stop command device 2 and selecting the open command in the selection command device 24 so that the opening/shutting valve 23 is driven into the open state. Then, by operating one of the control levers 68, 70, etc. under the above condition to hold corresponding ones of the pressure reducing valves 17 to 20, etc. in their neutral positions, the corresponding directional control valve can be returned to the neutral position and hence the operation of the corresponding actuator can be surely prevented.

Second Embodiment

A second embodiment of the present invention will be described with reference to FIG. 5.

Figure 5:
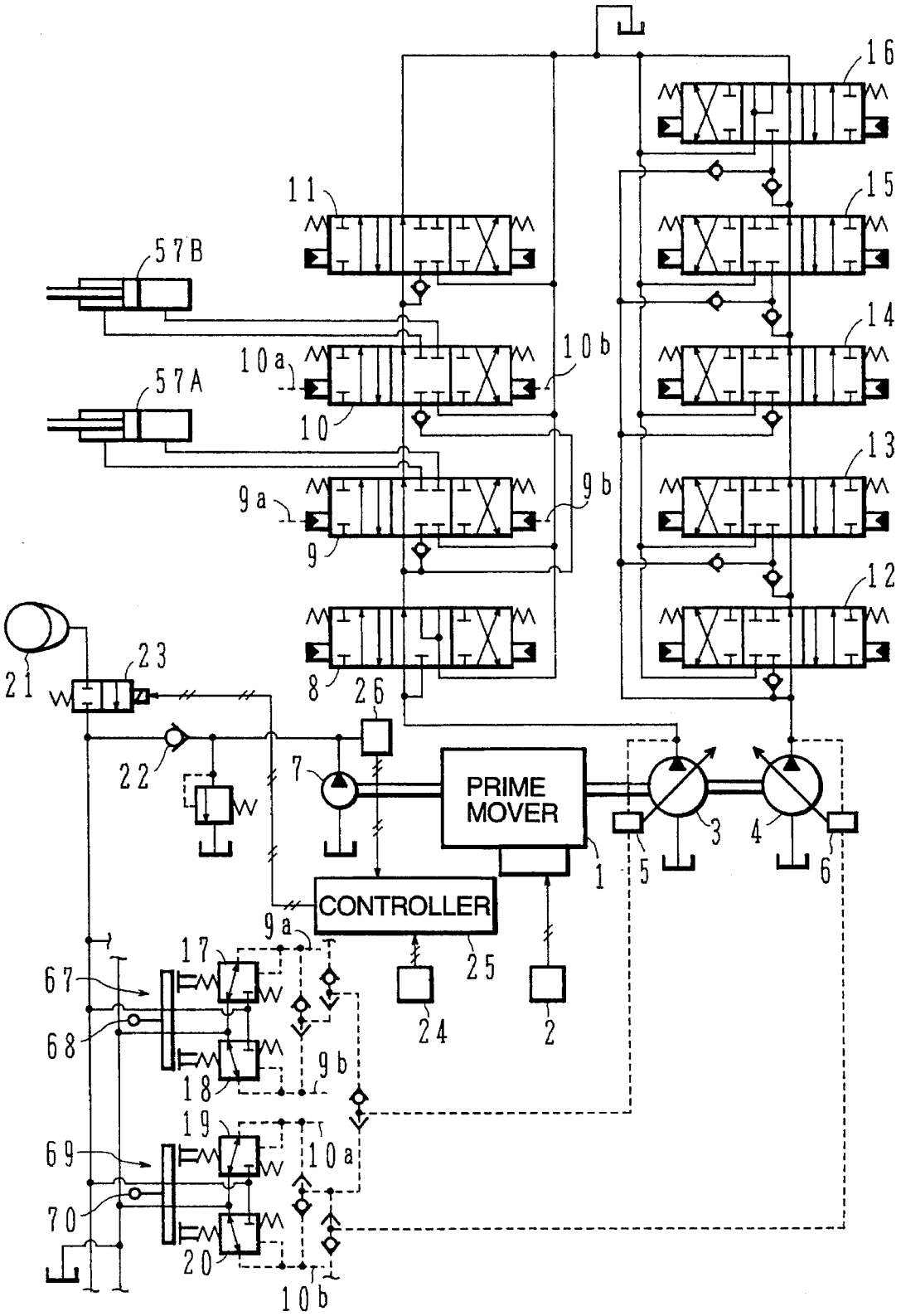
FIG. 5 is a circuit diagram of a hydraulic drive system for a construction machine according to a second embodiment of the present invention.

FIG. 5 shows a circuit diagram of a hydraulic drive system for a construction machine according to this embodiment. Identical members to those in the first embodiment are denoted by the same reference numerals.

Referring to FIG. 5, the hydraulic drive system of this embodiment is different from the hydraulic drive system of the first embodiment in that a pressure detector 26 for detecting the delivery pressure of the auxiliary hydraulic pump 7 driven by the prime mover 1 is provided as the stop detecting means for detecting that the prime mover 1 is in a stopped state, that the controller 25 outputs the open- or shut-drive signals to drive the opening/shutting valve 23 into the open or shut states in accordance with a pressure signal output from the pressure detector 26 and the selection command signal output from the selection command device 24, and that the opening/shutting valve 23 is disposed in the line which is branched from the line interconnecting the auxiliary hydraulic pump 7 and the pressure reducing valves 17 to 20, etc. and to which the accumulator 21 is connected. The remaining arrangement is substantially the same as in the first embodiment.

Operation of this embodiment arranged as above is different from the operation of the first embodiment in that if a value of the pressure signal output from the pressure detecting device 26 is not less than the predetermined value in S2 in FIG. 4, then the process goes to S3 upon judgment by the controller 25 that the prime mover 1 is in the driven state, and if a value of the pressure signal is less than the predetermined value, then the process goes to S5 upon judgment by the controller 25 that the prime mover 1 is in the non-driven state. The remaining operation is the same as in the first embodiment.

This embodiment can also provide similar advantages to those in the first embodiment.

As an alternative, a delivery pressure of the main hydraulic pump 3 or 4 may be detected by the pressure detector 26. This modification will be described with reference to FIG. 6.

Figure 6:
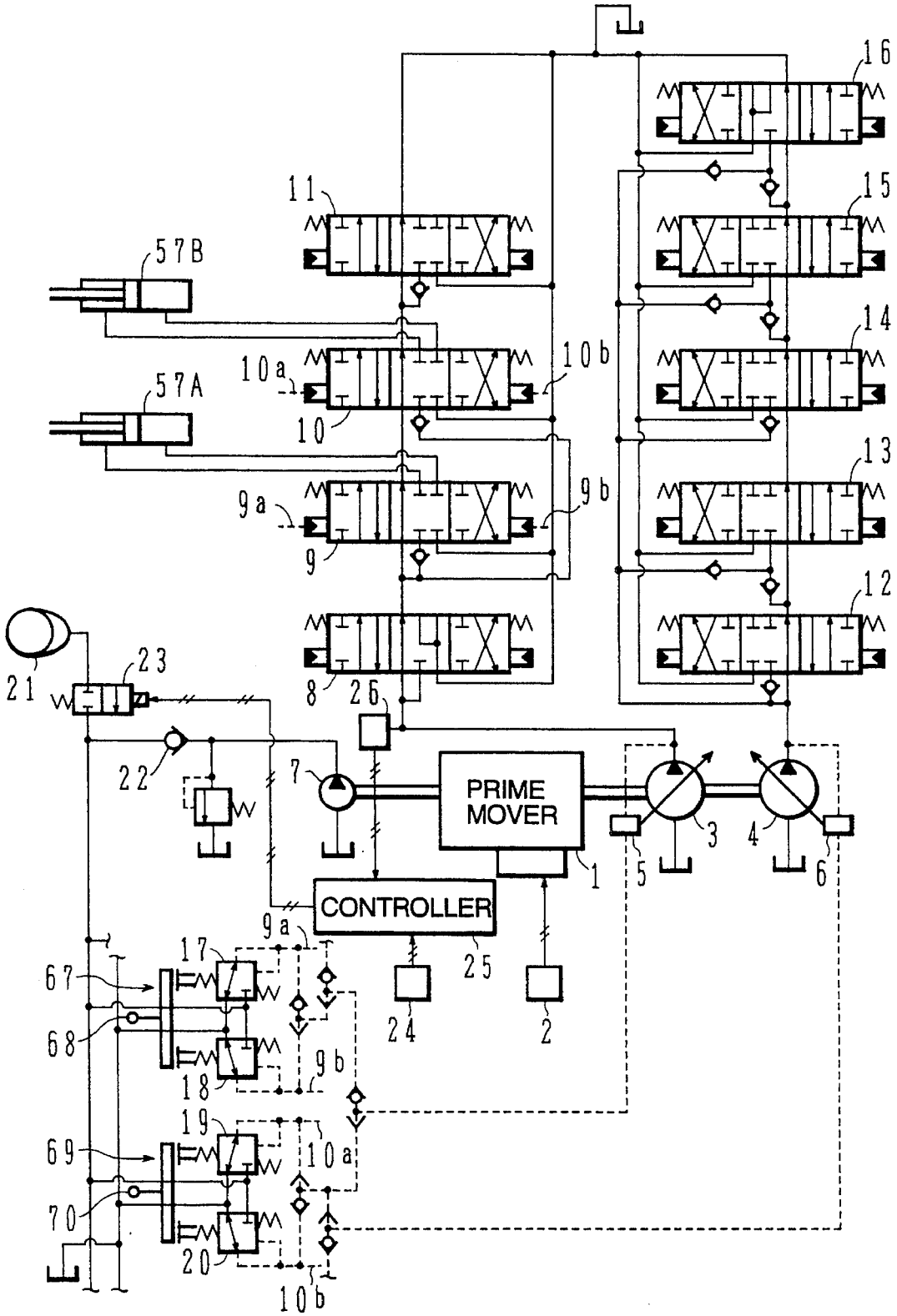
FIG. 6 is a circuit diagram of a hydraulic drive system for a construction machine according to a modification of the second embodiment of the present invention.

Referring to FIG. 6, a pressure detector 26 for detecting the delivery pressure of the main hydraulic pump 3 driven by the prime mover 1 is provided as the stop detecting means for detecting that the prime mover 1 is in a stopped state, and the controller 25 outputs the open- or shut-drive signals to drive the opening/shutting valve 23 into the open or shut states in accordance with a pressure signal output from the pressure detector 26 and the selection command signal output from the selection command device 24. In this case, a throttle (not shown) for restricting a flow in a small amount is disposed downstream of the directional control valve 11 to produce a slight pressure in the center bypass line even when the directional control valves 8 to 11 are all in the neutral positions. Whether the prime mover 1 is being driven or not can be detected by detecting such a pressure with the pressure detector 26. The foregoing is equally applied to the directional control valves 12 to 16.

While the delivery pressure of the main hydraulic pump 3 is detected in the above, the delivery pressure of at least one of the main hydraulic pumps 3, 4 may be detected.

This modification can also provide similar advantages to those in the first embodiment.

Third Embodiment

A third embodiment of the present invention will be described with reference to FIGS. 7 to 9.

Figure 7:
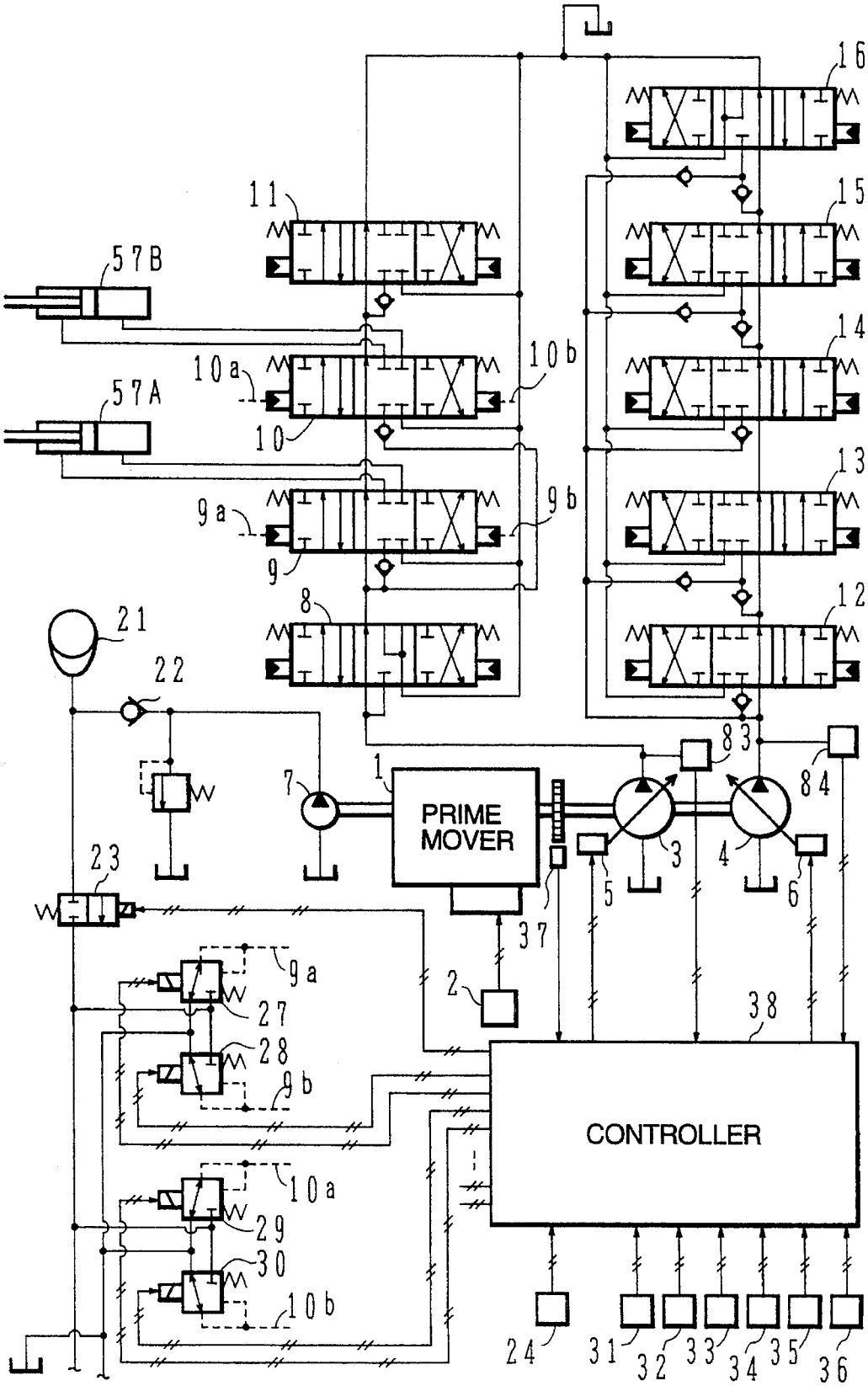
FIG. 7 is a circuit diagram of a hydraulic drive system for a construction machine according to a third embodiment of the present invention.

FIG. 7 shows a circuit diagram of a hydraulic drive system for a construction machine according to this embodiment. Identical members to those in the first and second embodiments are denoted by the same reference numerals.

Referring to FIG. 7, the hydraulic drive system of this embodiment is different from the hydraulic drive system of the first embodiment in that pressure sensors 83, 84 for measuring the delivery pressures of the main hydraulic pumps 3, 4 are provided, that the control valve operating mechanism for controlling the hydraulic fluid delivered from the auxiliary hydraulic pump 7 to operate the directional control valves 8 to 16 comprises operation detecting mechanisms 31 to 36 for detecting operation of respective control levers (not shown) as operation commands and outputting corresponding operation command signals to a controller 38, the controller 38 for outputting drive signals in accordance with the operation command signals, and solenoid proportional pressure reducing valves 27 to 30, etc. having electric input means to receive the drive signals output from the controller 38 and outputting secondary pressures, which are resulted by reducing the pressure of the hydraulic fluid from the auxiliary hydraulic pump 7 in accordance with the drive signals, to the directional control valves 8 to 16, and that a rotational speed detector 37 for detecting a rotational speed of the prime mover 1 is provided as the stop detecting means for detecting that the prime mover 1 is in a stopped state. The controller 38 also outputs the open- or shut-drive signals to drive the opening/shutting valve 23 into the open or shut states in accordance with a rotational speed signal output from the rotational speed detector 37 and the selection command signal output from the selection command device 24.

A detailed configuration of each of the operation detecting mechanisms 31 to 36 will be described with reference to FIG. 8, taking the operation detecting mechanism 31 as an example.

Figure 8:
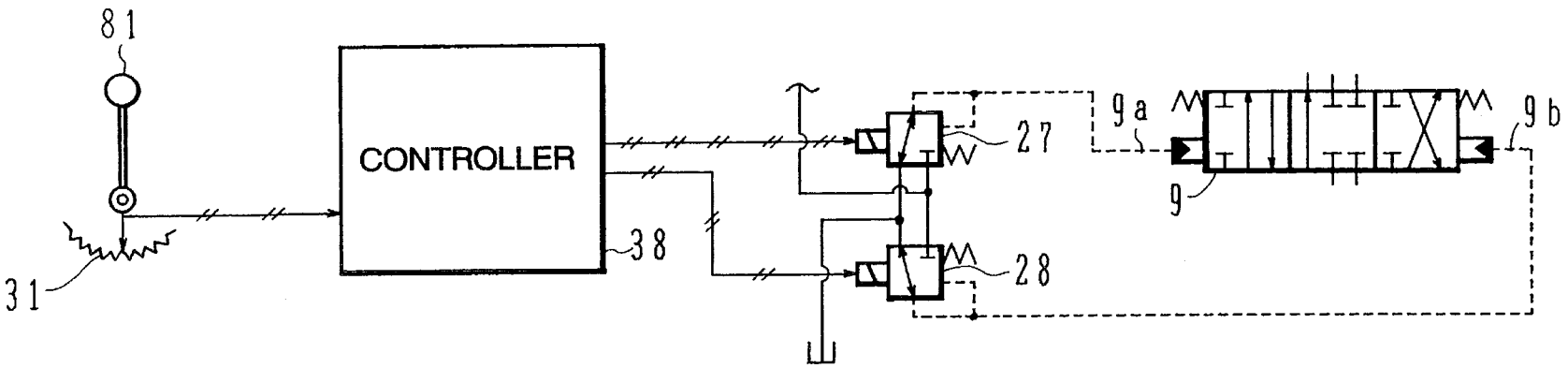
FIG. 8 is a view showing a detailed configuration of an operation detecting mechanism.

Referring to FIG. 8, the operation detecting mechanism 31 comprising a potentiometer, for example, is disposed in a base of a control lever 81 so as to cooperate with the control lever. The operation detecting mechanism 31 detects the position to which the control lever 81 is operated, as an operation command, and outputs a corresponding operation command signal to the controller 38. Based on a preset gain curve, the controller 38 outputs a drive signal corresponding to the operation command signal to the solenoid proportional pressure reducing valve 27 or 28.

The remaining arrangement is substantially the same as in the first embodiment.

Figure 9:
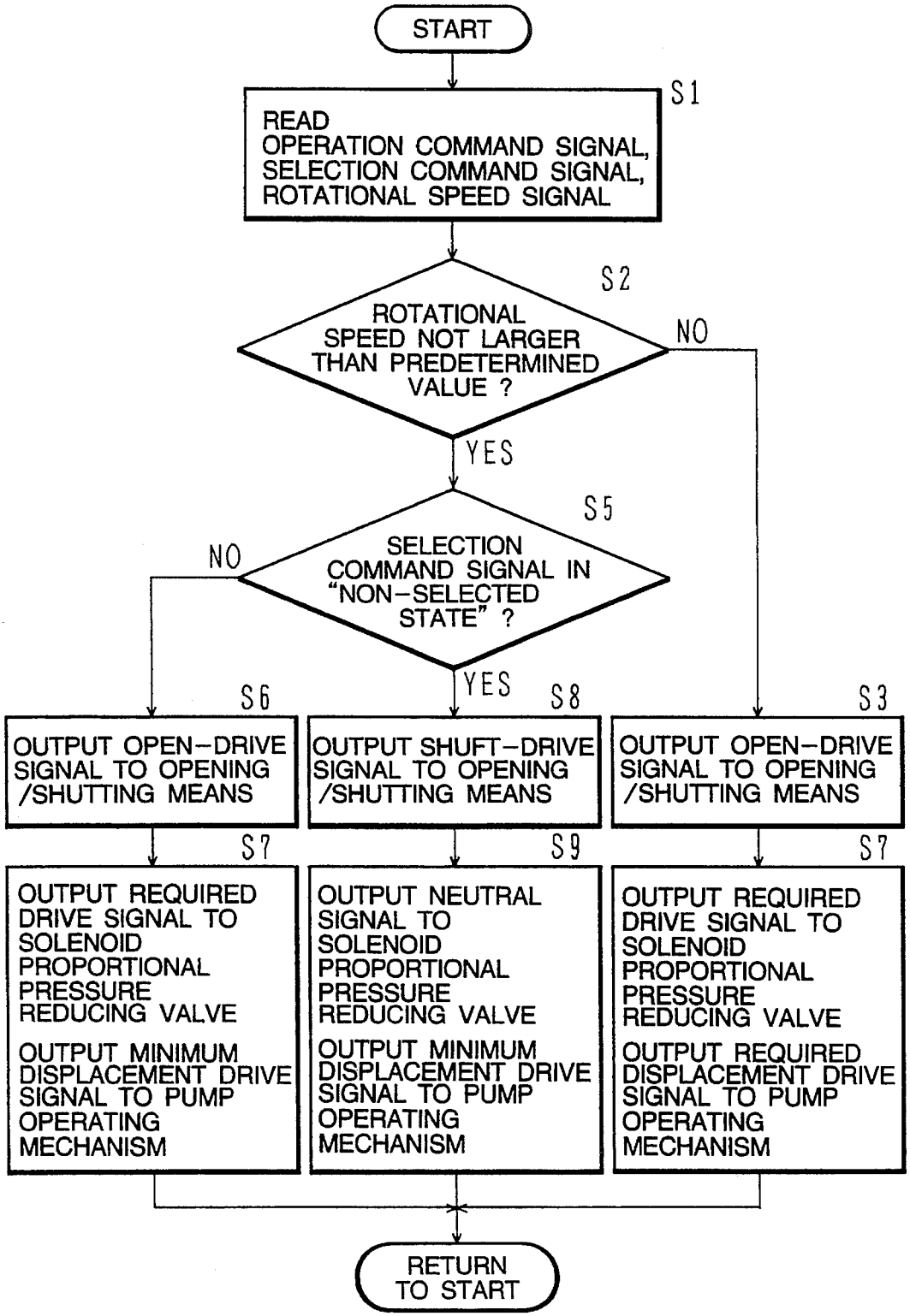
FIG. 9 is a flowchart showing operation of the hydraulic drive system for a construction machine according to the third embodiment.

Operation of this embodiment arranged as above will now be described with reference to a flowchart of FIG. 9 showing a process sequence carried out in the controller 38.

First, as shown at step S1, the controller 38 reads the operation command signals output from the operation detecting mechanisms 31 to 36, the selection command signal output from the selection command device 24, and the rotational speed signal output from the rotational speed detector 37. Then, the process goes to step S2 to determine whether a value of the rotational speed signal is not larger than the predetermined value. If the decision in step S2 is not satisfied, then the process goes to step S3 upon judgment that the prime mover 1 is in a driven state. In step S3, the controller 25 outputs an open-drive signal for driving the opening/shutting valve 23 into an open state. The opening/shutting valve 23 is thereby opened to make open the line interconnecting the auxiliary hydraulic pump 7 and the solenoid proportional pressure reducing valves 27 to 30, etc. The hydraulic fluid delivered from the auxiliary hydraulic pump 7 is supplied to the accumulator 21 as well to be accumulated therein. At this time, the main hydraulic pumps 3, 4 are driven with the operation of the prime mover 1 so that the hydraulic fluid from the main hydraulic pumps 3, 4 is supplied to center bypass passages of the directional control valves 8 to 16. When any of the control levers is now operated, the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc. in step S4, whereupon the hydraulic fluid from the auxiliary hydraulic pump 7 is supplied to a driving sector of the corresponding directional control valve through the corresponding pressure reducing valve. Thus, the corresponding directional control valve is shifted, enabling the actuator to be operated at a speed corresponding to the amount by which the control lever is operated. On this occasion, signals from sensors provided in the operation detecting mechanisms 31 to 36 are also input to the controller 38 which calculates a first target displacement volume for each of the main hydraulic pumps 3, 4 depending on a maximum value of the amounts by which the control levers are operated, and which outputs a corresponding required drive signal to each of the pump operating mechanisms 5, 6. Signals from the pressure sensors 83, 84 are further input to the controller 38 which calculates, based on a preset input torque limiting function, a second target displacement volume for horsepower limit control depending on the pump delivery pressure. If the first target displacement is larger than the second target displacement volume, a drive signal in accordance with the second target displacement volume is output as the required drive signal to corresponding one of the pump operating mechanisms 5, 6. Upon completion of the foregoing procedures in step S4, the process returns to the start.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the decision in above step S2 in the controller 38 is satisfied, the process goes to step S5 upon judgment that the prime mover 1 is in a non-driven state. In step S5, it is determined whether the selection command signal output from the selection command device 24 is a signal in a non-selected state or not, i.e., whether the selection command signal is a shut command signal for bringing the opening/shutting valve 23 into a shut state. When an operator selects the open command in the selection command device 24, which is a command to select driving of the actuator, with an intention of driving the actuator, the decision in step S5 is not satisfied and the process goes to step S6. In step S6, to allow the directional control valve to be effectively shifted with the aid of the accumulator 21, the controller 38 outputs the open-drive signal for driving the opening/shutting valve 23 into the open state to make open the line interconnecting the accumulator 21 and the solenoid proportional pressure reducing valves 27 to 30, etc. By operating any of the control levers, therefore, the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc. in step S7, whereby the hydraulic fluid in the accumulator 21 is supplied to a driving sector of the corresponding directional control valve to shift the same, so that the corresponding actuator can be brought into an operable state. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating corresponding one of the control levers, enabling the boom cylinder 57A to be operated with the dead load of the working unit, which results in a descent of the working unit. At this time, from the viewpoint of ensuring safety when the prime mover 1 is next started up, a drive signal for minimizing the displacement volume of the main hydraulic pumps 3, 4 is output from the controller 38 to the pump operating mechanisms 5, 6. Upon completion of the foregoing procedures in step S6, the process returns to the start.

On the other hand, when the operator selects the shut command in the selection command device 24, which is a command to select non-driving of the actuator, with no intention of driving the actuator while the prime mover 1 is in the stopped state as mentioned above, the decision in step S5 as to whether the selection command signal is a signal in the non-selected state or not is satisfied and the process goes to step S8. In step S8, to disable any shift of the directional control valve with the aid of the accumulator 21, the controller 38 outputs the shut-drive signal for driving the opening/shutting valve 23 into the shut state to shut off the line interconnecting the accumulator 21 and the solenoid proportional pressure reducing valves 27 to 30, etc., whereby no pilot pressures due to the hydraulic fluid in the accumulator 21 are transmitted to the solenoid proportional pressure reducing valves 27 to 30, etc. Then, in step S9, the controller 38 outputs a neutral signal to the solenoid proportional pressure reducing valves 27 to 30, etc. so that the solenoid proportional pressure reducing valves 27 to 30, etc. are controlled to be held in their neutral positions. Accordingly, even if the operator or any other person touches any of the control levers by a mistake under the above condition, since the solenoid proportional pressure reducing valves 27 to 30, etc. remain held in the neutral positions, the hydraulic fluid in the accumulator 21 is not supplied to the solenoid proportional pressure reducing valves 27 to 30, etc. and the directional control valves 8 to 16 are not shifted and held in neutral positions. Therefore, no actuators are operated and the working unit is kept at rest in midair without descending. In other words, the actuators can be surely prevented from operating against the intention of the operator. At this time, from the viewpoint of ensuring safety when the prime mover 1 is next started up, a drive signal for minimizing the displacement volume of the main hydraulic pumps 3, 4 is output from the controller 38 to the pump operating mechanisms 5, 6. Upon completion of the foregoing procedures in step S9, the process returns to the start.

While the above embodiment employs the rotational speed detector 37 as the stop detecting means for detecting that the prime mover 1 is in a stopped state, an output voltage detector for detecting an output voltage of an electric generator equipped on the prime mover 1 may be provided instead. This case can also present the similar advantages.

Fourth Embodiment

A fourth embodiment of the present invention will be described with reference to FIGS. 10 and 11.

Figure 10:
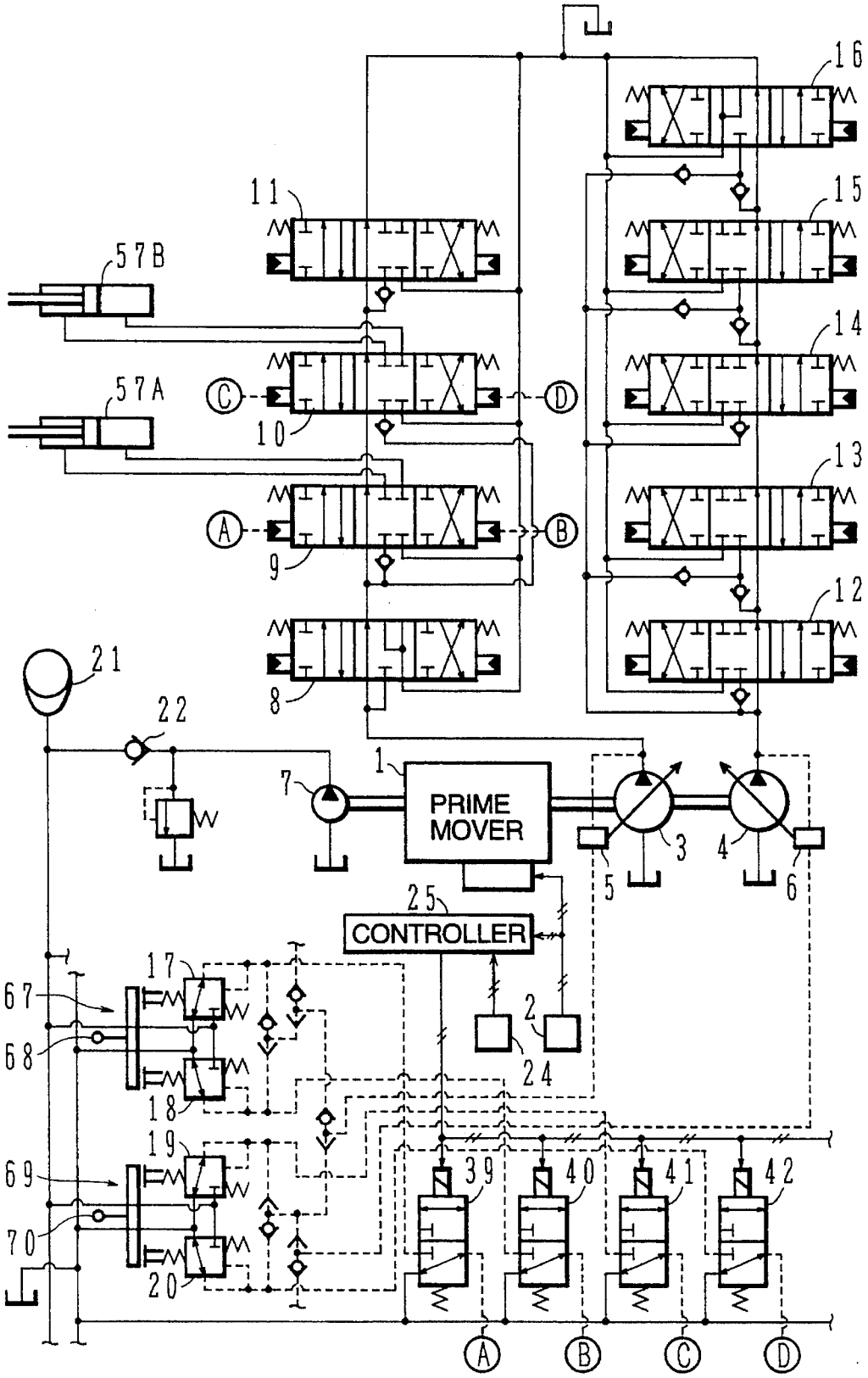
FIG. 10 is a circuit diagram of a hydraulic drive system for a construction machine according to a fourth embodiment of the present invention.

FIG. 10 shows a circuit diagram of a hydraulic drive system for a construction machine according to this embodiment.

Referring to FIG. 10, the hydraulic drive system of this embodiment is different from the hydraulic drive system of the first embodiment in that a plurality of auxiliary control valves 39 to 42, etc. corresponding respectively to the plurality of pressure reducing valves 17 to 20, etc. are provided instead of the opening/shutting valve 23 in the first embodiment. For example, the auxiliary control valve 39 is disposed in a pilot circuit line interconnecting the pressure reducing valve 17 and one driving sector of the directional control valve 9, and the auxiliary control valve 40 is disposed in a pilot circuit line interconnecting the pressure reducing valve 18 and the other driving sector of the directional control valve 9. The auxiliary control valve 41 is disposed in a pilot circuit line interconnecting the pressure reducing valve 19 and one driving sector of the directional control valve 10, and the auxiliary control valve 42 is disposed in a pilot circuit line interconnecting the pressure reducing valve 20 and the other driving sector of the directional control valve 10. Though not shown for the sake of brevity, pressure reducing valves and auxiliary control valves corresponding to the other directional control valves 8, 11 to 16 are also disposed in similar arrangement. Note that when the pressure reducing valves 17 to 20 and the auxiliary control valves 39 to 42 are described below, the description is equally applied to the other pressure reducing valves and auxiliary control valves which are not shown.

Further, the selection command device 24 in the hydraulic drive system of this embodiment selectively receives a command (hereinafter referred to often as a neutral hold command) for driving the auxiliary control valves 39 to 42, etc. to shift the corresponding directional control valves 8 to 16 into positions (hereinafter referred to often as neutral hold positions) where the valves 8 to 16 are kept neutral, and a command (hereinafter referred to often as an operating position command) for driving the auxiliary control valves 39 to 42, etc. to shift the corresponding directional control valves 8 to 16 into positions (hereinafter referred to often as operating positions) where the valves 8 to 16 are operable. The controller 25 is designed to output the same drive signal to each of the auxiliary control valves 39 to 42, etc. The remaining arrangement is substantially the same as in the first embodiment.

Figure 11:
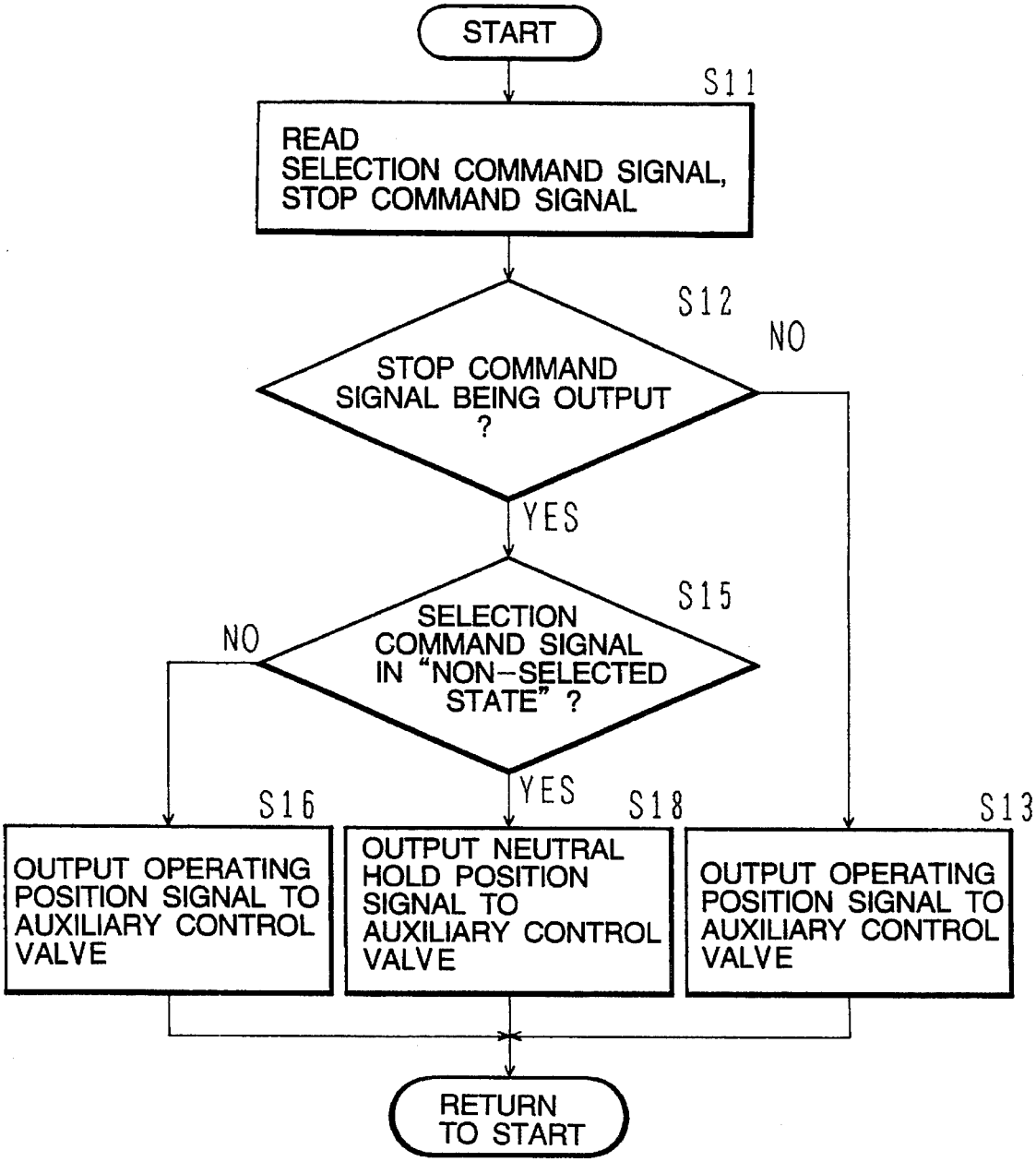
FIG. 11 is a flowchart showing operation of the hydraulic drive system for a construction machine according to the fourth embodiment.

Operation of this embodiment arranged as above will now be described with reference to a flowchart of FIG. 11 showing a process sequence carried out in the controller 25.

First, as shown at step S11, the controller 25 reads the stop command signal output from the stop command device 2 and the selection command signal output from the selection command device 24. Then, the process goes to step S12 to determine whether the stop command signal is output or not. If the decision in step S12 is not satisfied, then the process goes to step S13 upon judgment that the prime mover 1 is in a driven state. In step S13, the controller 25 outputs an operating position signal for driving the auxiliary control valves 39 to 42, etc. into the operating positions, i.e., upper shift positions in FIG. 10. The auxiliary control valves 39 to 42, etc. are thereby shifted to the operating positions to make open the pilot lines interconnecting the pressure reducing valves 17 to 20, etc. and the directional control valves 8 to 16. The hydraulic fluid delivered from the auxiliary hydraulic pump 7 is supplied to the accumulator 21 as well to be accumulated therein. At this time, the main hydraulic pumps 3, 4 are driven with the operation of the prime mover 1 so that the hydraulic fluid from the main hydraulic pumps 3, 4 is supplied to center bypass passages of the directional control valves 8 to 16. When any of the control levers 68, 70, etc. is now operated, the hydraulic fluid from the auxiliary hydraulic pump 7 is supplied to a driving sector of the corresponding directional control valve through the corresponding pressure reducing valve, whereby the corresponding directional control valve is shifted. On this occasion, as a spool stroke of that directional control valve increases, an opening of a passage communicating a pump port with an actuator port of that directional control valve and an opening of a passage communicating the actuator port with a reservoir port of that directional control valve are increased gradually, while an opening of a throttle for opening and shutting the center bypass passage is reduced. Therefore, a flow rate of the hydraulic fluid flowing into the corresponding actuator from one of the main hydraulic pumps 3, 4 or a flow rate of the hydraulic fluid flowing out of the corresponding actuator, and a direction of flow of the hydraulic fluid are adjusted, enabling that actuator to be operated at a speed depending on the amount by which the control levers is operated. Similarly to the first embodiment, at this time, the pump operating mechanisms 5, 6 perform horsepower control in which displacement volume of the main hydraulic pumps 3, 4 are controlled so that an input torque of the main hydraulic pumps 3, 4 is kept within an output torque of the prime mover 1. Upon completion of the foregoing procedures in step S13, the process returns to the start.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the decision in above step S12 in the controller 25 is satisfied, the process goes to step S15 upon judgment that the prime mover 1 is in a non-driven state. In step S15, it is determined whether the selection command signal output from the selection command device 24 is a signal in a non-selected state or not, i.e., whether the selection command signal is a neutral hold command signal or not. When an operator selects the operating position command in the selection command device 24, which is a command to select driving of the actuator, with an intention of driving the actuator, the decision in step S15 is not satisfied and the process goes to step S16. In step S16, to allow the directional control valve to be effectively shifted with the aid of the accumulator 21, the controller 25 outputs the operating position signal for driving the auxiliary control valves 39 to 42, etc. into the operating positions to make open the lines interconnecting the pressure reducing valves 17 to 20, etc. and the directional control valves 8 to 16. By operating any of the control levers 68, 70, etc., therefore, the hydraulic fluid in the accumulator 21 is supplied to a driving sector of the corresponding directional control valve to shift the same, whereby the corresponding actuator can be brought into an operable state. Assuming now, for example, that the actuator is the boom cylinder 57A and the working unit including the boom *53a* connected to the boom cylinder 57A is left at rest in midair upon stop of the prime mover 1, the directional control valve 9 is shifted by operating the control lever 68, enabling the boom cylinder 57A to be operated with the dead load of the working unit, which results in a descent of the working unit. Upon completion of the foregoing procedures in step S16, the process returns to the start.

On the other hand, when the operator selects the neutral hold command in the selection command device 24, which is a command to select non-driving of the actuator, with no intention of driving the actuator while the prime mover 1 is in the stopped state as mentioned above, the decision in step S15 as to whether the selection command signal is a signal in the non-selected state or not is satisfied and the process goes to step S18. In step S18, to disable any shift of the directional control valve with the aid of the accumulator 21, the controller 25 outputs the neutral hold position signal for driving the auxiliary control valves 39 to 42, etc. into the neutral hold positions, i.e., lower shift positions in FIG. 10. The pilot lines interconnecting the pressure reducing valves 17 to 20, etc. and the directional control valves 8 to 16 are thereby shut off so that pilot pressures due to the hydraulic fluid in the accumulator 21 are transmitted to the pressure reducing valves 17 to 20, but not to the directional control valves 8 to 16. Accordingly, even if the operator or any other person touches any of the control levers 68, 70, etc. by a mistake under the above condition, the directional control valves 8 to 16 are held in neutral positions with no fear that the hydraulic fluid in the accumulator 21 may be supplied to the pressure reducing valves 17 to 20, etc. to shift the directional control valves 8 to 16. Therefore, no actuators are operated and the working unit is kept at rest in midair without descending. In other words, the actuators can be surely prevented from operating against the intention of the operator. Upon completion of the foregoing procedures in step S18, the process returns to the start.

As with the first embodiment, even when the prime mover 1 is stopped against the intention of the operator because of a failure in itself or an overload imposed thereon, the hydraulic fluid in the accumulator 21 can be supplied to the directional control valves 8 to 16 through the pressure reducing valves 17 to 20, etc. by entering the stop command in the stop command device 2 and selecting the operating position command in the selection command device 24 so that the auxiliary control valves 39 to 42, etc. are driven into the operating positions. Then, by operating one of the control levers 68, 70, etc. under the above condition to hold corresponding ones of the pressure reducing valves 17 to 20, etc. in their neutral positions, the corresponding directional control valve can be returned to the neutral position and hence the operation of the corresponding actuator can be surely prevented.

This embodiment provides an additional advantage that when it is desired to apply the above-described function to only the particular actuator or only the particular direction, this object can be easily achieved by providing an auxiliary control valve for only the particular corresponding directional control valve.

Fifth Embodiment

A fifth embodiment of the present invention will be described with reference to FIG. 12.

Figure 12:
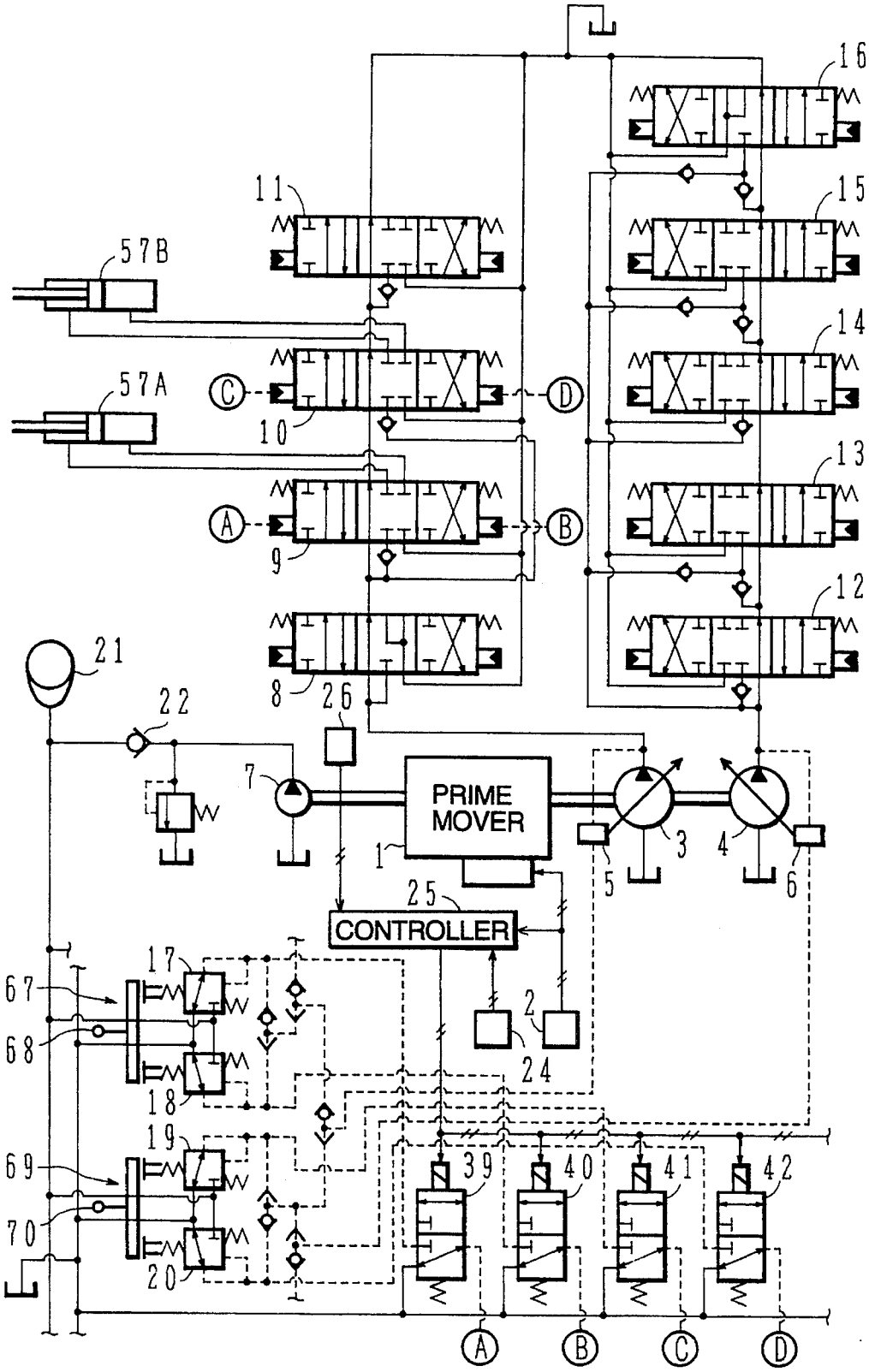
FIG. 12 is a circuit diagram of a hydraulic drive system for a construction machine according to a fifth embodiment of the present invention.

FIG. 12 shows a circuit diagram of a hydraulic drive system for a construction machine according to this embodiment. Identical members to those in the first to fourth embodiments are denoted by the same reference numerals.

Referring to FIG. 12, the hydraulic drive system of this embodiment is different from the hydraulic drive system of the fourth embodiment in that a pressure detector 26 for detecting the delivery pressure of the auxiliary hydraulic pump 7 driven by the prime mover 1 is provided as the stop detecting means for detecting that the prime mover 1 is in a stopped state, and that the controller 25 outputs the operating position or neutral hold position signals to shift the auxiliary control valves 39 to 42, etc. to the operating positions or the neutral hold positions in accordance with a pressure signal output from the pressure detector 26 and the selection command signal output from the selection command device 24. The remaining arrangement is substantially the same as in the fourth embodiment.

Operation of this embodiment arranged as above is different from the operation of the fourth embodiment in that if a value of the pressure signal output from the pressure detecting device 26 is not less than the predetermined value in S12 in FIG. 11, then the process goes to S13 upon judgment by the controller 25 that the prime mover 1 is in the driven state, and if a value of the pressure signal is less than the predetermined value, then the process goes to S15 upon judgment by the controller 25 that the prime mover 1 is in the non-driven state. The remaining operation is the same as in the fourth embodiment.

This embodiment can also provide similar advantages to those in the fourth embodiment.

As with the modification of the second embodiment, a delivery pressure of the main hydraulic pump 3 or 4 may be detected by the pressure detector 26. This case can also present the similar advantages.

Sixth Embodiment

A sixth embodiment of the present invention will be described with reference to FIGS. 13 and 14.

Figure 13:
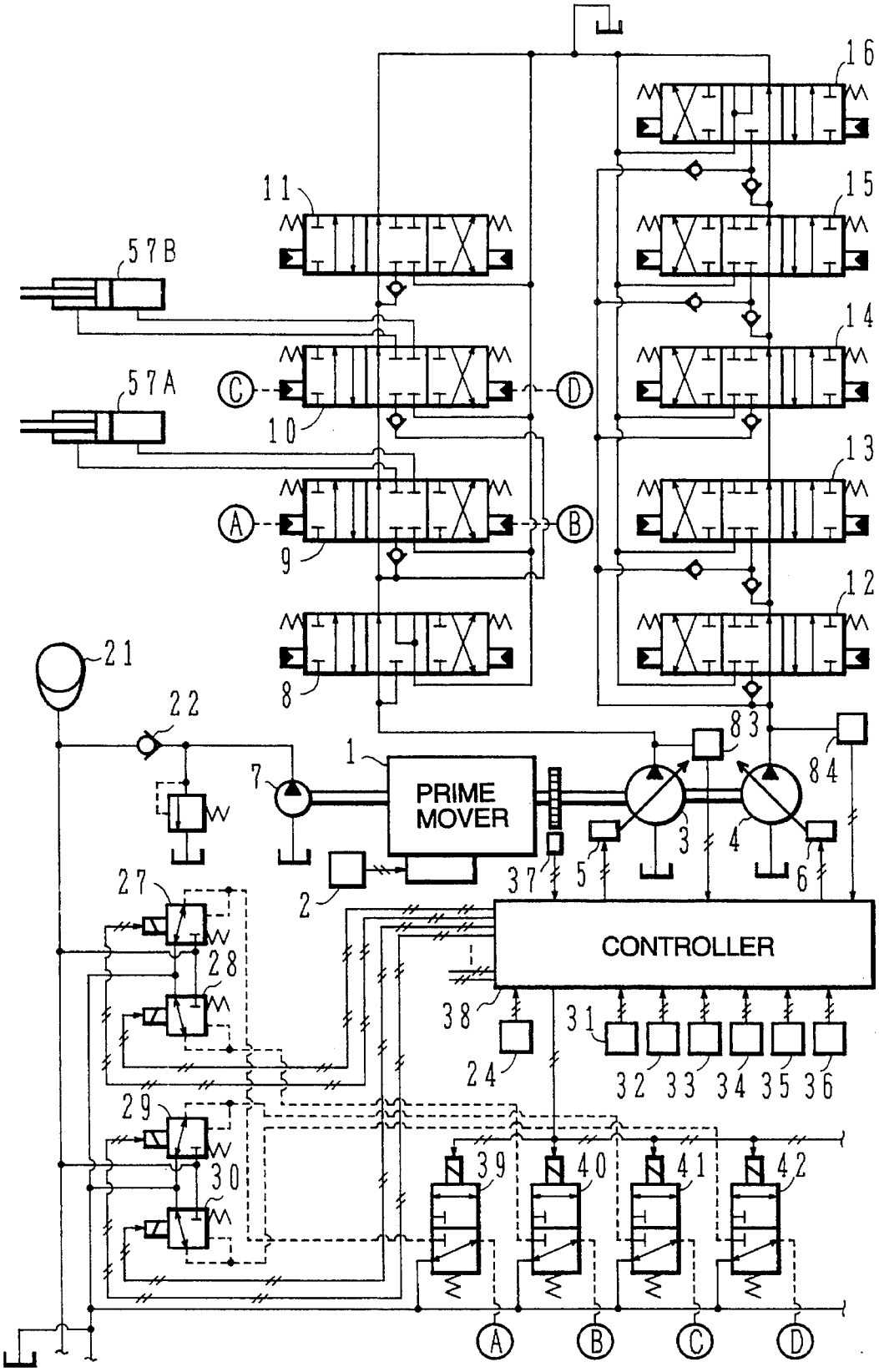
FIG. 13 is a circuit diagram of a hydraulic drive system for a construction machine according to a sixth embodiment of the present-invention.

FIG. 13 shows a circuit diagram of a hydraulic drive system for a construction machine according to this embodiment. Identical members to those in the first to fifth embodiments are denoted by the same reference numerals.

Referring to FIG. 13, the hydraulic drive system of this embodiment is different from the hydraulic drive system of the fourth embodiment in that the control valve operating mechanism for controlling the hydraulic fluid delivered from the auxiliary hydraulic pump 7 to operate the directional control valves 8 to 16 comprises operation detecting mechanisms 31 to 36 for detecting operation of respective control levers (not shown) as operation commands and outputting corresponding operation command signals to a controller 38, the controller 38 for outputting drive signals in accordance with the operation command signals, and solenoid proportional pressure reducing valves 27 to 30 having electric input means to receive the drive signals output from the controller 38 and outputting secondary pressures, which are resulted by reducing the pressure of the hydraulic fluid from the auxiliary hydraulic pump 7 in accordance with the drive signals, to the directional control valves 8 to 16, and that a rotational speed detector 37 for detecting a rotational speed of the prime mover 1 is provided as the stop detecting means for detecting that the prime mover 1 is in a stopped state. The controller 38 also outputs the operating position or neutral hold position signals to shift the auxiliary control valves 39 to 42, etc. to the operating positions or the neutral hold positions in accordance with a rotational speed signal output from the rotational speed detector 37 and the selection command signal output from the selection command device 24. The remaining arrangement is substantially the same as in the fourth embodiment.

Figure 14:
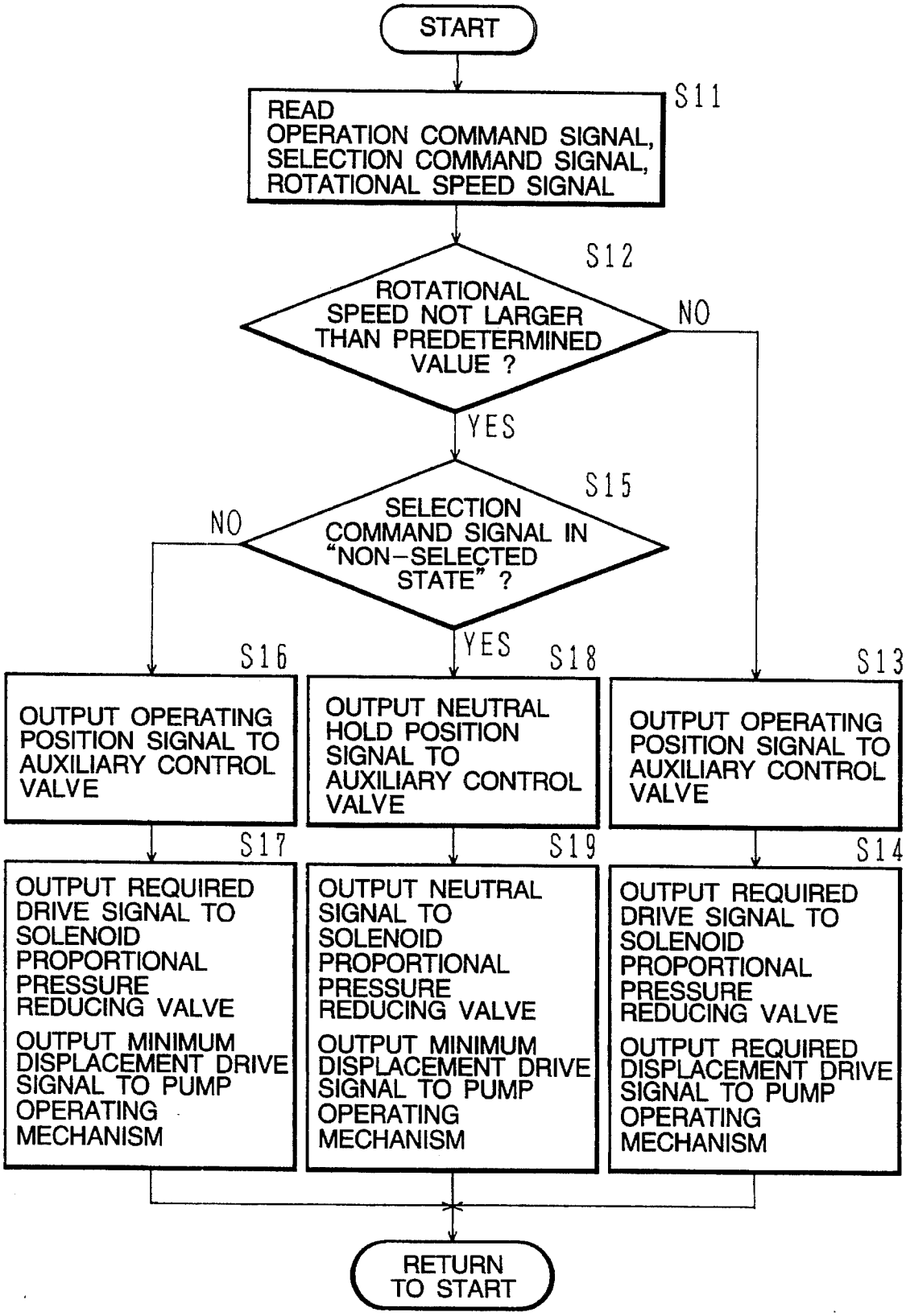
FIG. 14 is a flowchart showing operation of the hydraulic drive system for a construction machine according to the sixth embodiment.

Operation of this embodiment arranged as above will now be described with reference to a flowchart of FIG. 14 showing a process sequence carried out in the controller 38.

First, as shown at step S11, the controller 38 reads the operation command signals output from the operation detecting mechanisms 31 to 36, the selection command signal output from the selection command device 24, and the rotational speed signal output from the rotational speed detector 37. Then, the process goes to step S12 to determine whether a value of the rotational speed signal is not larger than the predetermined value. If the decision in step S12 is not satisfied, then the process goes to step S13 upon judgment that the prime mover 1 is in a driven state. In step S13, the controller 38 outputs an operating position signal for driving the auxiliary control valves 39 to 42, etc. into the operating positions, i.e., upper shift positions in FIG. 13. The auxiliary control valves 39 to 42, etc. are thereby shifted to the operating positions to make open the lines interconnecting the solenoid proportional pressure reducing valves 27 to 30, etc. and the directional control valves 8 to 16. The hydraulic fluid delivered from the auxiliary hydraulic pump 7 is supplied to the accumulator 21 as well to be accumulated therein. At this time, the main hydraulic pumps 3, 4 are driven with the operation of the prime mover 1 so that the hydraulic fluid from the main hydraulic pumps 3, 4 is supplied to center bypass passages of the directional control valves 8 to 16. When any of the control levers (not shown) is now operated, the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc. in step S14, whereupon the hydraulic fluid from the auxiliary hydraulic pump 7 is supplied to a driving sector of the corresponding directional control valve through the corresponding pressure reducing valve. Thus, the corresponding directional control valve is shifted, enabling the actuator to be operated at a speed corresponding to the amount by which the control lever is operated. As with the third embodiment, the controller 38 performs horsepower control such that a required drive signal in accordance with the first target displacement volume or the second target displacement volume is output to each of the pump operating mechanisms 5, 6. Upon completion of the foregoing procedures in step S14, the process returns to the start.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the decision in above step S12 in the controller 38 is satisfied, the process goes to step S15 upon judgment that the prime mover 1 is in a non-driven state. In step S15, it is determined whether the selection command signal output from the selection command device 24 is a signal in a non-selected state or not, i.e., whether the selection command signal is a neutral hold position signal for bringing the auxiliary control valves 39 to 42 into the neutral hold positions or not. When an operator selects the operating position command in the selection command device 24, which is a command to select driving of the actuator, with an intention of driving the actuator, the decision in step S15 is not satisfied and the process goes to step S16. In step S16, to allow the directional control valve to be effectively shifted with the aid of the accumulator 21, the controller 38 outputs the operating position signal for driving the auxiliary control valves 39 to 42 into the operating positions to make open the lines interconnecting the solenoid proportional pressure reducing valves 27 to 30, etc. and the directional control valves 18 to 26. By operating any of the control levers (not shown), therefore, the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc. in step S17, whereby the hydraulic fluid in the accumulator 21 is supplied to a driving sector of the corresponding directional control valve to shift the same, so that the corresponding actuator can be brought into an operable state. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating corresponding one of the control levers (not shown), enabling the boom cylinder 57A to be operated with the dead load of the working unit, which results in a descent of the working unit. At this time, from the viewpoint of ensuring safety when the prime mover 1 is next started up, a drive signal for minimizing the displacement volume of the main hydraulic pumps 3, 4 is output from the controller 38 to the pump operating mechanisms 5, 6. Upon completion of the foregoing procedures in step S17, the process returns to the start.

On the other hand, when the operator selects the neutral hold position command in the selection command device 24, which is a command to select non-driving of the actuator, with no intention of driving the actuator while the prime mover 1 is in the stopped state as mentioned above, the decision in step S15 as to whether the selection command signal is in the non-selected state or not is satisfied and the process goes to step S18. In step S18, to disable any shift of the directional control valve with the aid of the accumulator 21, the controller 38 outputs the neutral hold position signal for driving the auxiliary control valves 39 to 42, etc. into the neutral hold positions to shut off the lines interconnecting the solenoid proportional pressure reducing valves 27 to 30, etc. and the directional control valves 8 to 16, whereby no pilot pressures due to the hydraulic fluid in the accumulator 21 are transmitted to the solenoid proportional pressure reducing valves 27 to 30, etc., but not to the directional control valves 8 to 16. Then, in step S19, the controller 38 outputs a neutral signal to the solenoid proportional pressure reducing valves 27 to 30, etc. so that the solenoid proportional pressure reducing valves 27 to 30, etc. are controlled to be held in their neutral positions. Accordingly, even if the operator or any other person touches any of the control levers by a mistake under the above condition, since the solenoid proportional pressure reducing valves 27 to 30, etc. remain held in the neutral positions, the hydraulic fluid in the accumulator 21 is not supplied to the solenoid proportional pressure reducing valves 27 to 30, etc. and the directional control valves 8 to 16 are not shifted and held in neutral positions. Therefore, no actuators are operated and the working unit is kept at rest in midair without descending. In other words, the actuators can be surely prevented from operating against the intention of the operator. At this time, from the viewpoint of ensuring safety when the prime mover 1 is next started up, a drive signal for minimizing the displacement volume of the main hydraulic pumps 3, 4 is output from the controller 38 to the pump operating mechanisms 5, 6. Upon completion of the foregoing procedures in step S19, the process returns to the start.

Seventh Embodiment

A seventh embodiment of the present invention will be described with reference to FIG. 15.

Figure 15:
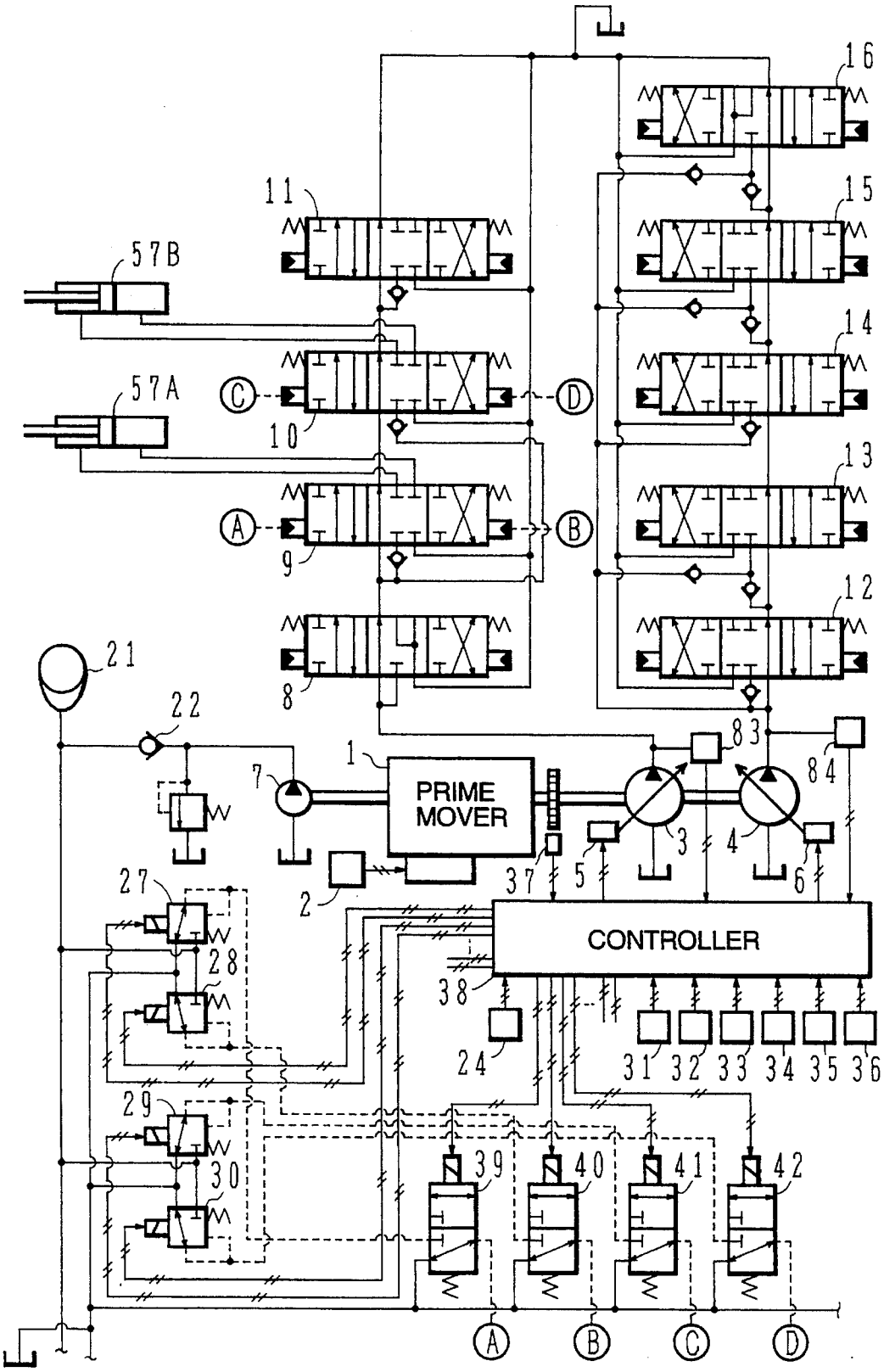
FIG. 15 is a circuit diagram of a hydraulic drive system for a construction machine according to a seventh embodiment of the present invention.

FIG. 15 shows a circuit diagram of a hydraulic drive system for a construction machine according to this embodiment. Identical members to those in the first to sixth embodiments are denoted by the same reference numerals.

Referring to FIG. 15, the hydraulic drive system of this embodiment is different from the hydraulic drive system of the sixth embodiment in that while the controller 38 is designed to output the same drive signal to all the auxiliary control valves 39 to 42, etc. in the sixth embodiment, the controller 38 is designed to respectively output different drive signals to the auxiliary control valves 39 to 42, etc., the drive signals being switchable separately in this embodiment. The remaining arrangement is substantially the same as in the sixth embodiment.

In addition to the advantages obtained in the sixth embodiment, this embodiment can provide an advantage that the directional control valves associated with the auxiliary control valves 39 to 42, etc. can be shifted at different response speeds from one another.

While the above sixth and seventh embodiments employ the rotational speed detector 37 as the stop detecting means for detecting that the prime mover 1 is in a stopped state, an output voltage detector for detecting an output voltage of an electric generator equipped on the prime mover 1 may be provided instead. This case can also present the similar advantages.

Eighth Embodiment

An eighth embodiment of the present invention will be described with reference to FIG. 16.

Figure 16:
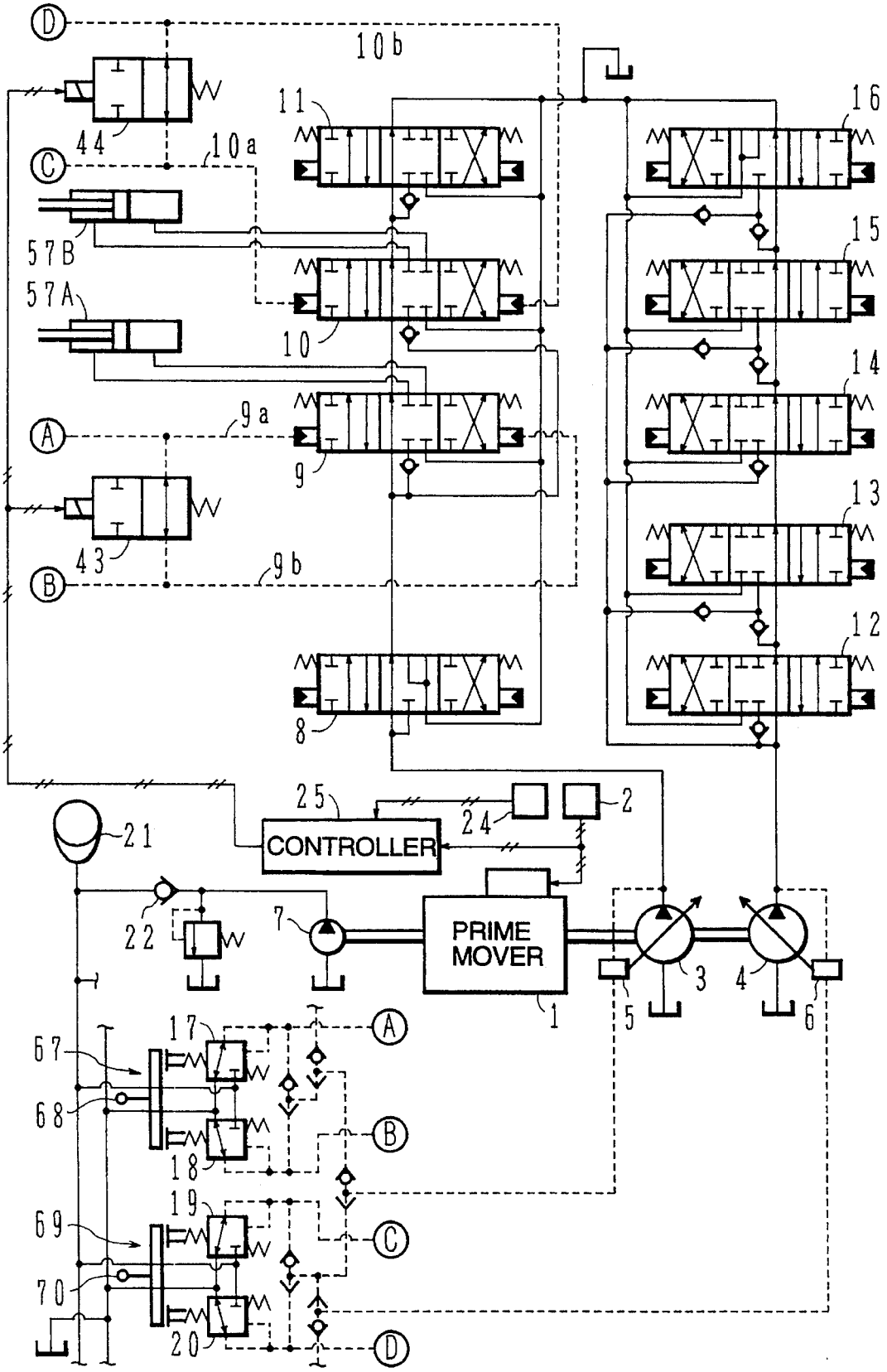
FIG. 16 is a circuit diagram of a hydraulic drive system for a construction machine according to an eighth embodiment of the present invention.

FIG. 16 shows a circuit diagram of a hydraulic drive system for a construction machine according to this embodiment. Identical members to those in the first to seventh embodiments are denoted by the same reference numerals.

Referring to FIG. 16, the hydraulic drive system of this embodiment is different from the hydraulic drive system of the fourth embodiment in having, instead of the auxiliary control valves 39 to 42, etc., auxiliary control valves 43, 44, etc. disposed in such a manner as able to communicate respective pairs of pilot lines (e.g., lines 9*a*, 9*b* and lines 10*a*, 10*b*) with each other which are extended from the pressure reducing valves 17 to 20, etc. and connected to respective opposite driving sectors of the directional control valves 8 to 16. The remaining arrangement is substantially the same as in the fourth embodiment.

Operation of this embodiment arranged as above is different from the operation of the fourth embodiment in that the auxiliary control valves 43, 44, etc. are shifted in S13 or S16 in FIG. 11 to operating positions, i.e., left-hand positions in FIG. 16, and are shifted in S18 to neutral hold positions, i.e., right-hand positions in FIG. 16.

Specifically, the controller 25 outputs an operating position signal in S13 or S16 to drive the auxiliary control valves 43, 44, etc. into the operating positions. The pairs of pilot lines (e.g., the lines 9*a*, 9*b* and the lines 10*a*, 10*b*) connected to the respective opposite driving sectors of the directional control valves 8 to 16 are thereby disconnected from each other so that each pair of driving sectors may function independently. As a result, the directional control valves 8 to 16 are brought into a state operable to shift.

On the other hand, the controller 25 outputs a neutral hold position signal in S18 to drive the auxiliary control valves 43, 44, etc. into the neutral hold positions. The pairs of pilot lines (e.g., the lines 9*a*, 9*b* and the lines 10*a*, 10*b*) connected to the respective opposite driving sectors of the directional control valves 8 to 16 are thereby communicated with each other so that the directional control valves 8 to 16, etc. are held in the neutral positions. Therefore, if the control levers 68, 70, etc. are touched accidentally, the pressure reducing valves 17 to 20, etc. are not operated and the directional control valves 8 to 16 are not shifted. The remaining operation is the same as in the fourth embodiment.

This embodiment can also provide similar advantages to those in the fourth embodiment.

Ninth Embodiment

A ninth embodiment of the present invention will be described with reference to FIG. 17.

Figure 17:
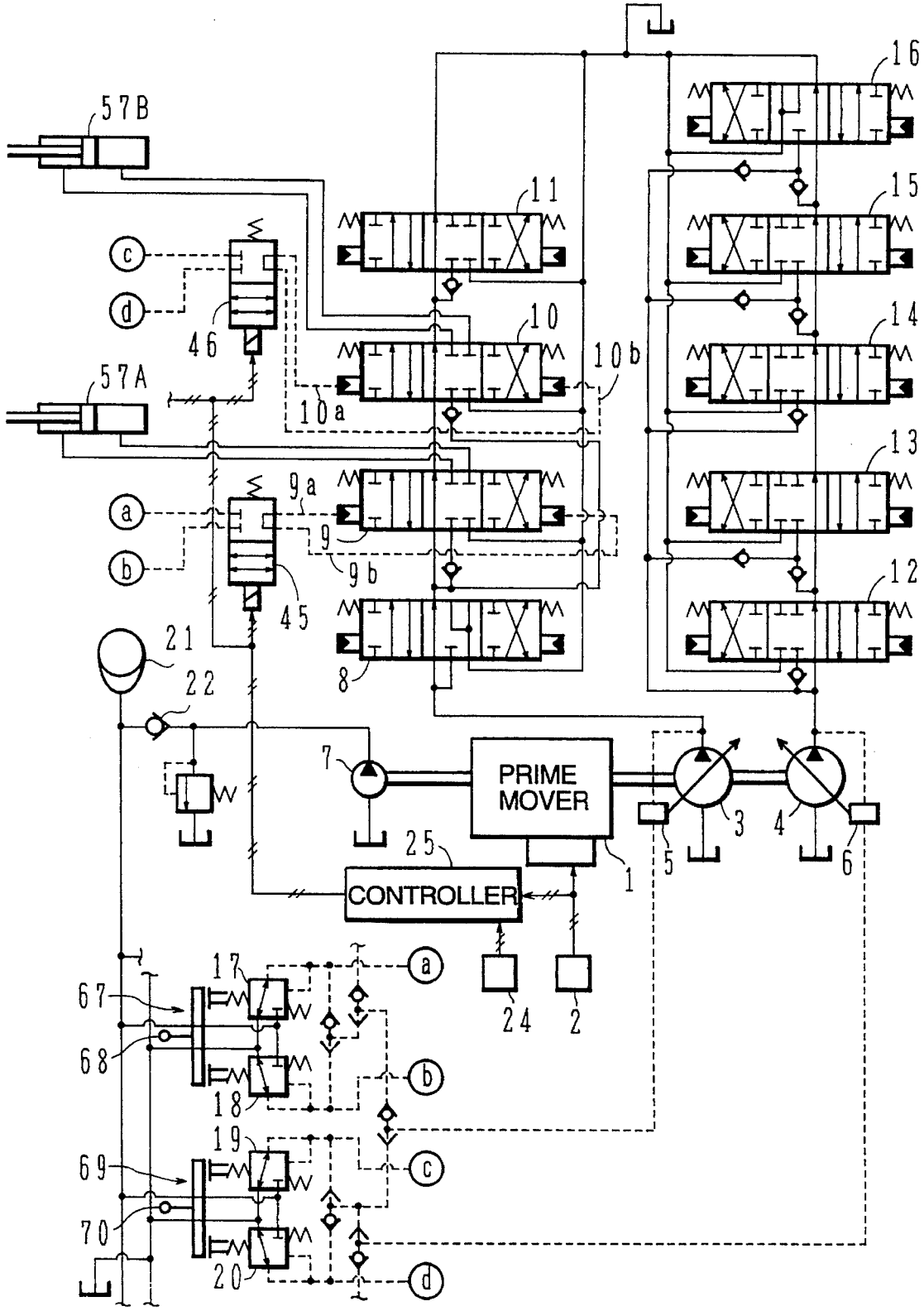
FIG. 17 is a circuit diagram of a hydraulic drive system for a construction machine according to a ninth embodiment of the present invention.

FIG. 17 shows a circuit diagram of a hydraulic drive system for a construction machine according to this embodiment. Identical members to those in the first to eighth embodiments are denoted by the same reference numerals.

Referring to FIG. 17, the hydraulic drive system of this embodiment is different from the hydraulic drive system of the eighth embodiment in having, instead of the auxiliary control valves 43 to 44, etc., auxiliary control valves 45, 46, etc. disposed to stride over respective pairs of pilot lines (e.g., lines 9*a*, 9*b* and lines 10*a*, 10*b*) which are extended from the pressure reducing valves 17 to 20, etc. and connected to respective opposite driving sectors of the directional control valves 8 to 16, such that each auxiliary control valve can simultaneously shut off the corresponding pair of two pilot lines. The remaining arrangement is the same as in the eighth embodiment.

Operation of this embodiment arranged as above is different from the operation of the eighth embodiment in that the auxiliary control valves 45, 46, etc. are shifted in S13 or S16 in FIG. 11 to operating positions, i.e., lower positions in FIG. 17, and are shifted in S18 to neutral hold positions, i.e., upper positions in FIG. 17.

Specifically, the controller 25 outputs an operating position signal in S13 or S16 to drive the auxiliary control valves 45, 46, etc. into the operating positions. The pairs of pilot lines (e.g., the lines 9*a*, 9*b* and the lines 10*a*, 10*b*) connected to the respective opposite driving sectors of the directional control valves 8 to 16 are both thereby made open. As a result, the directional control valves 8 to 16 are brought into a state operable to shift.

On the other hand, the controller 25 outputs a neutral hold position signal in S18 to drive the auxiliary control valves 45, 46, etc. into the neutral hold positions. The pairs of pilot lines (e.g., the lines 9*a*, 9*b* and the lines 10*a*, 10*b*) connected to the respective opposite driving sectors of the directional control valves 8 to 16 are both thereby shut off from the side of the pressure reducing valves 17 to 20, etc. so that the directional control valves 8 to 16, etc. are held in the neutral positions. Therefore, if the control levers 68, 70, etc. are touched accidentally, the pressure reducing valves 17 to 20, etc. are not operated and hence the directional control valves 8 to 16 are not shifted. The remaining operation is the same as in the fourth embodiment.

This embodiment can also provide similar advantages to those in the eighth embodiment.

Tenth Embodiment

A tenth embodiment of the present invention will be described with reference to FIG. 18.

Figure 18:
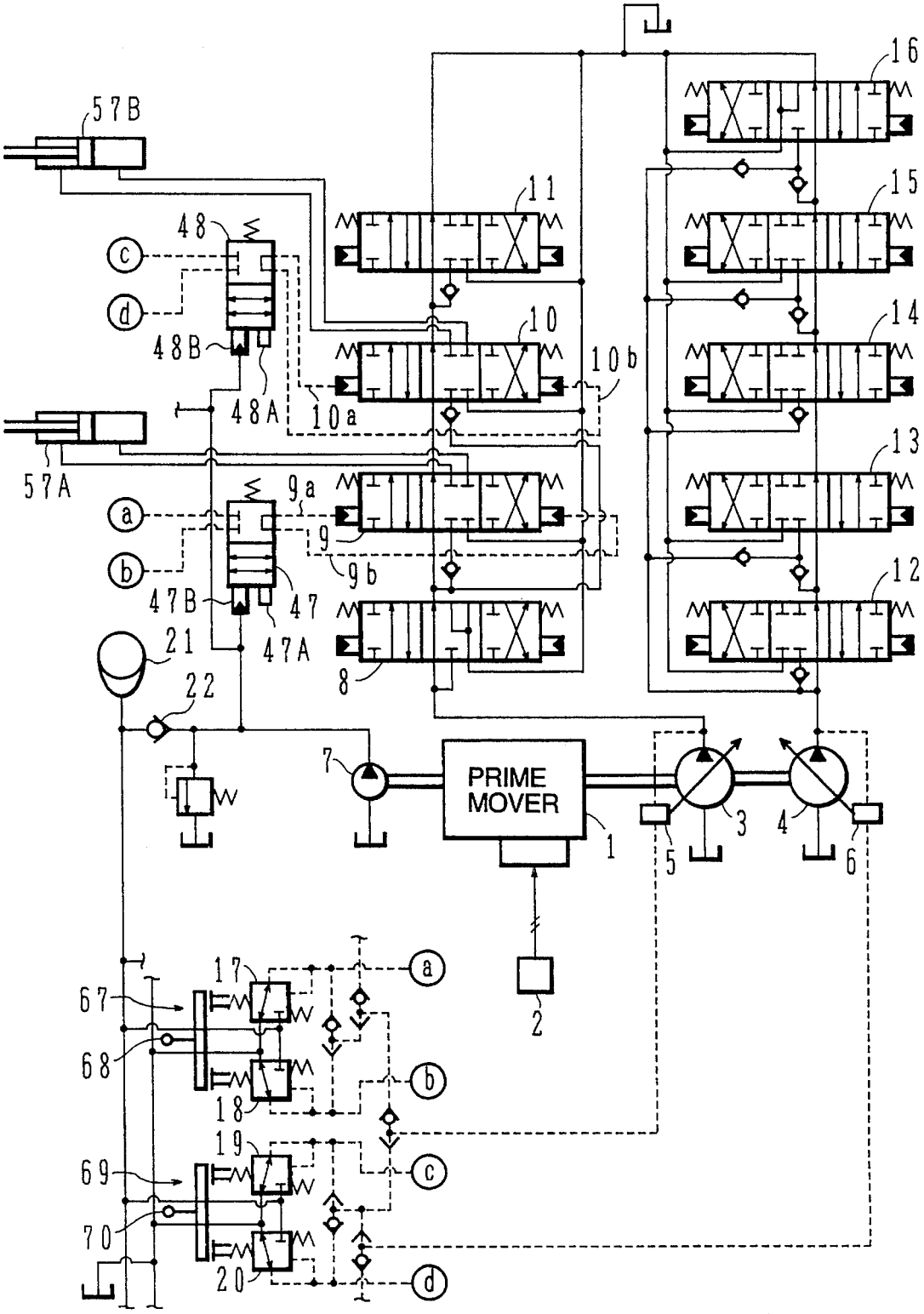
FIG. 18 is a circuit diagram of a hydraulic drive system for a construction machine according to a tenth embodiment of the present invention.

FIG. 18 shows a circuit diagram of a hydraulic drive system for a construction machine according to this embodiment. Identical members to those in the first to ninth embodiments are denoted by the same reference numerals.

Referring to FIG. 18, the hydraulic drive system of this embodiment is primarily different from the hydraulic drive system of the ninth embodiment in construction of auxiliary control valves 47, 48. More specifically, the auxiliary control valves 47, 48 are the same as the auxiliary control valves 45, 46 in that they are each disposed to stride over one of pairs of pilot lines, which are connected to respective opposite driving sectors of the directional control valves 8 to 16, in such a manner as able to simultaneously shut off the corresponding pair of two pilot lines. But the auxiliary control valves 47, 48 in this embodiment are not operated by electrical inputs unlike the auxiliary control valves 45, 46 in the ninth embodiment, but operated by the hydraulic fluid from the auxiliary hydraulic pump 7. The auxiliary control valves 47, 48 are each shifted to an operating position, i.e., a lower position in FIG. 18, when the hydraulic fluid is supplied from the auxiliary hydraulic pump 7, and shifted by a spring force to a neutral hold position, i.e., an upper position in FIG. 18, when the hydraulic fluid is not supplied from the auxiliary hydraulic pump 7. Furthermore, the auxiliary control valves 47, 48 can be manually shifted to either the operating position or the neutral hold position through their manipulating sectors 47A, 48A.

Because of the auxiliary control valves 47, 48 being hydraulically driven as mentioned above, the selection command device 24 and the controller 25 in the hydraulic drive system of the ninth embodiment are omitted in the hydraulic drive system of this embodiment. The remaining arrangement is substantially the same as in the ninth embodiment.

Operation of this embodiment arranged as above will be described below.

When the stop command signal for stopping the prime mover 1 is not output from the stop command device 2 and the prime mover 1 is in a driven state, the hydraulic fluid from the auxiliary hydraulic pump 7 is supplied to driving sectors 47B, 48B, etc. of the auxiliary control valves 47, 48, etc., whereupon the auxiliary control valves 47, 48, etc. are shifted to the operating positions, i.e., the lower positions in FIG. 18, to communicate the pressure reducing valves 17 to 20, etc. with corresponding driving sectors of the directional control valves 8 to 16. The hydraulic fluid delivered from the auxiliary hydraulic pump 7 is supplied to the accumulator 21 as well to be accumulated therein. At this time, the main hydraulic pumps 3, 4 are driven with the operation of the prime mover 1 so that the hydraulic fluid from the main hydraulic pumps 3, 4 is supplied to center bypass passages of the directional control valves 8 to 16. When any of the control levers 68, 70, etc. is now operated, the hydraulic fluid from the auxiliary hydraulic pump 7 is supplied to the driving sector of the corresponding directional control valve through the corresponding pressure reducing valve, and the corresponding directional control valve is shifted. On this occasion, as a spool stroke of that directional control valve increases, an opening of a passage communicating a pump port with an actuator port of that directional control valve and an opening of a passage communicating the actuator port with a reservoir port of that directional control valve are increased gradually, while an opening of a throttle for opening and shutting the center bypass passage is reduced. Therefore, a flow rate of the hydraulic fluid flowing into the corresponding actuator from one of the main hydraulic pumps 3, 4 or a flow rate of the hydraulic fluid flowing out of the corresponding actuator, and a direction of flow of the hydraulic fluid are adjusted, enabling that actuator to be operated at a speed depending on the amount by which the one of the control levers 68, 70, etc. is operated. Similarly to the first embodiment, at this time, the pump operating mechanisms 5, 6 perform horsepower control in which displacement volume of the main hydraulic pumps 3, 4 are controlled so that an input torque of the main hydraulic pumps 3, 4 is kept within an output torque of the prime mover 1.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the auxiliary hydraulic pump 7 also stops driving, the hydraulic fluid is not supplied to the driving sectors 47B, 48B of the auxiliary control valves 47, 48, etc. and, therefore, the auxiliary control valves 47, 48, etc. are shifted by the spring forces to the neutral hold positions, i.e., the upper positions in FIG. 18. Accordingly, the pressure reducing valves 17 to 20, etc. are disconnected from the corresponding driving sectors of the directional control valves 8 to 16.

When an operator desires to drive the actuator while the prime mover 1 is in the stopped state, it is only required to manually shift corresponding one of the auxiliary control valves 47, 48, etc. to the operating positions, i.e., the lower positions in FIG. 18. Thereafter, by operating corresponding one of the pressure reducing valves 17 to 20, etc., the hydraulic fluid in the accumulator 21 is supplied to the driving sector of the corresponding directional control valve to shift the same through the pressure reducing valve and the auxiliary control valve, whereby the corresponding actuator can be brought into an operable state. Thus, the accumulator 21 can effectively function to shift the directional control valve. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating the pressure reducing valve through corresponding one of the control levers 68, 70, etc., enabling the boom cylinder 57A to be operated with the dead load of the working unit, which results in a descent of the working unit.

On the other hand, when the operator releases his hand from the manipulating sectors 47A, 48A of the auxiliary control valves 47, 48, etc. while the prime mover 1 is in the stopped state, the auxiliary control valves 47, 48, etc. are shifted by the spring forces to the neutral hold positions, i.e., the upper positions in FIG. 18 (if the valves 47, 48, etc. are not shifted by the spring forces, they can be manually shifted to the upper positions through the manipulating sections 47A, 48A, etc.). Thereby, the pressure reducing valves 17 to 20, etc. are disconnected from the corresponding driving sectors of the directional control valves 8 to 16, and the opposite driving sectors of each of the directional control valves 8 to 16 are communicated with each other. Because of the directional control valves 8 to 16 being held in the neutral positions under such a condition, even if any of the control levers for the pressure reducing valves 17 to 20, etc. is touched by a mistake, there is no fear that the hydraulic fluid in the accumulator 21 may be supplied to the driving sectors of the directional control valves 8 to 16 to shift them. Thus, any shift of the directional control valve with the aid of the accumulator 21 is disabled. Therefore, no actuators are operated and the working unit is kept at rest in midair without descending. In other words, the actuators can be surely prevented from operating against the intention of the operator.

In the above arrangement, the manual shift of the auxiliary control valves 47, 48, etc. to the operating positions or the neutral hold positions in accordance with the intention of the operator while the prime mover 1 is in the stopped state, makes up the selection means for selecting whether the actuators are to be driven or not, and the driving sectors 47B, 48B, etc. of the auxiliary control valves 47, 48, etc. make up the stop detecting means for detecting whether the prime mover I is in the stopped state or not.

As with the first embodiment, even when the prime mover 1 is stopped against the intention of the operator because of a failure in itself or an overload imposed thereon, the hydraulic fluid in the accumulator 21 can be supplied to the directional control valves 8 to 16 through the pressure reducing valves 17 to 20, etc. by shifting the auxiliary control valves 47, 48, etc. through the manipulating sectors 47A, 48A, etc. thereof. Then, by operating one of the control levers 68, 70, etc. under the above condition to hold corresponding ones of the pressure reducing valves 17 to 20, etc. in their neutral positions, the corresponding directional control valve can be returned to neutral position and hence the operation of the corresponding actuator can be surely prevented.

Eleventh Embodiment

An eleventh embodiment of the present invention will be described with reference to FIGS. 19 to 22.

Figure 19:
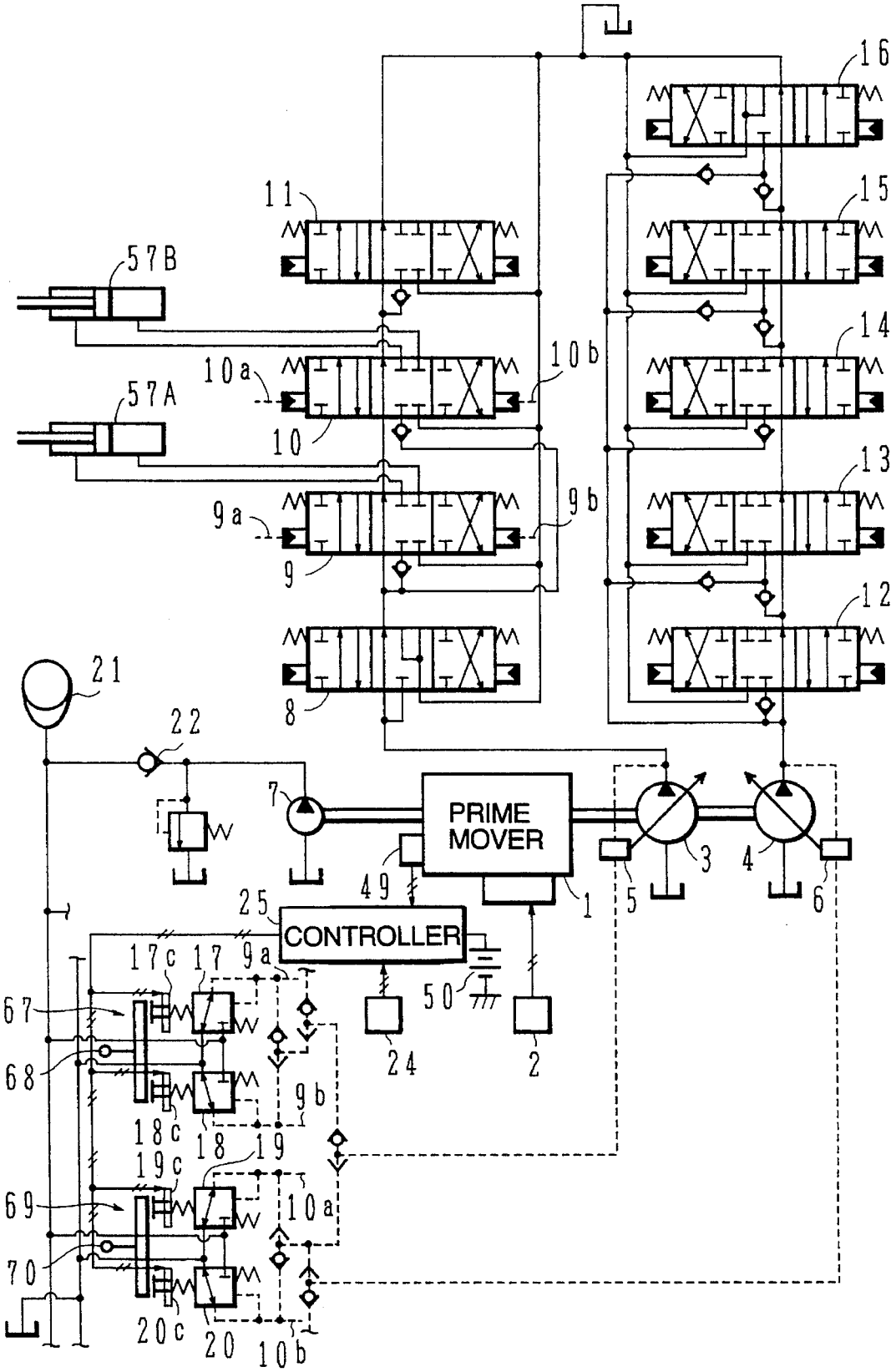
FIG. 19 is a circuit diagram of a hydraulic drive system for a construction machine according to an eleventh embodiment of the present invention.
Figure 20:
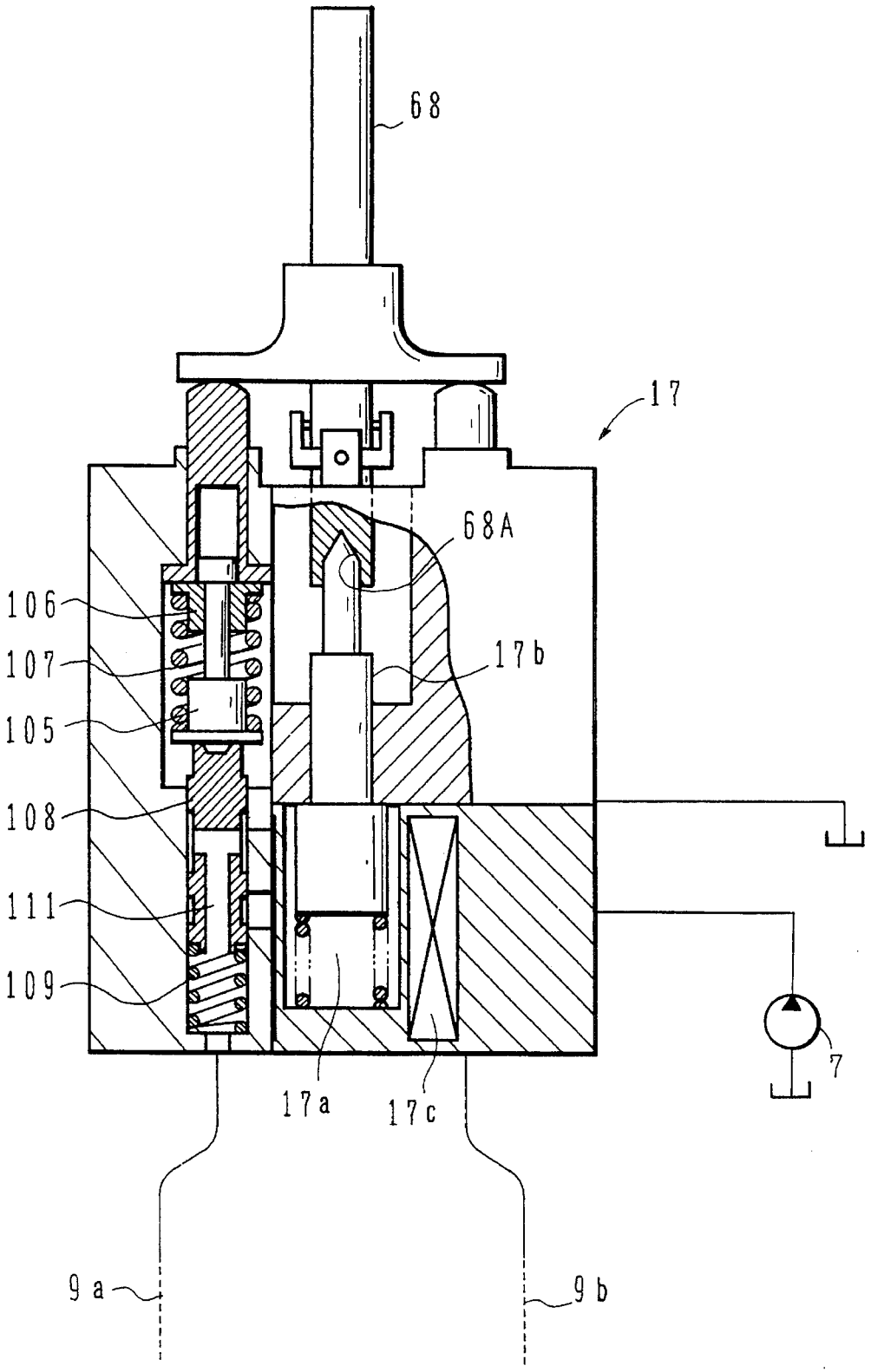
FIG. 20 is a fragmentary sectional view showing a structure of a pressure reducing valve 17.

FIG. 19 shows a circuit diagram of a hydraulic drive system for a construction machine according to this embodiment, and FIG. 20 shows a fragmentary sectional view showing a structure of a pressure reducing valve 17. Identical members to those in the first to tenth embodiments are denoted by the same reference numerals.

Referring to FIGS. 19 and 20, the hydraulic drive system of this embodiment is primarily different from the hydraulic drive system of the first embodiment in that an electric generator 49 is equipped on the prime mover 1 and the controller 25 detects, as the stop detecting means, a voltage signal output from the electric generator 49, that lock means locking the pressure reducing valves 17 to 20, etc. to disable their operation and lock control means for controlling actuation of the lock means in accordance with the output voltage signal and a selection command signal (described later) are provided as components of shift control means instead of the opening/shutting valve 23, and that a lock command for actuating the lock means into a locked state and an unlock command for releasing the lock means from the locked state are selectively input to the selection command device 24 which outputs a corresponding selection command signal to the controller 25.

The lock means is provided for each of the pressure reducing valves 17 to 20, etc. FIG. 20 shows, by way of example, the lock means for the pressure reducing valve 17.

Referring to FIG. 20, the pressure reducing valve 17 comprises a needle 17*b* having an upper end fitted to a hole 68A which is formed an a lower end of a control lever 68, a coil 17*c* disposed around the needle 17*b* for moving the needle 17*b* in a direction away from the control lever 68 when excited, and a spring 17*a* for urging the needle 17*b* to move in a direction toward the control lever 68. The lock means of the same structure is provided for each of the other pressure reducing valves 18 to 20, etc.

The remaining arrangement is substantially the same as in the first embodiment.

Figure 21:
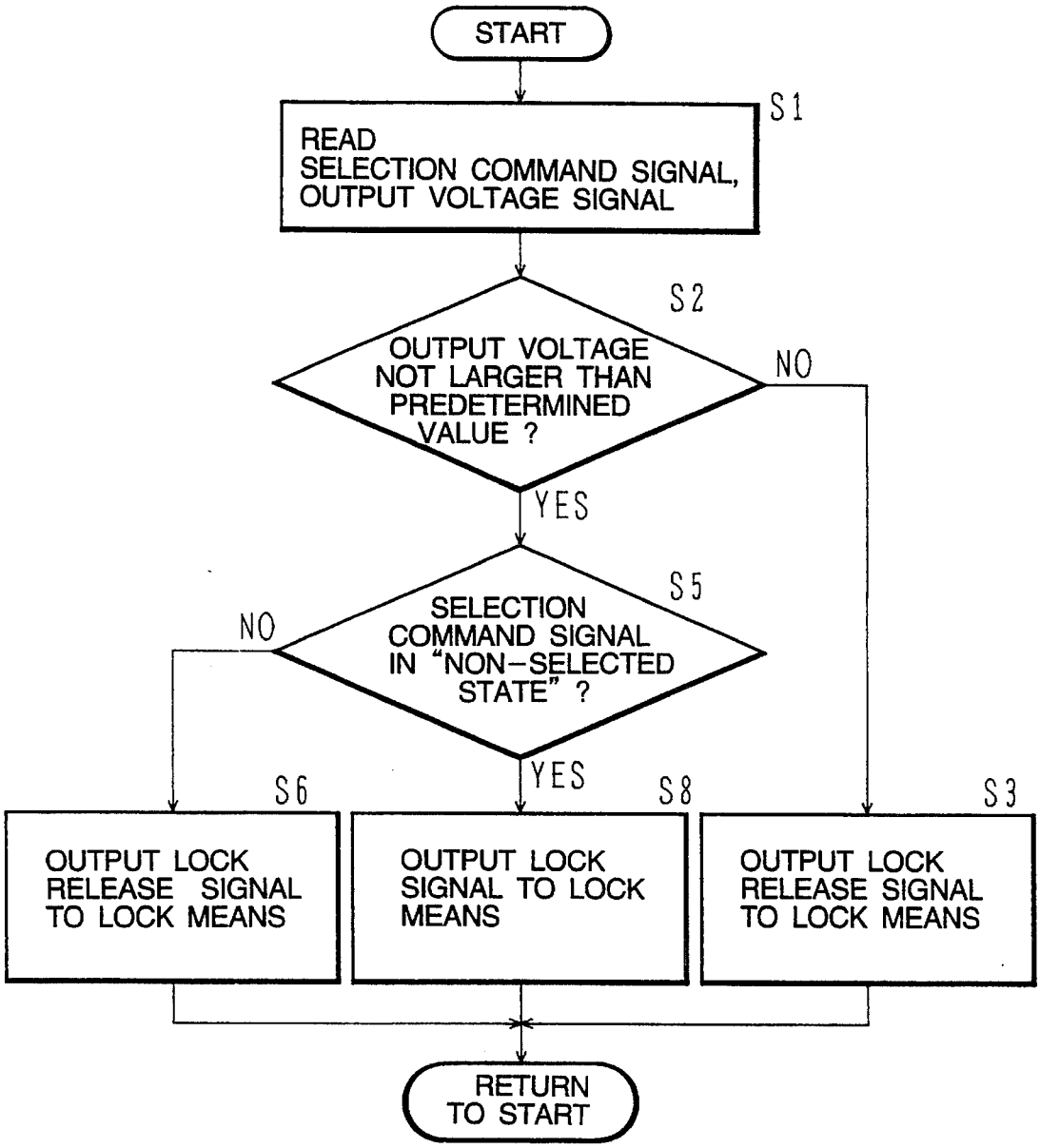
FIG. 21 is a flowchart showing operation of the hydraulic drive system for a construction machine according to the eleventh embodiment.
Figure 22:
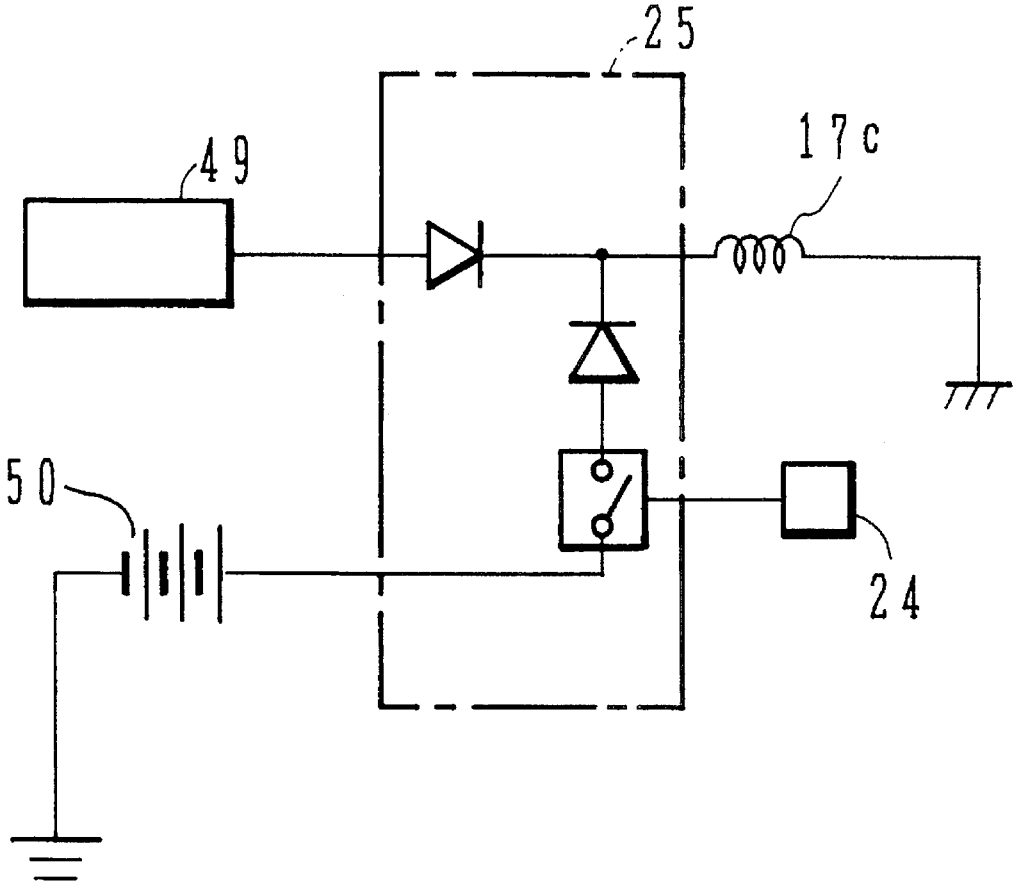
FIG. 22 is a diagram showing an electric system.

Operation of this embodiment arranged as above will now be described with reference to a flowchart of FIG. 21 showing a process sequence carried out in the controller 25.

First, as shown at step S1, the controller 25 reads the output voltage signal from the electric generator 49 and the selection command signal output from the selection command device 24. Then, the process goes to step S2 to determine whether an output voltage is not larger than the predetermined value. If the decision in step S2 is not satisfied, then the process goes to step S3 upon judgment that the prime mover 1 is in a driven state. In step S3, the controller 25 outputs a lock release signal for energizing the coils 17*c*, 18*c*, 19*c*, etc. to unlock the lock means. To describe this unlocking operation in more detail with reference to FIGS. 20 and 22, taking the pressure reducing valve 17 and the coil 17*c* as an example, the voltage from the electric generator 49 is applied to the coil 17*c* through the controller 25 for excitation of the coil 17*c*, whereupon the needle 17*b* is moved in the direction away from the control lever 68. Accordingly, the needle 17*b* and the control lever 68 are released from their mechanical fitting, i.e., a locked state, allowing the control lever 68 to be freely angularly moved. The above unlocking operation is equally applied to the other pressure reducing valves 18 to 20, etc. The hydraulic fluid delivered from the auxiliary hydraulic pump 7 is supplied to the accumulator 21 as well to be accumulated therein.

At this time, the main hydraulic pumps 3, 4 are driven with the operation of the prime mover 1 so that the hydraulic fluid from the main hydraulic pumps 3, 4 is supplied to center bypass passages of the directional control valves 8 to 16. When any of the control levers 68, 70, etc. is now operated, the hydraulic fluid from the auxiliary hydraulic pump 7 is supplied to a driving sector of the corresponding directional control valve through the corresponding pressure reducing valve, whereby the corresponding directional control valve is shifted. On this occasion, as a spool stroke of that directional control valve increases, an opening of a passage communicating a pump port with an actuator port of that directional control valve and an opening of a passage communicating the actuator port with a reservoir port of that directional control valve are increased gradually, while an opening of a throttle for opening and shutting the center bypass passage is reduced. Therefore, a flow rate of the hydraulic fluid flowing into the corresponding actuator from one of the main hydraulic pumps 3, 4 or a flow rate of the hydraulic fluid flowing out of the corresponding actuator, and a direction of flow of the hydraulic fluid are adjusted, enabling that actuator to be operated at a speed depending on the amount by which the one of the control levers 68, 70, etc. is operated. Similarly to the first embodiment, at this time, the pump operating mechanisms 5, 6 perform horsepower control in which displacement volume of the main hydraulic pumps 3, 4 are controlled so that an input torque of the main hydraulic pumps 3, 4 is kept within an output torque of the prime mover 1.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. Under a condition of the prime mover 1 being stopped, no output voltage is detected from the electric generator 49. Taking the pressure reducing valve 17 as an example, the coil 17*c* is not excited and the needle 17*b* is moved by a force of the spring 17*a* toward the control lever 68. Therefore, the distal end of the needle 17*b* is mechanically fitted to the hole 68A formed in the lower end of the control lever 68, bringing the control lever 68 into the locked state in which it cannot be angularly moved or operated. At this time, since the decision in above step S2 in the controller 25 is satisfied, the process goes to step S5 upon judgment that the prime mover 1 is in a non-driven state. In step S5, it is determined whether the selection command signal output from the selection command device 24 is a signal in a non-selected state or not, i.e., whether the selection command signal is a lock command signal for bringing the coils 17*c*, etc. into the locked state. When an operator selects the unlock command in the selection command device 24, which is a command to select driving of the actuator, with an intention of driving the actuator, the decision in step S5 is not satisfied and the process goes to step S6. In step S6, to allow the directional control valve to be effectively shifted with the aid of the accumulator 21, the controller 25 outputs the lock release signal for energizing the coils 17*c*, etc. to unlock the lock means. To describe this unlocking operation in more detail, taking the coil 17*c* of the pressure reducing valve 17 as an example, a voltage is applied to the coil 17*c* by utilizing a power supply 50 for excitation of the coil 17*c*, whereupon the needle 17*b* is moved against the force of the spring 17*a* in the direction away from the control lever 68. Accordingly, the needle 17*b* and the control lever 68 are released from their mechanical fitting, i.e., the locked state, allowing the control lever 68 to be freely angularly moved. The above unlocking operation is equally applied to the other pressure reducing valves and coils. By operating any of the control levers 68, 70, etc., therefore, the hydraulic fluid in the accumulator 21 is supplied to a driving sector of the corresponding directional control valve to shift the same, so that the corresponding actuator can be brought into an operable state. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating the control lever 68, enabling the boom cylinder 57A to be operated with the dead load of the working unit, which results in a descent of the working unit. Upon completion of the foregoing procedures in step S6, the process returns to the start.

On the other hand, when the operator selects the lock command in the selection command device 24, which is a command to select non-driving of the actuator, with no intention of driving the actuator while the prime mover 1 is in the stopped state as mentioned above, the decision in step S5 as to whether the selection command signal is in the non-selected state or not is satisfied and the process goes to step S8. In step S8, to disable any shift of the directional control valve with the aid of the accumulator 21, the controller 25 as lock control means outputs the lock signal for deenergizing the coils 17*c*, etc. to actuate the lock means. To describe this locking operation in more detail, taking the coil 17*c* of the pressure reducing valve 17 as an example, no voltage is applied to the coil 17*c* so as not to excite the coil 17*c*, and the mechanical fitting of the needle 17*b* and the control lever 68 is kept to maintain the locked state. The above locking operation is equally applied to the other pressure reducing valves and coils. Accordingly, even if the operator or any other person touches any of the control levers 68, 70 by a mistake under the above condition, since that control lever is not angularly moved and the corresponding pressure reducing valve is not operated, the directional control valves 8 to 16 are held in the neutral positions with no fear that the hydraulic fluid in the accumulator 21 may be supplied to the pressure reducing valves 17 to 20, etc. to shift the directional control valves 8 to 16. Therefore, no actuators are operated and the working unit is kept at rest in midair without descending. In other words, the actuators can be surely prevented from operating against the intention of the operator. Upon completion of the foregoing procedures in step S8, the process returns to the start.

Even when the prime mover 1 is stopped against the intention of the operator because of a failure in itself or an overload imposed thereon, the hydraulic fluid in the accumulator 21 can be supplied to the directional control valves 8 to 16 through the pressure reducing valves 17 to 20, etc. by selecting the unlock command in the selection command device 24 so that the coils 17*c*, etc. are energized to unlock the lock means. Then, by operating one of the control levers 68, 70, etc. under the above condition to hold corresponding ones of the pressure reducing valves 17 to 20, etc. in their neutral positions, the corresponding directional control valve can be returned to the neutral position and hence the operation of the corresponding actuator can be surely prevented. This case can also provide the similar advantages.

While the controller 25 detects the output voltage signal from the electric generator 49 equipped on the prime mover 1 in the above eleventh embodiment to make up the stop detecting means for detecting that the prime mover 1 is in a stopped state, the stop command device 2 for commanding stop of the prime mover 1 may be used as the stop detecting means. Alternatively, the stop detecting means may be of a pressure detector for detecting a delivery pressure of at least one of the auxiliary hydraulic pump 7 and the main hydraulic pumps 3, 4, or a rotational speed detector for detecting a rotational speed of the prime mover 1.

Further, while the pressure reducing valves 17 to 20, etc. which can be manually operated are provided as the control valve operating means in the above embodiment, the means may be modified such that operation detecting mechanisms for electrically detecting manual commands of the operator are provided, the pressure reducing valves are of solenoid proportional pressure reducing valves having electric input means, and the solenoid proportional pressure reducing valves are driven in accordance with operation signals output from the operation detecting mechanisms. This case can also provide the similar advantages.

Twelfth Embodiment

Figure 23:
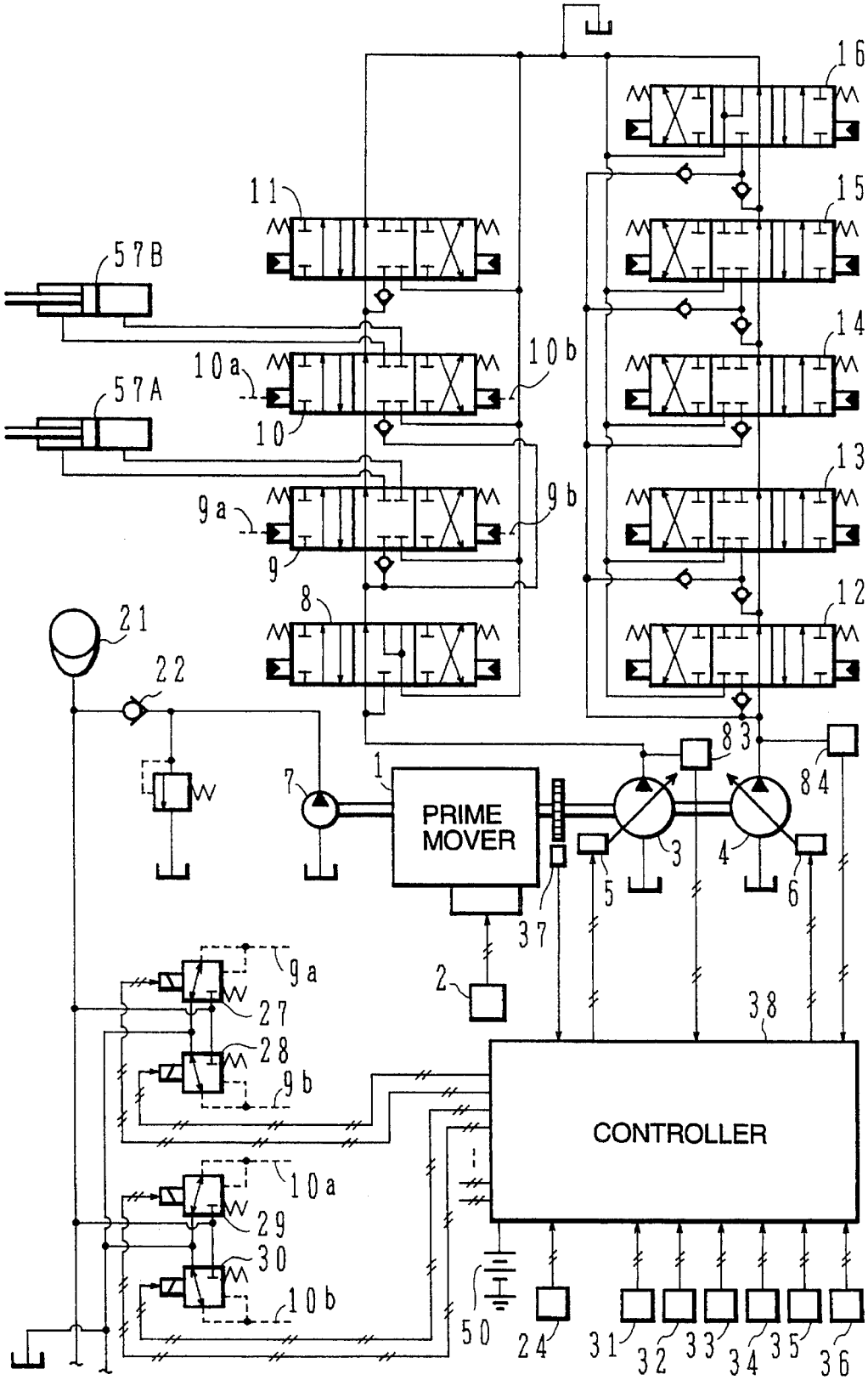
FIG. 23 is a circuit diagram of a hydraulic drive system for a construction machine according to a twelfth embodiment of the present invention.
Figure 24:
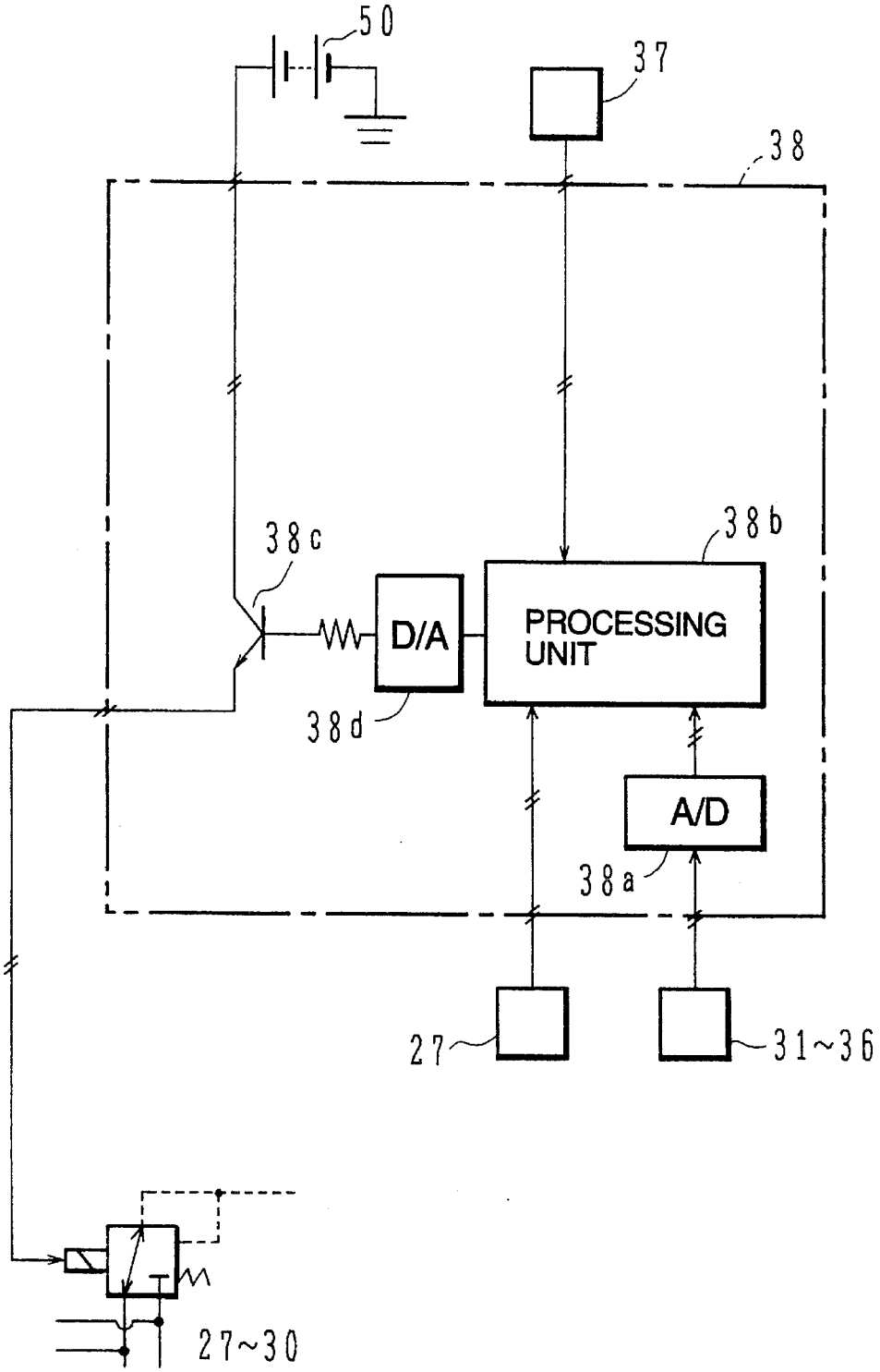
FIG. 24 is a diagram showing a configuration of a controller 38 equipped in a circuit of the hydraulic drive system.

A twelfth embodiment of the present invention will be described with reference to FIGS. 23 to 25. FIG. 23 shows a circuit diagram of a hydraulic drive system for a construction machine according to this embodiment, and FIG. 24 shows a configuration of a controller 38 provided in a circuit of the hydraulic drive system shown in FIG. 23. Identical members to those in the first to eleventh embodiments are denoted by the same reference numerals.

Referring to FIGS. 23 and 24, the hydraulic drive system of this embodiment is different from the hydraulic drive system of the third embodiment in that an operation command for enabling solenoid proportional pressure reducing valves 27 to 30, etc. to operate and an operation stop command for disabling operation of those valves are selectively input to the selection command device 24 which outputs a corresponding selection command signal, and that the opening/shutting valve 23 as a component of the shift control means is omitted, and the controller 38 controls operation of the solenoid proportional pressure reducing valves 27 to 30, etc. in accordance with the selection command signal from the selection command device 24 and a rotational speed signal from a rotational speed detector 37.

A detailed configuration of the controller 38 is shown in FIG. 24.

Referring to FIG. 24, the controller 38 comprises an A/D converter 38*a* for converting the analog operation command signals output from the operation detecting mechanisms 31 to 36 into digital signals, a processing unit 38*b* which is composed of a microcomputer and executes logical decision based on the signals applied from the A/D converter 38*a*, the selection command device 24 and the rotational speed detector 37, a D/A converter 38*d* for converting a signal output from the processing unit 38*b* into an analog signal, and a solenoid proportional pressure reducing valve drive circuit 38*c* for outputting a drive signal to the solenoid proportional pressure reducing valves 27 to 30, etc. in accordance with the signal from the D/A converter 38*d*.

The remaining arrangement is substantially the same as in the third embodiment.

Figure 25:
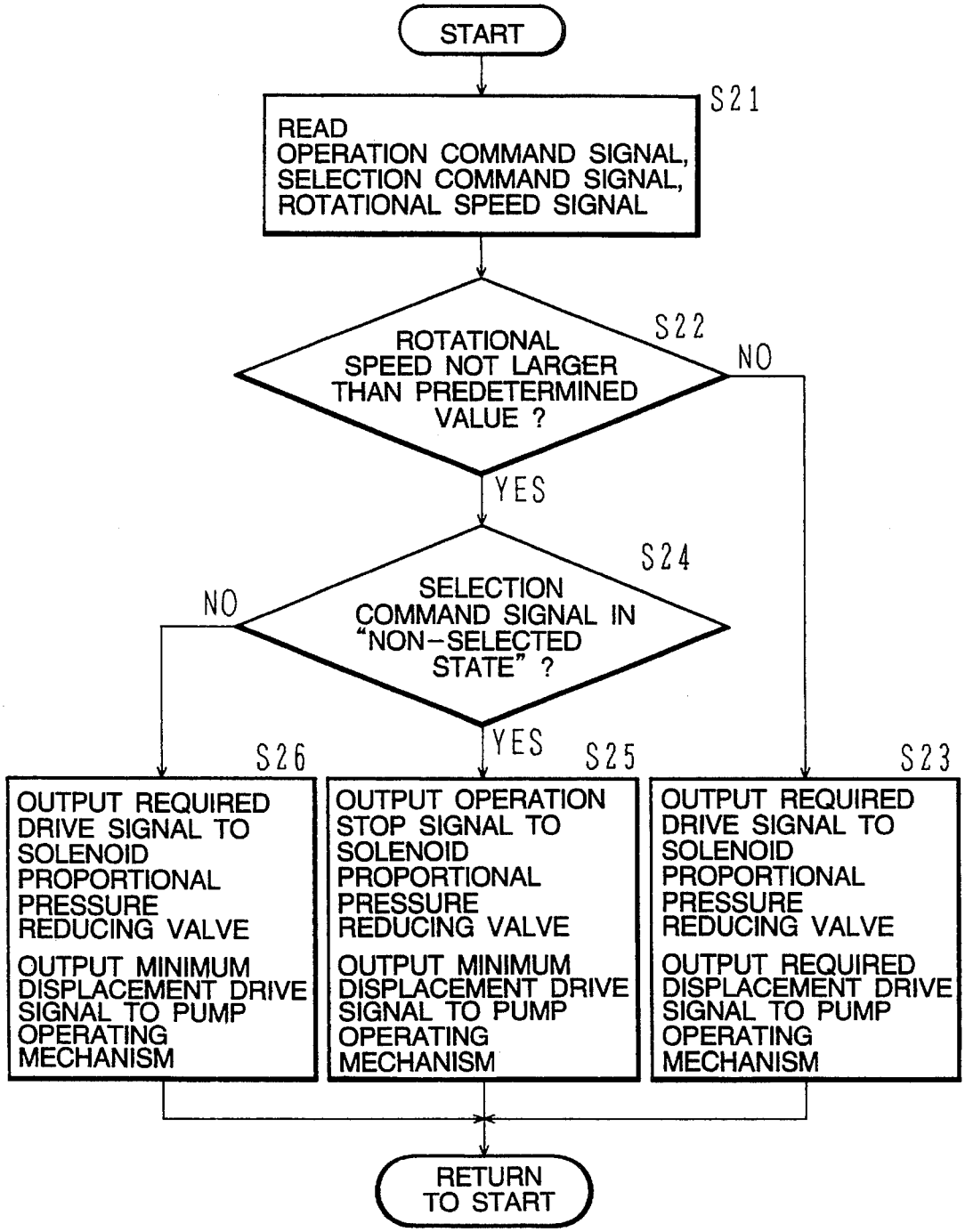
FIG. 25 is a flowchart showing operation of the hydraulic drive system for a construction machine according to the twelfth embodiment.

Operation of this embodiment arranged as above will now be described with reference to a flowchart of FIG. 25 showing a process sequence carried out in the controller 38.

First, as shown at step S21, the controller 38 reads the operation command signals output from the operation detecting mechanisms 31 to 36, the selection command signal output from the selection command device 24, and the rotational speed signal output from the rotational speed detector 37. Then, the process goes to step S22 to determine in the processing unit 38*b* of the controller 38 whether a value of the rotational speed signal is not larger than the predetermined value. If the decision in step S22 is not satisfied, then it is judged that the prime mover 1 is in a driven state. In this condition, the main hydraulic pumps 3, 4 are driven with the operation of the prime mover 1 so that the hydraulic fluid from the main hydraulic pumps 3, 4 is supplied to center bypass passages of the directional control valves 8 to 16. The hydraulic fluid delivered from the auxiliary hydraulic pump 7 is supplied to the accumulator 21 as well to be accumulated therein. When any of the control levers (not shown) is now operated, the solenoid proportional pressure reducing valve driver 38*c* of the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc. in step S23, whereupon the hydraulic fluid from the auxiliary hydraulic pump 7 is supplied to a driving sector of the corresponding directional control valve through the corresponding pressure reducing valve. Thus, the corresponding directional control valve is shifted, enabling the actuator to be operated at a speed corresponding to the amount by which the control lever is operated. As with the third embodiment, the controller 38 performs horsepower control such that a required drive signal in accordance with the first target displacement volume or the second target displacement volume is output to each of the pump operating mechanisms 5, 6 from the solenoid proportional pressure reducing valve driver 38*c* of the controller 38. Upon completion of the foregoing procedures in step S23, the process returns to the start.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the decision in above step S22 in the controller 38 is satisfied, the process goes to step S24 upon judgment that the prime mover 1 is in a non-driven state. In step S24, it is determined whether the selection command signal output from the selection command device 24 is a signal in a non-selected state or not, i.e., whether the selection command signal is an operation stop command signal for bringing the solenoid proportional pressure reducing valves 27 to 30, etc. into a standstill state. When an operator selects the operation command in the selection command device 24, which is a command to select driving of the actuator, with an intention of driving the actuator, the decision in step S5 is not satisfied and the process goes to step S26. Upon the operator manipulating any of the control levers (not shown), to allow the directional control valve to be effectively shifted with the aid of the accumulator 21, the solenoid proportional pressure reducing valve drive circuit 38*c* of the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc. in step S26, whereupon the hydraulic fluid in the accumulator 21 is supplied to a driving sector of the corresponding directional control valve through the corresponding pressure reducing valve, and the corresponding directional control valve is shifted. Accordingly, the corresponding actuator can be brought into an operable state. Assuming now, for example, that the actuator is the boom cylinder 57A and the working unit including the boom 53*a* connected to the boom cylinder 7A is left at rest in midair upon stop of the prime mover 1, the directional control valve 9 is shifted by operating corresponding one of the control levers (not shown), enabling the boom cylinder 57A to be operated with the dead load of the working unit, which results in a descent of the working unit. At this time, from the viewpoint of ensuring safety when the prime mover 1 is next started up, a drive signal for minimizing the displacement volume of the main hydraulic pumps 3, 4 is output to the pump operating mechanisms 5, 6 from the solenoid proportional pressure reducing valve drive circuit 38*c* of the controller 38. Upon completion of the foregoing procedures in step S26, the process returns to the start.

On the other hand, when the operator selects the operation stop command in the selection command device 24, which is a command to select non-driving of the actuator, with no intention of driving the actuator while the prime mover 1 is in the stopped state as mentioned above, the decision in step S24 as to whether the selection command signal is a signal in the non-selected state or not is satisfied and the process goes to step S25. In step S25, to disable any shift of the directional control valve with the aid of the accumulator 21, the solenoid proportional pressure reducing valve drive circuit 38*c* of the controller 38 outputs the operation stop signal for fixing the solenoid proportional pressure reducing valves 27 to 30 in the standstill state so that the solenoid proportional pressure reducing valves 27 to 30, etc. are controlled to be held in their neutral positions and disabled from operating. Accordingly, even if the operator or any other person touches any of the control levers by a mistake under the above condition, since the solenoid proportional pressure reducing valves 27 to 30, etc. remain held in the neutral positions, the hydraulic fluid in the accumulator 21 is not supplied to the solenoid proportional pressure reducing valves 27 to 30, etc. and the directional control valves 8 to 16 are not shifted and held in neutral positions. Therefore, no actuators are operated and the working unit is kept at rest in midair without descending. In other words, the actuators can be surely prevented from operating against the intention of the operator. At this time, from the viewpoint of ensuring safety when the prime mover 1 is next started up, a drive signal for minimizing the displacement volume of the main hydraulic pumps 3, 4 is output from the solenoid proportional pressure reducing valve drive circuit 38*c* of the controller 38 to the pump operating mechanisms 5, 6. Upon completion of the foregoing procedures in step S25, the process returns to the start.

While the above twelfth embodiment employs the rotational speed detector 37 for detecting a rotational speed of the prime mover 1 as the stop detecting means for detecting that the prime mover 1 is in a stopped state, the stop command device 2 for commanding stop of the prime mover 1 may be used as the stop detecting means instead of the rotational speed detector 37. Alternatively, the stop detecting means may be of a detector for detecting an output voltage of an electric generator equipped on the prime mover 1, or a pressure detector for detecting a delivery pressure of at least one of the auxiliary hydraulic pump 7 and the main hydraulic pumps 3, 4.

Thirteenth Embodiment

A thirteenth embodiment of the present invention will be described with reference to FIGS. 26 to 27. Identical members to those in the first to twelfth embodiments are denoted by the same reference numerals.

Figure 26:
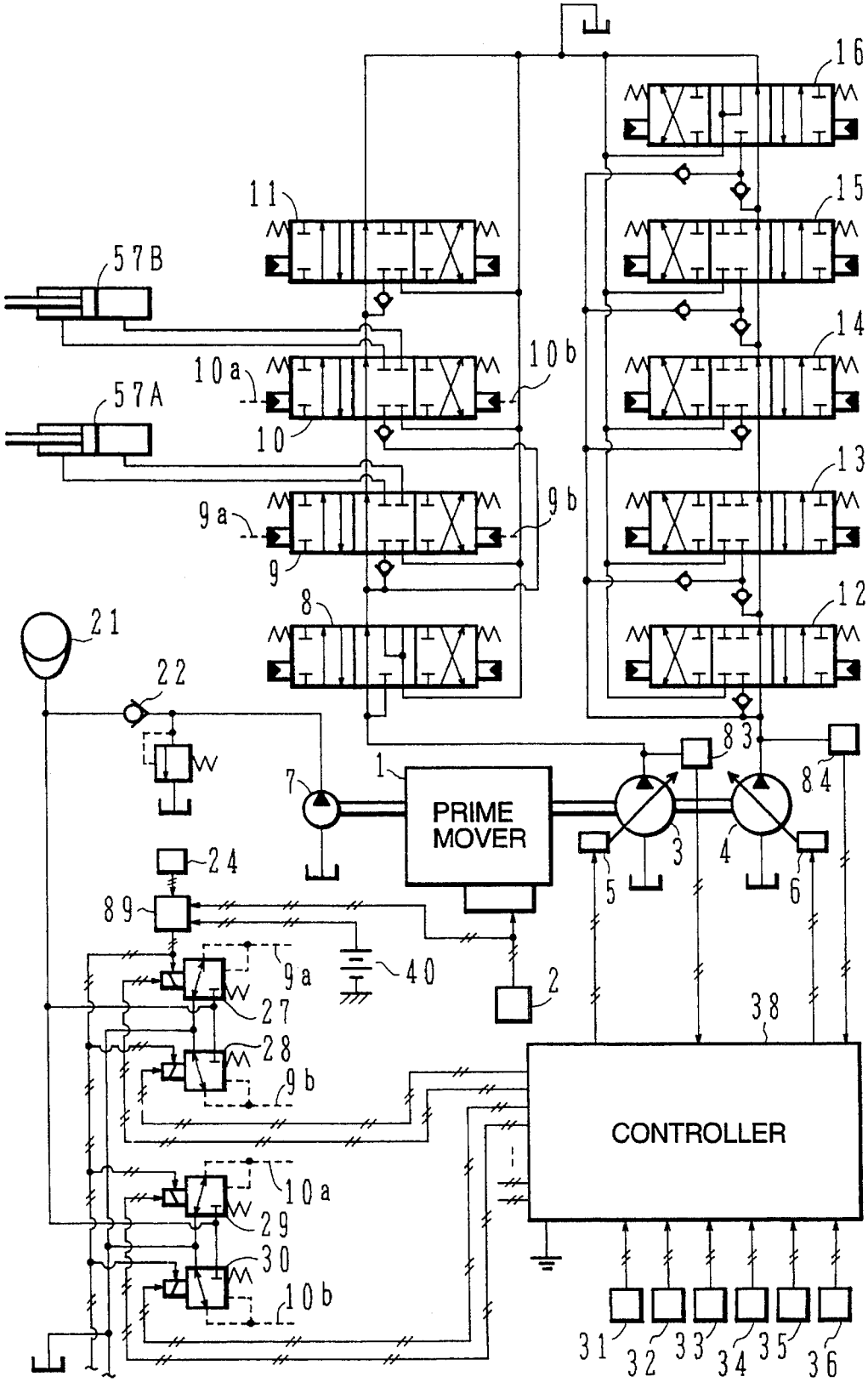
FIG. 26 is a circuit diagram of a hydraulic drive system for a construction machine according to a thirteenth embodiment of the present invention.
Figure 27:
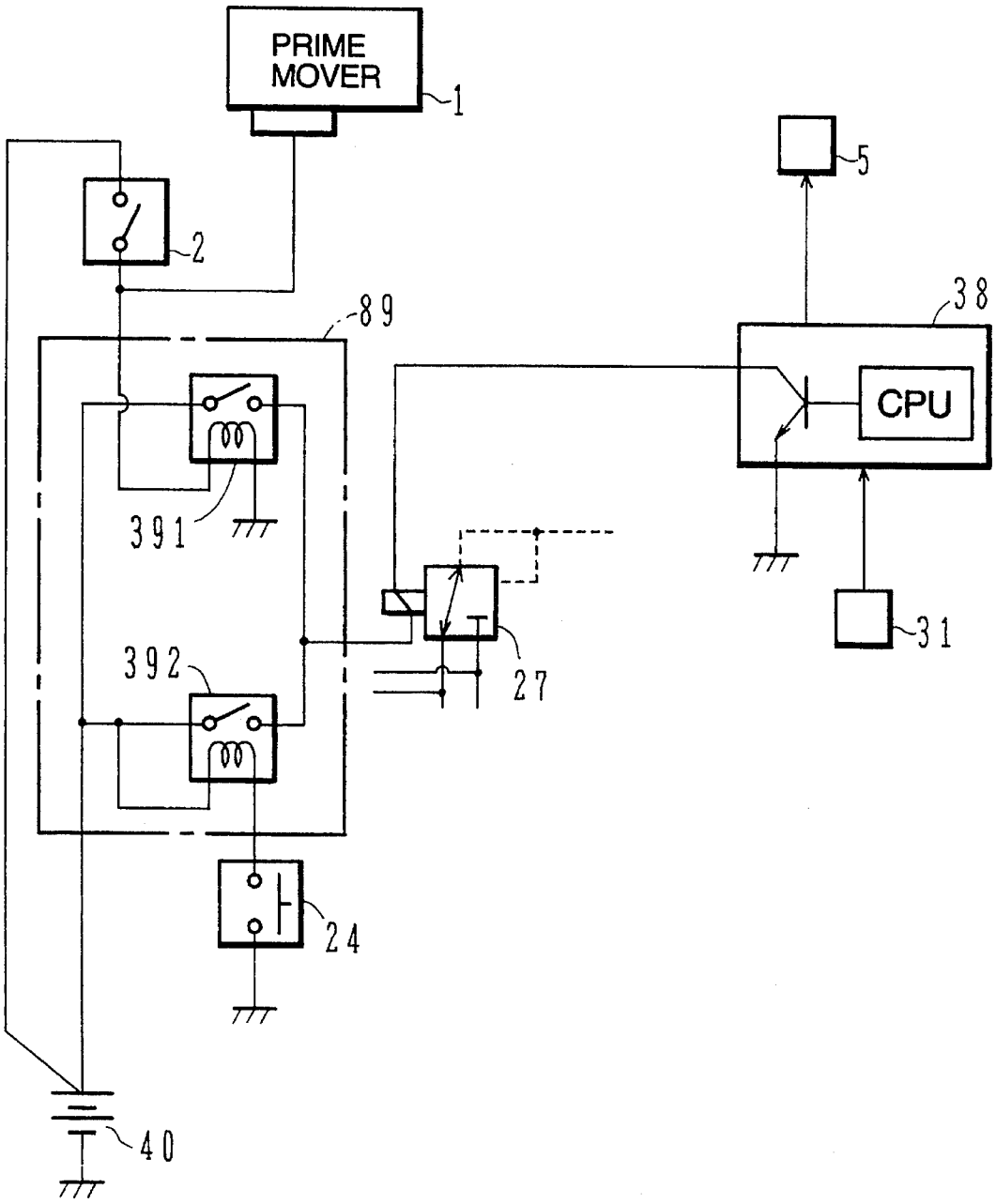
FIG. 27 is a diagram showing an electric system.

FIG. 26 shows a circuit diagram of a hydraulic drive system according to this embodiment. In FIG. 26, the hydraulic drive system of this embodiment is designed to cut off source power for solenoid proportional valves as the control valve shifting means to thereby enable the solenoid proportional valves from operating.

The hydraulic drive system of this embodiment is different from the hydraulic drive system of the eleventh embodiment in that the control valve operating mechanism for controlling the hydraulic fluid delivered from the auxiliary hydraulic pump 7 to operate the directional control valves 8 to 16 comprises operation detecting mechanisms 31 to 36 for detecting operation of respective control levers (not shown) as operation commands and outputting corresponding operation command signals to a controller 38, the controller 38 for outputting drive signals in accordance with the operation command signals, solenoid proportional pressure reducing valves 27 to 30, etc. having electric input means to receive the drive signals output from the controller 38 and outputting secondary pressures, which are resulted by reducing the pressure of the hydraulic fluid from the auxiliary hydraulic pump 7 based on a voltage applied from a battery 40 as a power supply in accordance with the drive signals, to the directional control valves 8 to 16, and a switching device 89 disposed in a circuit interconnecting the battery 40 and the solenoid proportional pressure reducing valves 27 to 30, etc. to be able to conduct and cut off the circuit, that the stop command device 2 is used as the stop detecting means for detecting that the prime mover 1 is in a stopped state, and that one of an turn-on command for bringing the switching device 89 into a turned-on state and a turn-off command for bringing it into a turned-off state is selectively input to the selection command device 24. Further, the controller 38 controls the solenoid proportional pressure reducing valves 27 to 30 to be brought into an operation enable state or an operation disable state in accordance with the stop command signal output from the stop command device 2 and the selection command signal from the selection command device 24. The remaining arrangement is substantially the same as in the first embodiment.

This embodiment arranged as above operates as follow. When the stop command signal for stopping the prime mover 1 is not output from the stop command device 2 and the prime mover 1 is in a driven state, the main hydraulic pumps 3, 4 are driven and the hydraulic fluid from the main hydraulic pumps 3, 4 is supplied to center bypass passages of the directional control valves 8 to 16. To describe the subsequent operation with reference to FIGS. 26 and 27, taking the solenoid proportional pressure reducing valve 27 as an example, a switch in the stop command device 2 is now in an ON state and a relay 391 in the switching device 89 is supplied with power from the battery 40 to close a contact. The solenoid proportional pressure reducing valve 27 is thereby conducted with the battery 40 through the relay 391, bringing the solenoid proportional pressure reducing valve 27 into an operable state. The hydraulic fluid delivered from the auxiliary hydraulic pump 7 is supplied to the accumulator 21 as well to be accumulated therein. When the control lever (not shown) is operated under such a condition, the operation detecting mechanism 31 detects the operation of the control lever as an operation command and outputs a corresponding operation command signal to the controller 38, which in turn outputs a drive signal depending on the amount by which the control lever is operated, to the solenoid proportional pressure reducing valve 27. The above process is equally applied to the other solenoid proportional pressure reducing valves. Accordingly, the hydraulic fluid from the auxiliary hydraulic pump 7 is supplied to a driving sector of the corresponding directional control valve through corresponding one of the solenoid proportional pressure reducing valves 27 to 30, etc., whereby the corresponding directional control valve is shifted. On this occasion, as a spool stroke of that directional control valve increases, an opening of a passage communicating a pump port with an actuator port of that directional control valve and an opening of a passage communicating the actuator port with a reservoir port of that directional control valve are increased gradually, while an opening of a throttle for opening and shutting the center bypass passage is reduced. Therefore, a flow rate of the hydraulic fluid flowing into the corresponding actuator or a flow rate of the hydraulic fluid flowing out of the corresponding actuator, and a direction of flow of the hydraulic fluid are adjusted, enabling that actuator to be operated at a speed depending on the amount by which the corresponding control lever is operated. As with the third embodiment, the controller 38 performs horsepower control such that a required drive signal in accordance with the first target displacement volume or the second target displacement volume is output to each of the pump operating mechanisms 5, 6.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. To describe the subsequent operation with reference to FIGS. 26 and 27, taking the solenoid proportional pressure reducing valve 27 again as an example, the switch in the stop command device 2 is now in an OFF state and, therefore, the relay 391 in the switching device 89 is supplied with no power from the battery 40 to open the contact.

When an operator desires to drive the actuator while the prime mover 1 is in the stopped state, it is only required to select the turn-on command in the selection command device 24. Upon the selection, a switch (see FIG. 27) in the selection command device 24 is turned to an ON state and a relay 392 in the switching device 89 is supplied with power from the battery 40 to close a contact. The solenoid proportional pressure reducing valve 27 is thereby conducted with the battery 40 through the relay 392, bringing the solenoid proportional pressure reducing valve 27 into an operable state. When the control lever (not shown) is now operated, the operation detecting mechanism 31 detects the operation of the control lever as an operation command and outputs a corresponding operation command signal to the controller 38, which in turn outputs a drive signal depending on the amount by which the control lever is operated, to the solenoid proportional pressure reducing valve 27. The above process is equally applied to the other solenoid proportional pressure reducing valves. Accordingly, the hydraulic fluid in the accumulator 21 is supplied to a driving sector of the corresponding directional control valve through corresponding one of the solenoid proportional pressure reducing valves 27 to 30, etc., whereby the corresponding directional control valve is shifted. As a result, the corresponding actuator can be brought into an operable state. Assuming now, for example, that the actuator is the boom cylinder 57A and the working unit including the boom **53*a* connected to the boom cylinder 57A is left at rest in midair upon stop of the prime mover 1, the directional control valve 9 is shifted by operating corresponding one of the control levers (not shown), enabling the boom cylinder 57A** to be operated with the dead load of the working unit, which results in a descent of the working unit.

On the other hand, when the operator has no intention of driving the actuator while the prime mover 1 is in the stopped state, it is only required to select the turn-off command in the selection command device 24. Upon the selection, the switch (see FIG. 27) in the selection command device 24 is turned to an OFF state and the relay 392 in the switching device 89 is kept open. At this time, the relay 391 also remains open as described above. Therefore, the solenoid proportional pressure reducing valve 27 is supplied with no power and hence disabled from operating to be held in its neutral return state. Accordingly, even if any of the control levers for the solenoid proportional pressure reducing valves 27 to 30, etc. is touched by a mistake under the above condition, there is no fear that the hydraulic fluid in the accumulator 21 may be supplied to the driving sectors of the directional control valves 8 to 16 to shift them. Thus, any shift of the directional control valve with the aid of the accumulator 21 is disabled. Therefore, no actuators are operated and the working unit is kept at rest in midair without descending. In other words, the actuators can be surely prevented from operating against the intention of the operator.

As with the first embodiment, even when the prime mover 1 is stopped against the intention of the operator because of a failure in itself or an overload imposed thereon, the solenoid proportional pressure reducing valves 27 to 30, etc. are brought into the neutral return state in which they are disabled from operating, by entering the stop command in the stop command device 2 and selecting the turn-off command in the selection command device 24 so as to turn off the switching device 89. Consequently, corresponding one of the directional control valves 8 to 16 can be returned to the neutral position and hence the operation of the corresponding actuator can be surely prevented.

Fourteenth Embodiment

Figure 28:
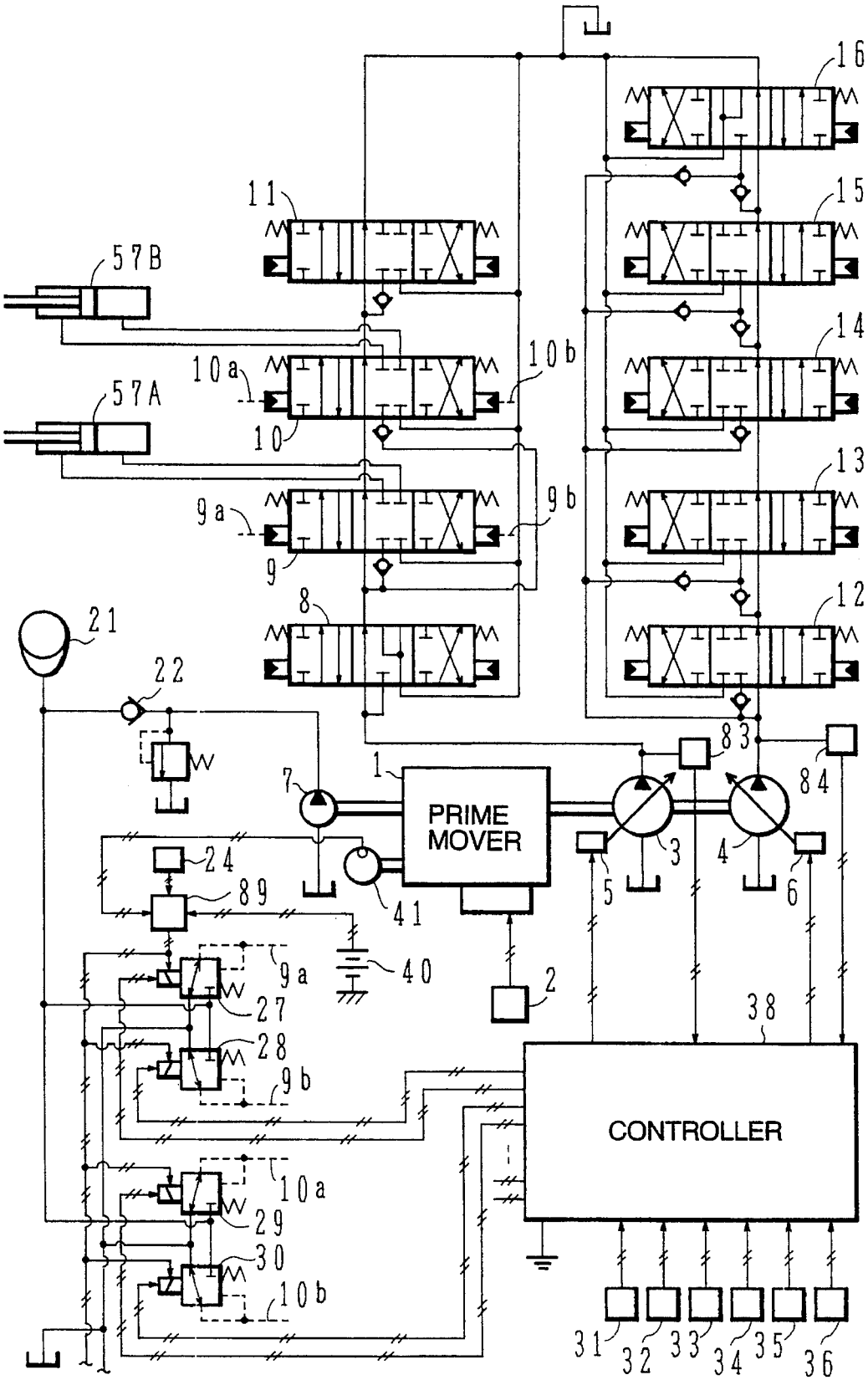
FIG. 28 is a circuit diagram of a hydraulic drive system for a construction machine according to a fourteenth embodiment of the present invention.
Figure 29:
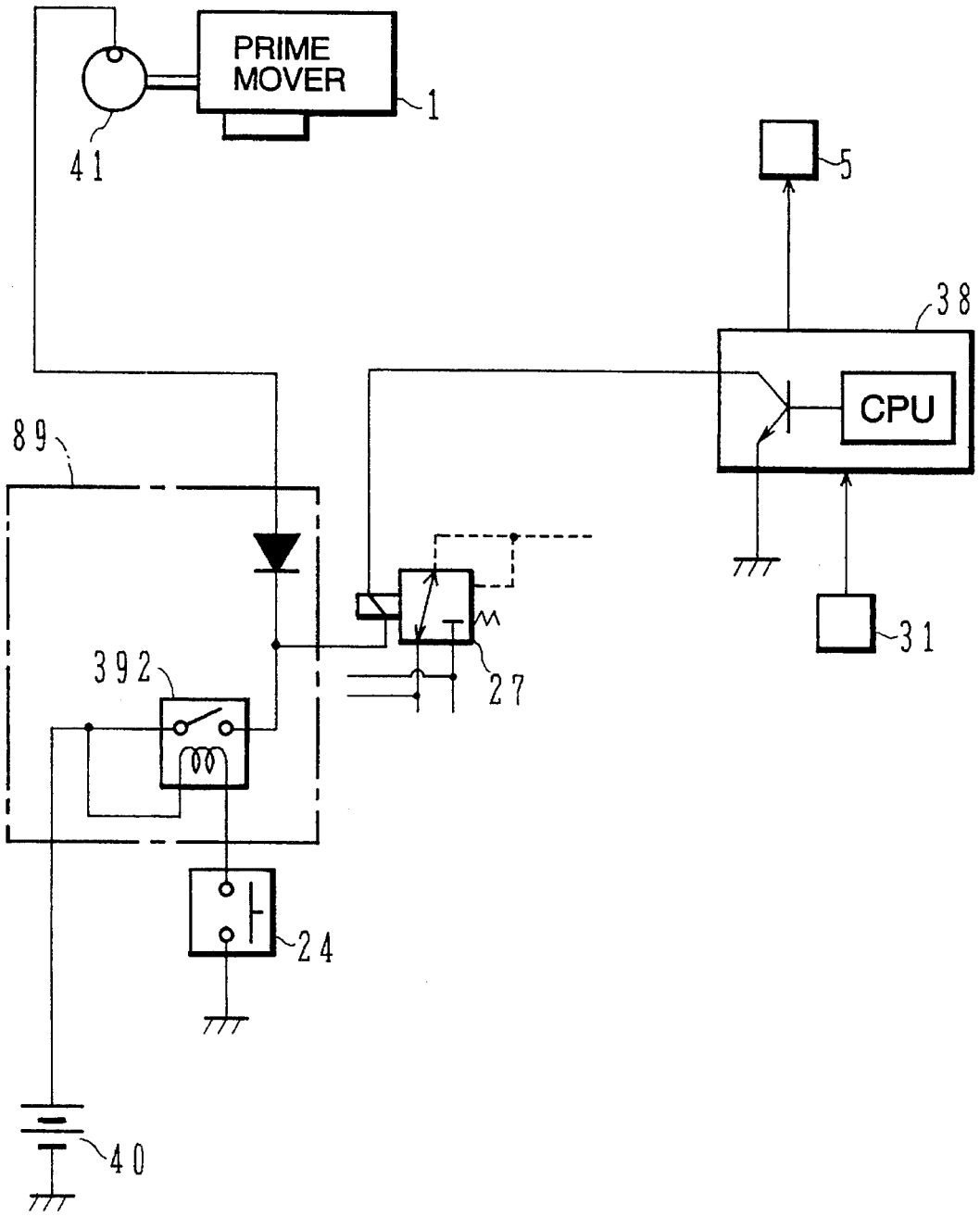
FIG. 29 is a diagram showing an electric system.

A fourteenth embodiment of the present invention will be described with reference to FIGS. 28 to 29. FIG. 28 shows a circuit diagram of a hydraulic drive system according to this embodiment. Identical members to those in the first to thirteenth embodiments are denoted by the same reference numerals.

Referring to FIG. 28, the hydraulic drive system of this embodiment is different from the hydraulic drive system of the thirteenth embodiment in that an electric generator 41 united in one with the prime mover 1 is provided as the stop detecting means for detecting that the prime mover 1 is in a stopped state, and that the relay 391 is omitted from the switching device 89 and the relay 392 in the switching device 89 is controlled to open and close in accordance with a voltage signal output from the electric generator 41 and the selection command signal output from the selection command device 24.

This embodiment arranged as above operates as follow. When the stop command signal for stopping the prime mover 1 is not output from the stop command device 2 and the prime mover 1 is in a driven state, the main hydraulic pumps 3, 4 are driven and the hydraulic fluid from the main hydraulic pumps 3, 4 is supplied to center bypass passages of the directional control valves 8 to 16. The hydraulic fluid delivered from the auxiliary hydraulic pump 7 is supplied to the accumulator 21 as well to be accumulated therein. To describe the subsequent operation with reference to FIGS. 28 and 29, taking the solenoid proportional pressure reducing valve 27 as an example, the electric generator 41 is now rotated by the prime mover 1 to produce a voltage which is supplied to the solenoid proportional pressure reducing valve 27 through a diode in the switching device 89, bringing the solenoid proportional pressure reducing valve 27 into an operable state. When the control lever (not shown) is operated under such a condition, the operation detecting mechanism 31 detects the operation of the control lever as an operation command and outputs a corresponding operation command signal to the controller 38, which in turn outputs a drive signal depending on the amount by which the control lever is operated, to the solenoid proportional pressure reducing valve 27. The above process is equally applied to the other solenoid proportional pressure reducing valves. Accordingly, the hydraulic fluid from the auxiliary hydraulic pump 7 is supplied to a driving sector of the corresponding directional control valve through corresponding one of the solenoid proportional pressure reducing valves 27 to 30, etc., whereby the corresponding directional control valve is shifted. The control for a flow rate and a direction of flow of the hydraulic fluid and the pump control are performed in a like manner to the thirteenth embodiment, and hence are not described here.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. To describe the subsequent operation with reference to FIGS. 28 and 29, taking the solenoid proportional pressure reducing valve 27 again as an example, the output voltage from the electric generator 41 equipped on the prime mover 1 is now zero and, therefore, the solenoid proportional pressure reducing valve 27 is supplied with no power and brought into a state in which it cannot be operated.

When an operator desires to drive the actuator while the prime mover 1 is in the stopped state, it is only required to select the turn-on command in the selection command device 24. Upon the selection, a switch (see FIG. 29) in the selection command device 24 is turned to an ON state and the relay 392 in the switching device 89 is supplied with power from the battery 40 to close a contact. The solenoid proportional pressure reducing valve 27 is thereby conducted with the battery 40 through the relay 392, bringing the solenoid proportional pressure reducing valve 27 into an operable state. When the control lever (not shown) is now operated, the operation detecting mechanism 31 detects the operation of the control lever as an operation command and outputs a corresponding operation command signal to the controller 38, which in turn outputs a drive signal depending on the amount by which the control lever is operated, to the solenoid proportional pressure reducing valve 27. The above process is equally applied to the other solenoid proportional pressure reducing valves. Accordingly, the hydraulic fluid in the accumulator 21 is supplied to a driving sector of the corresponding directional control valve through corresponding one of the solenoid proportional pressure reducing valves 27 to 30, etc., whereby the corresponding directional control valve is shifted. As a result, the corresponding actuator can be brought into an operable state. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating corresponding one of the control levers (not shown), enabling the boom cylinder 57A to be operated with the dead load of the working unit, which results in a descent of the working unit.

On the other hand, when the operator has no intention of driving the actuator while the prime mover 1 is in the stopped state, it is only required to select the turn-off command in the selection command device 24. Upon the selection, the switch (see FIG. 29) in the selection command device 24 is turned to an OFF state and the relay 392 in the switching device 89 is kept open. At this time, no voltage is produced from the electric generator 41 as described above. Therefore, the solenoid proportional pressure reducing valve 27 is supplied with no power and hence disabled from operating to be held in its neutral return state. Accordingly, even if any of the control levers for the solenoid proportional pressure reducing valves 27 to 30, etc. is touched by a mistake under the above condition, there is no fear that the hydraulic fluid in the accumulator 21 may be supplied to the driving sectors of the directional control valves 8 to 16 to shift them. Thus, any shift of the directional control valve with the aid of the accumulator 21 is disabled. Therefore, no actuators are operated and the working unit is kept at rest in midair without descending. In other words, the actuators can be surely prevented from operating against the intention of the operator.

As with the thirteenth embodiment, even when the prime mover 1 is stopped against the intention of the operator because of a failure in itself or an overload imposed thereon, the solenoid proportional pressure reducing valves 27 to 30, etc. are brought into the neutral return state in which they are disabled from operating, by selecting the turn-off command in the selection command device 24 so as to turn off the switching device 89. Consequently, corresponding one of the directional control valves 8 to 16 can be returned to the neutral position and hence the operation of the corresponding actuator can be surely prevented.

Fifteenth Embodiment

A fifteenth embodiment of the present invention will be described with reference to FIGS. 30 to 32.

Figure 30:
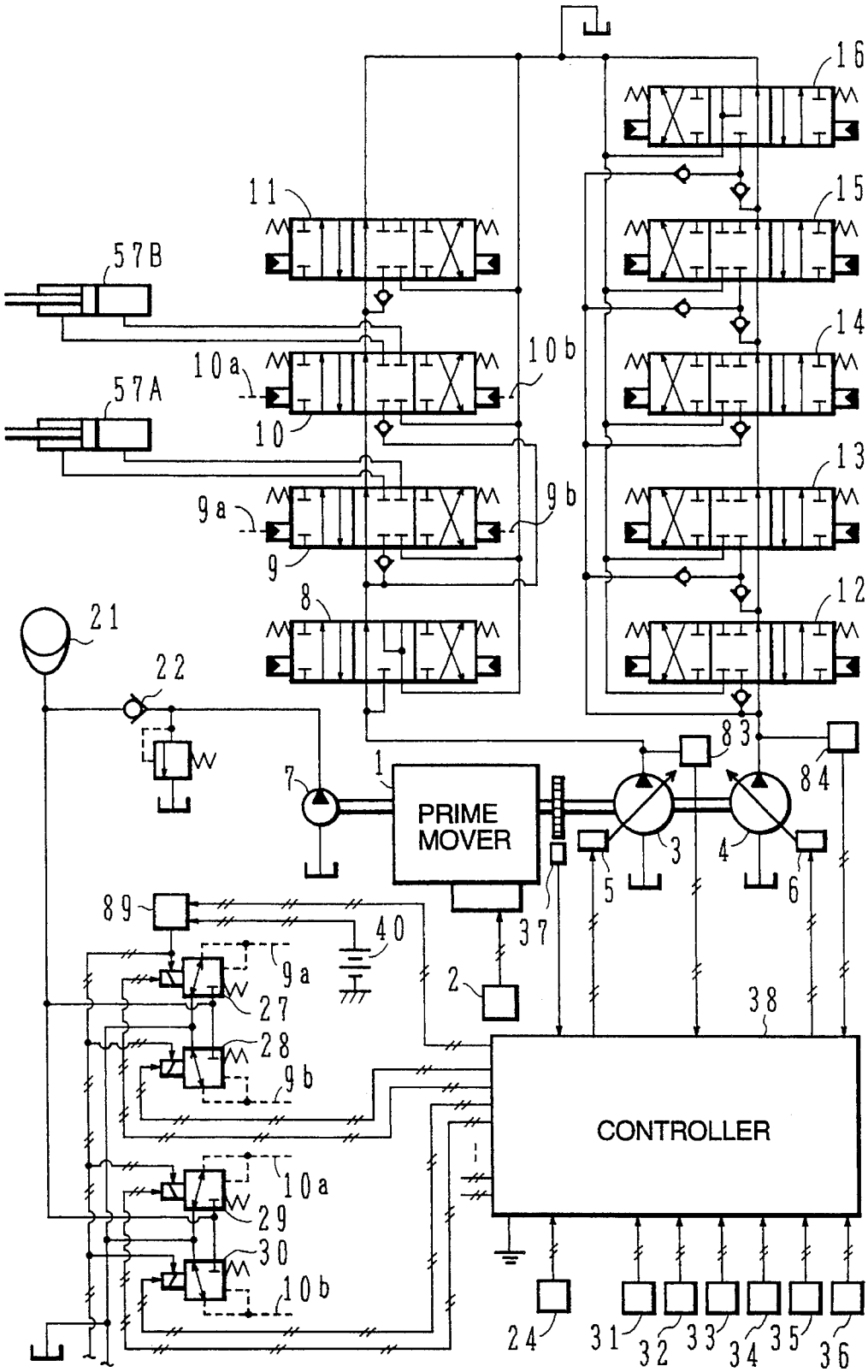
FIG. 30 is a circuit diagram of a hydraulic drive system for a construction machine according to a fifteenth embodiment of the present invention.

FIG. 30 shows a circuit diagram of a hydraulic drive system for a construction machine according to this embodiment. Identical members to those in the first to fourteenth embodiments are denoted by the same reference numerals.

Referring to FIG. 30, the hydraulic drive system of this embodiment is different from the hydraulic drive system of the thirteenth embodiment in that a rotational speed detector 37 for detecting a rotational speed of the prime mover 1 is provided as the stop detecting means for detecting that the prime mover 1 is in a stopped state, that the controller 38 controls the switching device 89 to be turned on and off in accordance with a rotational speed signal output from the rotational speed detector 37 and the selection command signal output from the selection command device 24, and that the relay 391 is omitted from the switching device 89 and the relay 392 is controlled by the controller 38 to open and close. The remaining arrangement is substantially the same as in the fourteenth embodiment.

Figure 31:
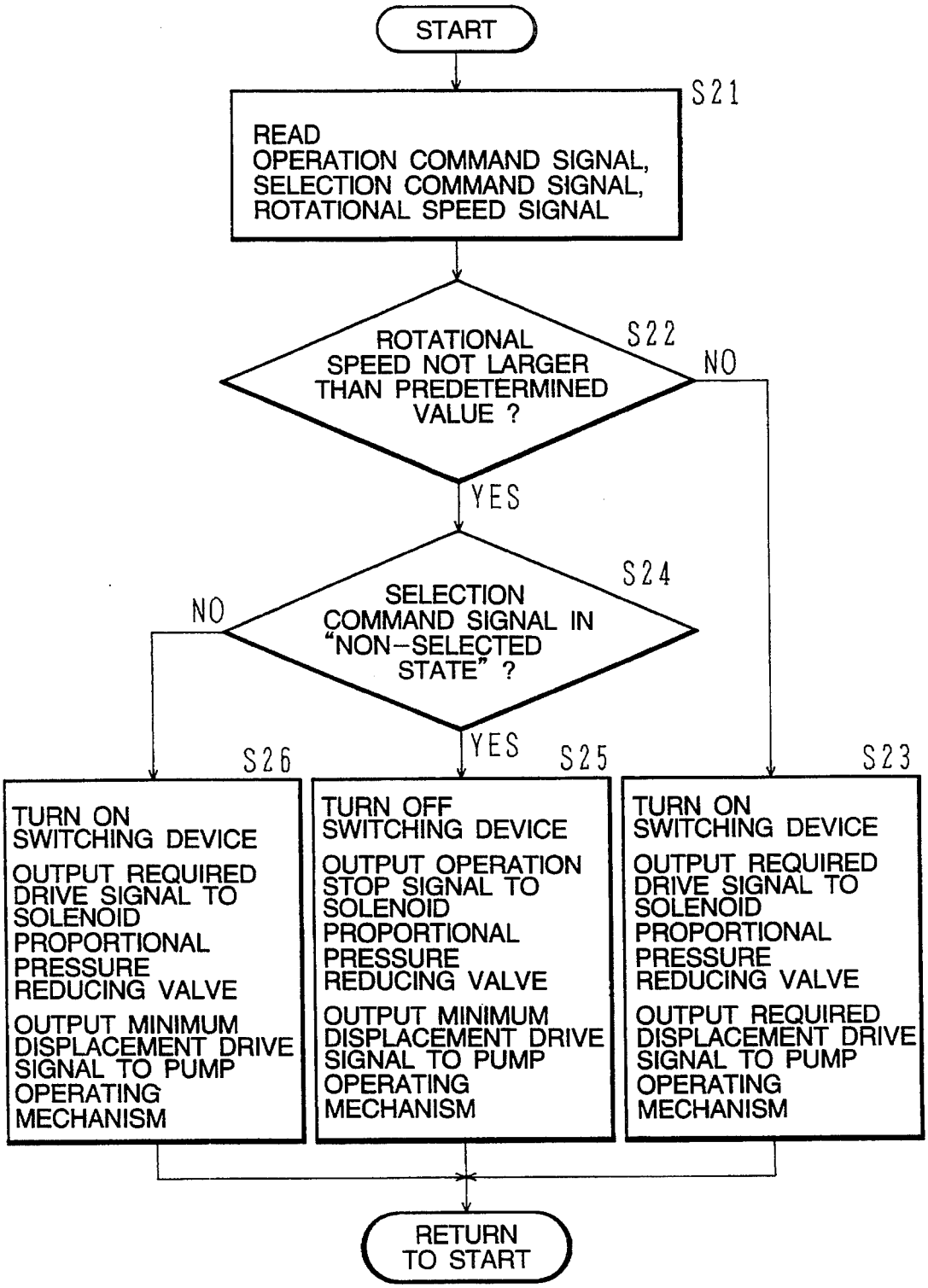
FIG. 31 is a flowchart showing operation of the hydraulic drive system for a construction machine according to the fifteenth embodiment.
Figure 32:
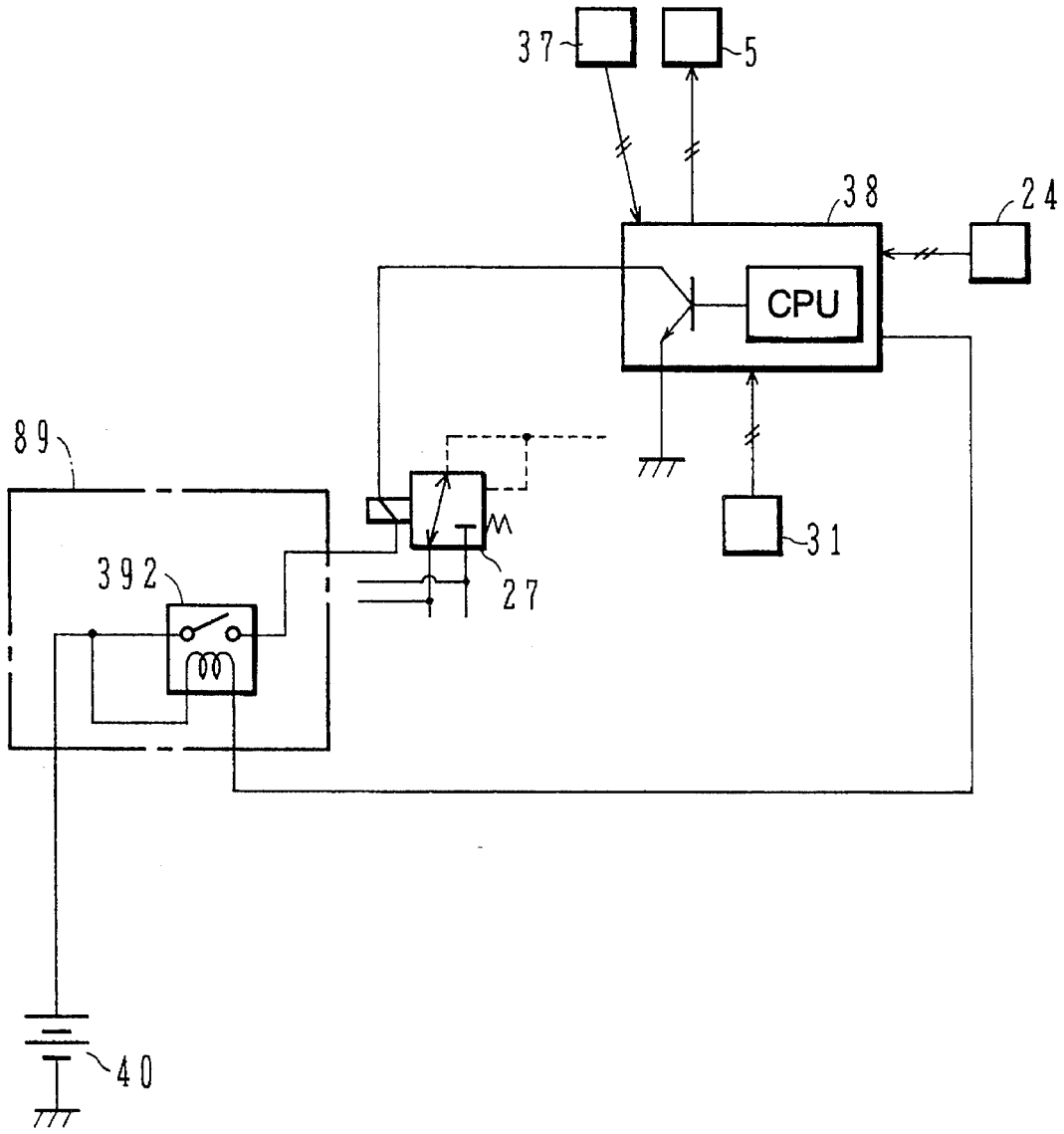
FIG. 32 is a diagram showing an electric system.

Operation of this embodiment arranged as above will now be described with reference to a flowchart of FIG. 31 showing a process sequence carried out in the controller 38.

First, as shown at step S21, the controller 38 reads the operation command signals output from the operation detecting mechanisms 31 to 36, the selection command signal output from the selection command device 24, and the rotational speed signal output from the rotational speed detector 37. Then, the process goes to step S22 to determine whether a value of the rotational speed signal is not larger than the predetermined value. If the decision in step S22 is not satisfied, then the process goes to step S23 upon judgment that the prime mover 1 is in a driven state. In step S23, the controller 38 controls the switching device 89 to turn on. To describe that operation with reference to FIG. 32, taking the solenoid proportional pressure reducing valve 27 as an example, the controller 38 is conducted with the battery 40 as a power supply to close the relay 392. The solenoid proportional pressure reducing valve 27 is thereby conducted with the battery 40 through the relay 392, bringing the solenoid proportional pressure reducing valve 27 into an operable state. The hydraulic fluid delivered from the auxiliary hydraulic pump 7 is supplied to the accumulator 21 as well to be accumulated therein. When the control lever (not shown) is operated under such a condition, the operation detecting mechanism 31 detects the operation of the control lever as an operation command and outputs a corresponding operation command signal to the controller 38, which in turn outputs a drive signal depending on the amount by which the control lever is operated, to the solenoid proportional pressure reducing valve 27. The above process is equally applied to the other solenoid proportional pressure reducing valves. Accordingly, the hydraulic fluid from the auxiliary hydraulic pump 7 is supplied to a driving sector of the corresponding directional control valve through corresponding one of the solenoid proportional pressure reducing valves 27 to 30, etc., whereby the corresponding directional control valve is shifted. On this occasion, as a spool stroke of that directional control valve increases, an opening of a passage communicating a pump port with an actuator port of that directional control valve and an opening of a passage communicating the actuator port with a reservoir port of that directional control valve are increased gradually, while an opening of a throttle for opening and shutting the center bypass passage is reduced. Therefore, a flow rate of the hydraulic fluid flowing into the corresponding actuator or a flow rate of the hydraulic fluid flowing out of the corresponding actuator, and a direction of flow of the hydraulic fluid are adjusted, enabling that actuator to be operated at a speed depending on the amount by which the corresponding control lever is operated. As with the third embodiment, the controller 38 performs horsepower control such that a required drive signal in accordance with the first target displacement volume or the second target displacement volume is output to each of the pump operating mechanisms 5, 6. Upon completion of the foregoing procedures in step S23, the process returns to the start.

On the other hand, when the stop command signal for stopping the prime mover 1 is output from the stop command device 2 while the prime mover 1 is in the driven state as mentioned above, the prime mover 1 is stopped, whereupon the driving of the main hydraulic pumps 3, 4 is stopped and the operation of the actuator is also stopped. Therefore, the working unit connected to the actuator is held at rest. At this time, since the decision in above step S22 in the controller 38 is satisfied, the process goes to step S24 upon judgment that the prime mover 1 is in a non-driven state. In step S24, it is determined whether the selection command signal output from the selection command device 24 is a signal in a non-selected state or not, i.e., whether the selection command signal is a turn-off command signal for bringing the solenoid proportional pressure reducing valves 27 to 30, etc. into a standstill state. When an operator selects the turn-on command in the selection command device 24, which is a command to select driving of the actuator, with an intention of driving the actuator, the decision in step S24 is not satisfied and the process goes to step S26. In step S26, to allow the directional control valve to be effectively shifted with the aid of the accumulator 21, the controller 38 controls the switching device 89 to turn on similarly to above step S23. Then, upon the operator manipulating any of the control levers (not shown), the controller 38 outputs a required drive signal depending on the amount by which the control lever is operated and which is detected by corresponding one of the operation detecting mechanisms 31 to 36, to corresponding one of the solenoid proportional pressure reducing valves 27 to 30, etc., whereupon the hydraulic fluid in the accumulator 21 is supplied to a driving sector of the corresponding directional control valve through the corresponding pressure reducing valve, and the corresponding directional control valve is shifted. Accordingly, the corresponding actuator can be brought into an operable state. Assuming now, for example, that the actuator is the boom cylinder 57A and the working unit including the boom 53*a* connected to the boom cylinder 57A is left at rest in midair upon stop of the prime mover 1, the directional control valve 9 is shifted by operating corresponding one of the control levers, enabling the boom cylinder 57A to be operated with the dead load of the working unit, which results in a descent of the working unit. At this time, from the viewpoint of ensuring safety when the prime mover 1 is next started up, a drive signal for minimizing the displacement volume of the main hydraulic pumps 3, 4 is output to the pump operating mechanisms 5, 6 from the controller 38. Upon completion of the foregoing procedures in step S26, the process returns to the start.

On the other hand, when the operator selects the turnoff command in the selection command device 24, which is a command to select non-driving of the actuator, with no intention of driving the actuator while the prime mover 1 is in the stopped state as mentioned above, the decision in step S24 as to whether the selection command signal is a signal in the non-selected state or not is satisfied and the process goes to step S25. In step S25, to disable any shift of the directional control valve with the aid of the accumulator 21, the controller 38 controls the switching device 89 to turn off. To describe that operation, taking the solenoid proportional pressure reducing valve 27 as an example, the controller 38 is cut off from the battery 40 as a power supply to keep the relay 392 open. The solenoid proportional pressure reducing valve 27 is supplied with no power and hence disable from operating to be held in its neutral state. The above process is equally applied to the other solenoid proportional pressure reducing valves. Accordingly, even if the operator or any other person touches any of the control levers by a mistake under the above condition, since the solenoid proportional pressure reducing valves 27 to 30, etc. remain held in the neutral positions, the hydraulic fluid in the accumulator 21 is not supplied to the solenoid proportional pressure reducing valves 27 to 30, etc. and the directional control valves 8 to 16 are not shifted and held in neutral positions. Therefore, no actuators are operated and the working unit is kept at rest in midair without descending. In other words, the actuators can be surely prevented from operating against the intention of the operator. At this time, from the viewpoint of ensuring safety when the prime mover 1 is next started up, a drive signal for minimizing the displacement volume of the main hydraulic pumps 3, 4 is output from the controller 38 to the pump operating mechanisms 5, 6. Upon completion of the foregoing procedures in step S25, the process returns to the start.

While the above fifteenth embodiment employs the rotational speed detector 37 for detecting a rotational speed of the prime mover 1 as the stop detecting means for detecting that the prime mover 1 is in a stopped state, the stop command device 2 for commanding stop of the prime mover 1 may be used as the stop detecting means instead of the rotational speed detector 37. Alternatively, the stop detecting means may be of a detector for detecting an output voltage of an electric generator equipped on the prime mover 1, or a pressure detector for detecting a delivery pressure of at least one of the auxiliary hydraulic pump 7 and the main hydraulic pumps 3, 4.

Industrial Applicability

According to the present invention, for example, when an operator desires to drive an actuator while a prime mover is in its stopped state, he selects driving of the actuator in selection means, whereupon shift control means allows a directional control valve to be effectively shifted with the aid of accumulator means, because stop detecting means detects that the prime mover is in the stopped state. Specifically, a hydraulic fluid stored in the accumulator means as a hydraulic source is supplied through the control valve operating means to a driving sector of the directional control valve corresponding to the actuator. Thus, since the directional control valve can be shifted upon operation of the control valve operating means, the actuator corresponding to that directional control valve is brought into an operable state. For example, in the case of that actuator being connected to a working unit which is left in midair, the actuator is driven with the dead load of the working unit, enabling the working unit to descend.

On the other hand, when the operator has no intention to drive the actuator while the prime mover is in the stopped state, he selects non-driving of the actuator in the selection means, whereupon the shift control means disables the directional control valve from shifting with the aid of the accumulator means, because the stop detecting means detects that the prime mover is in the stopped state. At this time, therefore, even if the operator or any other person touches the control valve operating means by a mistake, the hydraulic fluid stored in the accumulator means will not be supplied through the control valve operating means to a driving sector of the directional control valve. As a result, the directional control valve is not shifted and held in its neutral position to prevent the corresponding actuator from being operated.

We claim:

1. A hydraulic drive system for a construction machine comprising a prime mover (1), main hydraulic pumps (3, 4) driven by said prime mover (1), actuators (57A, 57B, 57C, 56A, 54) driven by a hydraulic fluid delivered from said main hydraulic pumps (3, 4), directional control valves (8–16) for controlling flows of the hydraulic fluid supplied from said main hydraulic pumps (3, 4) to said actuators (57A, 57B, 57C, 56A, 54), an auxiliary hydraulic pump (7) driven by said prime mover (1), control valve operating means (67, 69; 17–20, 68, 70; 27–30, 31–36, 38) for controlling the hydraulic fluid delivered from said auxiliary hydraulic pump (7) to shift said directional control valves (8–16), and accumulator means (21) disposed in a line interconnecting said auxiliary hydraulic pump (7) and said control valve operating means (67, 69; 17–20, 68, 70; 27–30, 31–36, 38) and used as a hydraulic source for said control valve operating means (67, 69; 17–20, 68, 70; 27–30, 31–36, 38) to shift said directional control valves (8–16) when said prime mover (1) is stopped, wherein:

said hydraulic drive system further comprises stop detecting means (2, 26, 37, 41, 49, 47B, 48B) for detecting that said prime mover (1) is in a stopped state;

selection means (24, 47A, 48A) for selecting whether or not said actuators (57A, 57B, 57C, 56A, 54) are to be driven when said prime mover (1) is in the stopped state; and shift control means (23, 39–42, 43–48, 17*c*–20*c*, 89; 17*a*; 25, 38) for enabling said directional control valves (8–16) to be shifted by using said accumulator means (21) when said stop detecting means (2, 26, 37, 41, 49, 47B, 48B; 25, 39) detects that said prime mover (1) is stopped and said selection means (24, 47A, 48A) selects that said actuators (57A, 57B, 57C, 56A, 54) are to be driven, and disabling said directional control valves (8–16) from shifting with the use of said accumulator means (21) when said stop detecting means (2, 26, 37, 41, 49, 47B, 48B; 25, 39) detects that said prime mover (1) is stopped and said selection means (24, 47A, 48A) selects that said actuators (57A, 57B, 57C, 56A, 54) are not to be driven.

2. A hydraulic drive system for a construction machine according to claim 1, wherein said shift control means (23, 39–42, 43–48, 17*c*–20*c*, 89; 17*a*; 25, 38) enables said directional control valves (8–16) to be shifted by using said auxiliary hydraulic pump (7) as a hydraulic source when said stop detecting means (2, 26, 37, 41, 49, 47B, 48B; 25, 39) does not detect that said prime mover (1) is in the stopped state.

3. A hydraulic drive system for a construction machine according to claim 1, wherein said shift control means includes valve means (23, 39–42, 45–48) disposed in one of a line interconnecting said accumulator means (21) and said control valve operating means (67, 69; 17–20, 68, 70; 27–30, 31–36, 38) and a line interconnecting said control valve operating means (67, 69; 17–20, 68, 70; 27–30, 31–36, 38) and said directional control valves (8–16), and means (25, 38) for shifting said valve means to shut off said one line.

4. A hydraulic drive system for a construction machine according to claim 1, wherein said shift control means includes opening/shutting means (23) disposed in the line interconnecting said accumulator means (21) and said control valve operating means (67, 69; 17–20, 68, 70; 27–30, 31–36, 38) for opening and shutting said line, said selection means includes selection command means (24) for selectively receiving one of an open command to drive said opening/shutting means (23) into an open position and a shut command to drive said opening/shutting means (23) into a shut position, and outputting a corresponding selection command signal, and said shift control means further includes opening/shutting control means (25, 38) for controlling operation of said opening/shutting means (23) in accordance with a stop detection signal output from said stop detecting means (2, 26, 37) and said selection command signal.

5. A hydraulic drive system for a construction machine according to claim 1, wherein said shift control means includes auxiliary control valves (39–42, 43–46) disposed in pilot lines interconnecting said control valve operating means (67, 69; 17–20, 68, 70; 27–30, 31–36, 38) and said directional control valves (8–16) and selectively shifted to either first positions to hold said directional control valves (8–16) in neutral positions and second positions to bring said directional control valves (8–16) into operable positions, said selection means includes selection command means (24) for selectively receiving one of a shift command to shift said auxiliary control valves (39–42, 43–46) to the first positions and a shift command to shift said auxiliary control valves (39–42, 43–46) to the second positions, and outputting a corresponding selection command signal, and said shift control means further includes auxiliary control valve control means (25, 38) for controlling operation of said auxiliary control valves (39–42, 43–46) in accordance with a stop detection signal output from said stop detecting means (2, 26, 37) and said selection command signal.

6. A hydraulic drive system for a construction machine according to claim 1, wherein said shift control means includes auxiliary control valves (47, 48) disposed in pilot lines interconnecting said control valve operating means (67, 69; 17–20, 68, 70) and said directional control valves (8–16) and selectively shifted to either first positions to hold said directional control valves (8–16) in neutral positions and second positions to bring said directional control valves (8–16) into operable positions, and means (47A, 48A) for shifting said auxiliary control valves (47, 48) to the second positions when said stop detecting means (47B, 48B) do not detect that said prime mover (1) is in the stopped state, and said selection means is means (47A, 48A) for manually shifting said auxiliary control valves (47, 48) to either the first positions or the second positions.

7. A hydraulic drive system for a construction machine according to claim 1, wherein said shift control means includes lock means (17*c*–20*c*) for locking said control valve operating means (67, 69; 17–20, 68, 70) to be unable to operate, said selection means includes selection command means (24) for selectively receiving one of a lock command to actuate said lock means (17*c*–20*c*) into a locked state and an unlock command to release said lock means (17*c*–20*c*) from the locked state, and outputting a corresponding selection command signal, and said shift control means further includes lock control means (17*a;* 25) for controlling actuation of said lock means (17*c*–20*c*) in accordance with a stop detection signal output from said stop detecting means (25) and said selection command signal.

8. A hydraulic drive system for a construction machine according to claim 7, wherein said control valve operating means (67, 69; 17–20, 68, 70) includes control levers (68, 70) operated by an operator and control valves (17–20) for controlling the hydraulic fluid depending on operation of said control levers (68, 70), and said lock means includes are means (17*c*–20*c*) for enabling said control levers to be angularly movable when said selection command means (24) receives said unlock command, and mechanically locking said control levers to be not angularly movable when said selection command means (24) receives said lock command.

9. A hydraulic drive system for a construction machine according to claim 1, wherein said control valve operating means (67, 69; 17–20, 68, 70) includes pressure reducing valves (27–30) having electric input means and outputting secondary pressures, which are resulted by reducing a pressure of the hydraulic fluid from said auxiliary hydraulic pump (7), to said directional control valves (8–16), said selection means includes selection command means (24) for selectively receiving one of an operation stop command to disable said pressure reducing valves (27–30) from operating and an operation command to enable said pressure reducing valves (27–30) to be operated, and outputting a corresponding selection command signal, and said shift control means includes means (38) for controlling operation of said pressure reducing valves in accordance with a stop detection signal output from said stop detecting means (37) and said selection command signal.

10. A hydraulic drive system for a construction machine according to claim 1, wherein said control valve operating means includes pressure reducing valves (27–30) having electric input means and outputting secondary pressures, which are resulted by reducing a pressure of the hydraulic fluid from said auxiliary hydraulic pump (7), to said directional control valves (8–16), operation detecting means (31–36) for detecting a manual command from an operator and outputting a corresponding electric operation command signal, and pressure reducing valve driving means (38) for outputting a drive signal to the input means of said pressure reducing valves (27–30) in accordance with said operation command signal.

11. A hydraulic drive system for a construction machine according to claim 1, wherein said control valve operating means (67, 69; 17–20, 68, 70) includes manually operated pressure reducing valves (17–20) for outputting secondary pressures, which are resulted by reducing a pressure of the hydraulic fluid from said auxiliary hydraulic pump (7), to said directional control valves (8–16).

12. A hydraulic drive system for a construction machine according to claim 1, wherein said control valve operating means includes pressure reducing valves (27–30) having electric input means and outputting secondary pressures, which are resulted by reducing a pressure of the hydraulic fluid from said auxiliary hydraulic pump (7), to said directional control valves (8–16), operation detecting means (31–36) for detecting a manual command from an operator and outputting a corresponding electric operation command signal, and pressure reducing valve driving means (38) for outputting a drive signal to the input means of said pressure reducing valves (27–30) in accordance with said operation command signal, said shift control means (89, 38) includes switching means (89) for connecting and disconnecting a circuit interconnecting a power supply (40, 41) and the input means of said pressure reducing valves (27–30), said selection means includes selection command means (24) for selectively receiving a turn-off command to turn off said switching means (89) and a turn-on command to turn on said switching means (89), and outputting a corresponding selection command signal, and said shift control means (89, 38) further includes switching control means (89) for controlling operation of said switching means in accordance with a stop detection signal output from said stop detecting means (2, 37; 39) and said selection command signal.

13. A hydraulic drive system for a construction machine according to claim 12, wherein said stop detecting means includes stop command means (2) for receiving a stop command to command a stop of said prime mover (1).

14. A hydraulic drive system for a construction machine according to claim 12, wherein said stop detecting means includes rotational speed detecting means (37) for detecting a rotational speed of said prime mover (1).

15. A hydraulic drive system for a construction machine according to claim 12, wherein said stop detecting means includes a pressure detector (26) for detecting a delivery pressure of at least one of said main hydraulic pumps (3, 4) and said auxiliary hydraulic pump (7).

16. A hydraulic drive system for a construction machine according to claim 12, wherein said stop detecting means includes voltage detecting means (25, 39) for detecting an output voltage of an electric generator (41, 49) equipped on said prime mover (1).

17. A hydraulic drive system for a construction machine according to claim 1, wherein said stop detecting means includes stop command means (2) for receiving a stop command to command a stop of said prime mover (1).

18. A hydraulic drive system for a construction machine according to claim 1, wherein said stop detecting means includes rotational speed detecting means (37) for detecting a rotational speed of said prime mover (1).

19. A hydraulic drive system for a construction machine according to claim 1, wherein said stop detecting means includes a pressure detector (26) for detecting a delivery pressure of at least one of said main hydraulic pumps (3, 4) and said auxiliary hydraulic pump (7).

20. A hydraulic drive system for a construction machine according to claim 1, wherein said stop detecting means includes voltage detecting means (25, 39) for detecting an output voltage of an electric generator (41, 49) equipped on said prime mover (1).

* * * * *